US007176843B2

(12) United States Patent
Shimasaki et al.

(10) Patent No.: US 7,176,843 B2
(45) Date of Patent: Feb. 13, 2007

(54) WIDEBAND ANTENNA AND COMMUNICATION APPARATUS HAVING THE ANTENNA

(75) Inventors: Hiroshi Shimasaki, Ome (JP); Satoshi Mizoguchi, Ome (JP); Masao Teshima, Kunitachi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 128 days.

(21) Appl. No.: 11/092,161

(22) Filed: Mar. 28, 2005

(65) Prior Publication Data

US 2006/0017643 A1 Jan. 26, 2006

(30) Foreign Application Priority Data

Jul. 12, 2004 (JP) ..... 2004-205042
Jan. 11, 2005 (JP) ..... 2005-004196
Feb. 22, 2005 (JP) ..... 2005-045783

(51) Int. Cl.
*H01Q 9/28* (2006.01)

(52) U.S. Cl. ..... 343/795; 343/700 MS; 343/702

(58) Field of Classification Search ..... 343/795, 343/793, 700 MS, 702, 820, 821
See application file for complete search history.

(56) References Cited

U.S. PATENT DOCUMENTS 4,843,403 A 6/1989 Lalezari et al.
4,860,019 A 8/1989 Jiang et al.
5,872,546 A 2/1999 Ihara et al.
5,986,609 A * 11/1999 Spall ..... 343/702
6,018,324 A 1/2000 Kitchener
6,342,866 B1 * 1/2002 Ho et al. ..... 343/795
6,842,141 B2 * 1/2005 Suh et al. ..... 343/700 MS
2003/0034932 A1 2/2003 Huebner et al.
2005/0110687 A1 * 5/2005 Starkie et al. ..... 343/700 MS
2005/0237255 A1 * 10/2005 Zhang et al. ..... 343/795

FOREIGN PATENT DOCUMENTS

EP 0 766 343 A2 4/1997
JP 4-270504 A 9/1992
JP 3273463 B2 2/2002

OTHER PUBLICATIONS

Scong-Youp, S. Et al., "A novel broadband antenna, the low-profile dipole planar inverted cone antenna (LpdiPICA)" Antennas and Propagation Society Symposium, 2004. IEEE Monterey, CA, USA, Jun. 20-25, 2004, Picataway, NJ, USA, IEEE, vol. 1, pp. 775-778, XP010721160, ISBN: 0-7803-8302-8.

* cited by examiner

*Primary Examiner*—Hoang V. Nguyen
*Assistant Examiner*—Ephrem Alemu
(74) *Attorney, Agent, or Firm*—Frishauf, Holtz, Goodman & Chick, PC

(57) ABSTRACT

A wideband antenna in which a first and second conductive element are arranged so that a notch is formed between the first and second conductive element, wherein the first and second conductive element have shapes satisfying two conditions (i) a sum of the lengths of sides facing the notch and a first side terminating at one edge of a wider opening of the notch, these sides pertaining to the first conductive element, and the lengths of sides facing the notch and a second side terminating at one edge of the wider opening, these sides pertaining to the second conductive element, is approximately half of a first wavelength, and (ii) a sum of the lengths of sides pertaining to the first conductive element and facing the notch, and the lengths of sides pertaining to the second conductive element and facing the notch is approximately half of a second wavelength.

24 Claims, 69 Drawing Sheets

WIDEBAND ANTENNA AND COMMUNICATION APPARATUS HAVING THE ANTENNA

CROSS-REFERENCE TO RELATED APPLICATIONS

This application is based upon and claims the benefit of priority from prior Japanese Patent Applications No. 2004-205042, filed Jul. 12, 2004; No. 2005-004196, filed Jan. 11, 2005; and No. 2005-045783, filed Feb. 22, 2005, the entire contents of all of which are incorporated herein by reference.

BACKGROUND OF THE INVENTION

1. Field of the Invention

The present invention relates to a wideband antenna for transmitting and receiving radio waves and a communication apparatus having the antenna.

2. Description of the Related Art

An antenna having a structure in which two metal elements are disposed opposite to each other so that a gap is interposed between them is disclosed. (Refer to U.S. Pat. No. 4,843,403)

However, the transmitting and receiving band in a required frequency band may not be sufficiently extended merely by unconditionally forming the structure disclosed by U.S. Pat. No. 4,843,403.

BRIEF SUMMARY OF THE INVENTION

In view of the circumstances stated, it has been desired to surely extend the transmitting and receiving band in the required frequency band.

According to a first aspect of the present invention, there is provided a wideband antenna in which a first conductive element and a second conductive element are arranged so that a first notch of which the width becomes wider with getting apart from a reference point to be a power feeding point is formed between the first element and the second element, wherein the first element and the second element have shapes satisfying two conditions: (i) a sum of the lengths of one or more sides facing the first notch and a first side terminating at one edge of a wider opening of the first notch, these sides pertaining to the first element, and the lengths of one or more sides facing the first notch and a second side terminating at one edge of the wider opening of the first notch, these sides pertaining to the second element, is approximately half of a first wavelength corresponding to a first frequency within a required frequency band; and (ii) a sum of the lengths of one or more sides pertaining to the first element and facing the first notch, and the lengths of one or more sides pertaining to the second element and facing the first notch is approximately half of a second wavelength corresponding to a second frequency within the required frequency band, the second frequency being higher than the first frequency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 23A, 23B are illustrations showing characteristics of VSWR and reflection coefficient of the antenna shown in FIG. 22;

DETAILED DESCRIPTION OF THE INVENTION

Figure 1:
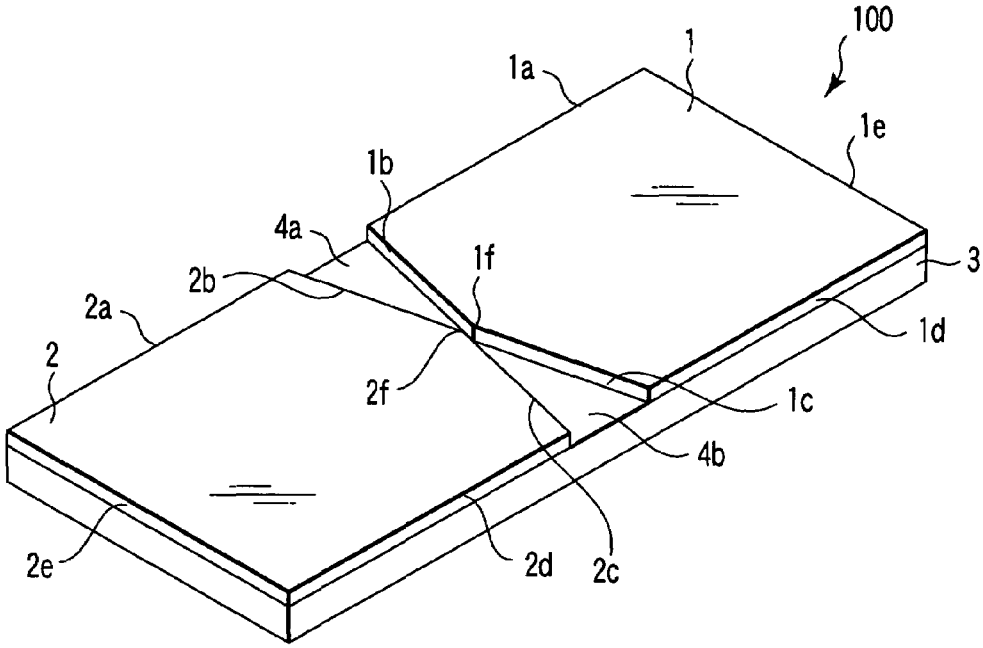
FIG. 1 is a perspective view showing a structure of a wideband antenna regarding a first embodiment of the invention.

The embodiments of the present invention will be explained with reference to the accompanying drawings. Structure of wideband antennas regarding each embodiment will be schematically shown so as to point out each feature specifically in the drawings referred to below. For example, each part will not be uniformly reduced in size and will be figuratively drawn in thickness.

(First Embodiment)

FIG. 1 is the perspective view showing the structure of the wideband antenna 100 regarding the first embodiment of the invention.

As shown in FIG. 1, the antenna 100 comprises the conductive elements 1, 2 and a dielectric substrate 3.

The elements 1, 2 are thin plates made of conductive material. The elements 1, 2 respectively have a pentagonal shape formed so that one side of a rectangular thin plate is linearly notched with the same angle from its center to both sides. The shapes of the elements 1, 2 are approximately congruent with each other.

Five sides of the element 1 are referred to as sides 1*a*, 1*b*, 1*c*, 1*d* and 1*e* as shown FIG. 1. The sides 1*b*, 1*c* are inclined sides provided with a shape so as to notch as mentioned above and contact each other. A top 1*f* is formed at a part at which the sides 1*b*, 1*c* contact with each other. The side 1*a* contacts the side 1*b*. The side 1*d* contacts the side 1*c*. The side 1*e* contacts the sides 1*a*, 1*d*, respectively.

Five sides of the elements 2 are referred to as sides 2*a*, 2*b*, 2*c*, 2*d* and 2*e* as shown in FIG. 1. The sides 2*b*, 2*c* are inclined sides provided with a shape so as to notch as mentioned above and contact each other. A top 2*f* is formed at a part at which the sides 2*b*, 2*c* contact each other. The side 2*a* contacts the side 2*b*. The side 2*d* contacts the side 2*c*. The side 2*e* contacts the sides 2*a*, 2*d*, respectively.

The elements 1, 2 are mounted on the dielectric substrate 3 in a manner that the tops 1*f*, 2*f* are opposed to each other. A small gap is provided between the tops 1*f* and 2*f*. The sides 1*a*, 2*a* and the sides 1*d*, 2*d* are disposed on the same straight lines, respectively.

Such arrangements of the elements 1, 2 described above forms two notches 4*a*, 4*b* interposing the tops 1*f*, 2*f* between the elements 1 and 2. That is, a notch 4*a* is formed between the sides 1*b* and 2*b*, and a notch 4*b* is formed between the sides 1*c* and 2*c*. The shapes of the notches 4*a*, 4*b* are approximately congruent with each other. The widths of the notches 4*a*, 4*b* are made narrowest between the tops 1*f* and 2*f* and are gradually made wider toward both side sections of the elements 1, 2. That is, the notches 4*a*, 4*b* extend in different directions from a reference point which is an intermediate point. The notches 4*a*, 4*b* have shapes in which the widths are made wider with getting apart form the reference point. Wider opening ends at which the notches 4*a*, 4*b* are made widest coincide with each one end of the sides 1*a*, 2*a*, 1*d* and 2*d*. Narrower opening ends at which the notches 4*a*, 4*b* are made narrowest coincide with each one end of the sides 1*b*, 1*c*, 2*b* and 2*c*.

Figure 2A:
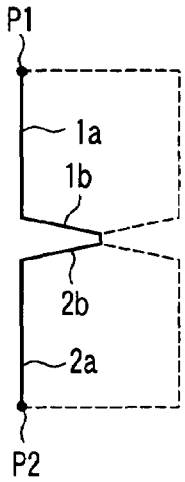
FIGS. 2A, 2B, 2C, 2D are illustrations explaining conditions to define sizes of conductive elements shown in FIG. 1.
Figure 2B:
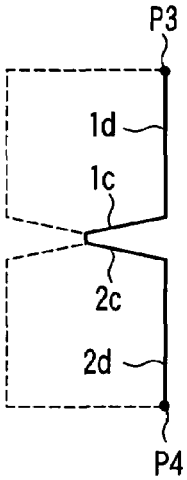
Figure 2C:
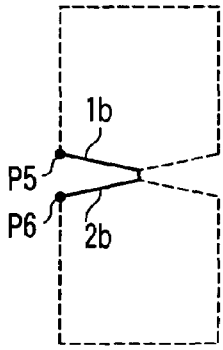
Figure 2D:
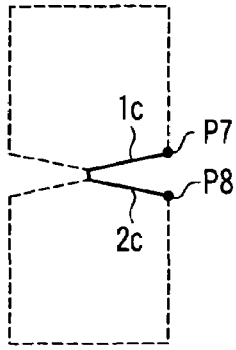

The sizes of the elements 1, 2 are decided in consideration with a required frequency range. That is, two frequencies f1, f2 (f1<f2) are defined in the required frequency band and wavelength corresponding to the frequency f1, f2 is referred to λ1, λ2. A length L1 from an end P1 of the side 1*a* to an end P2 of the side 2*a* along with the sides 1*a*, 1*b*, 2*b*, 2*a* as shown by a solid line in FIG. 2A, and a length L2 from an end P3 of the side 1*d* to an end P4 of the side 2*d* along with the sides 1*d*, 1*c*, 2*c*, 2*d* as shown by a solid line in FIG. 2B are set to approximately λ1×½. A length L3 from an end P5 (positioned at the wider opening end of the notch 4*a*) of the side 1*b* to an end P6 (positioned at the wider opening end of the notch 4*a*) of the side 2*b* along with the sides 1*b*, 2*b* as shown by a solid line in FIG. 2C, and a length L4 from an end P7 of the side 1*c* to an end P8 of the side 2*c* along with the sides 1*c*, 2*c* as shown by a solid line in FIG. 2D are set to approximately λ2×½. Although the lengths L1, L2 should be set to λ1×½ ideally, i.e. λ1×0.5, extent from λ1×0.4 to λ1×0.6 may be sufficient.

The gap between the tops 1*f* and 2*f* is very narrow in comparison with lengths of each side of the elements 1, 2. So that, the lengths L1, L2 substantially equal the sum of each length of the sides 1*a*, 1*b*, 2*a*, 2*b* or the sum of each length of the sides 1*c*, 1*d*, 2*c*, 2*d*.

The antenna 100 structured as mentioned above has a power feeding point between a point near the top 1*f* and a point near the top 2*f*.

Figure 3A:
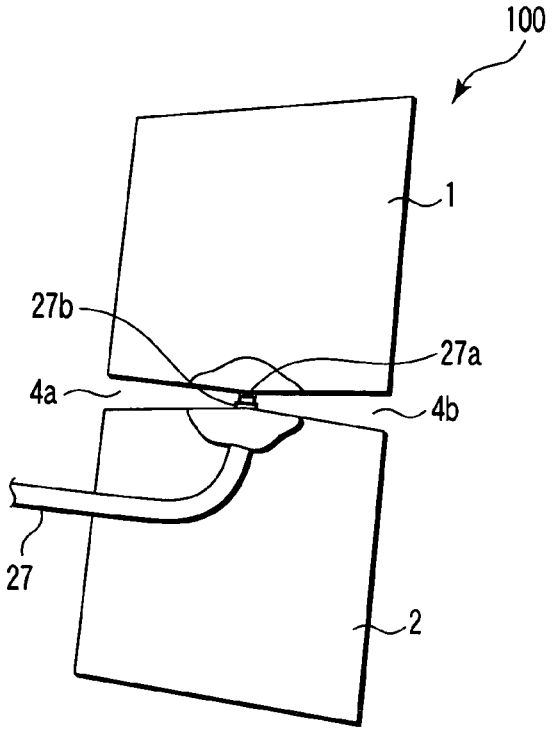
FIGS. 3A, 3B are illustrations showing power feeding forms to the antenna shown in FIG. 1.
Figure 3B:
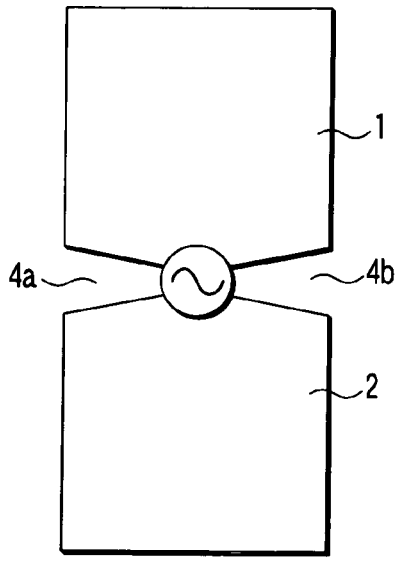

FIGS. 3A, 3B are the illustrations showing the power feeding forms for the antenna 100. As shown in FIG. 3A, an inner conductor 27*a* of a coaxial cable 27 is soldered to the element 1 near the top 1*f* and an outer conductor 27*b* is soldered to the element 2 near the top 2*f*. With such a structure, the feeding point is positioned near the reference point as shown in FIG. 3B.

Figure 4A:
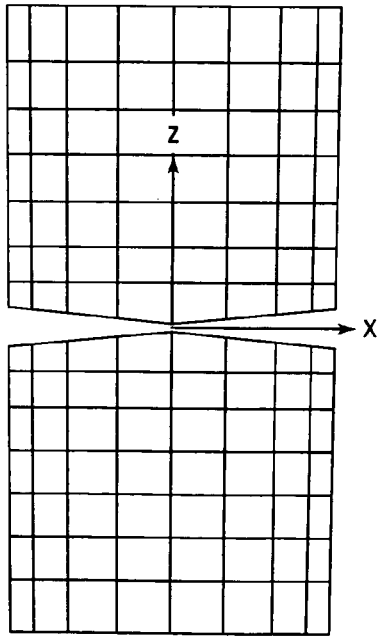
FIGS. 4A, 4B are illustrations showing characteristics of voltage standing wave ratio (VSWR) and a reflection coefficient of the antenna shown in FIG. 1.
Figure 4B:
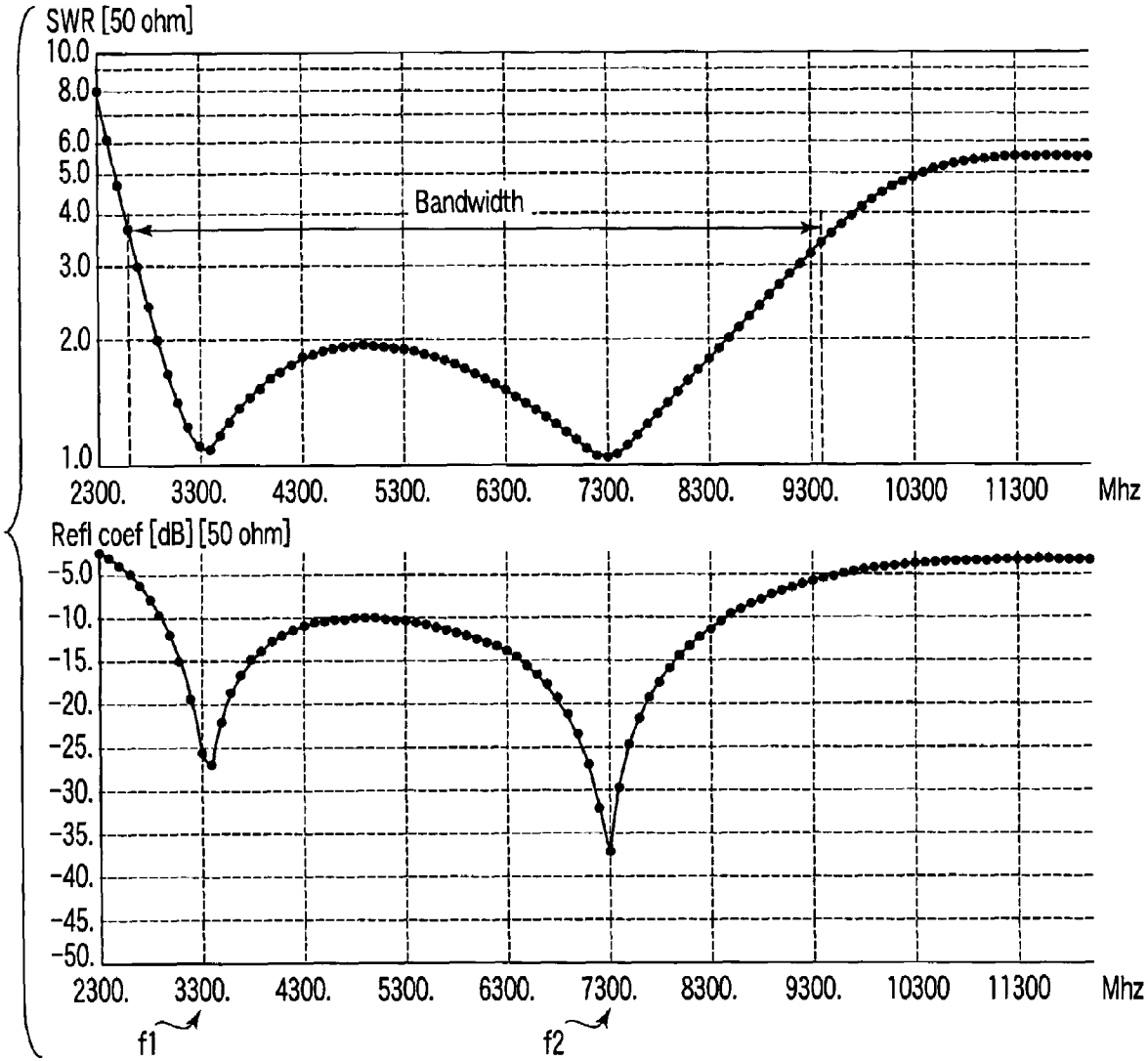

FIGS. 4A, 4B are illustrations showing characteristics of the voltage standing wave ratio (VSWR) and the reflection coefficient when power is fed between the tops 1*f* and 2*f* if the frequencies f1, f2 are set to 3.4 GHz, 7.3 GHz. By a simulation destined to a model shown in FIG. 4A, the characteristics shown in FIG. 4B are obtained.

As shown in FIGS. 4A, 4B, the two frequencies of f1, f2 become resonance points and the VSWR and the reflection coefficient become extremely small. Though the VSWR as to intermediate frequencies between the frequencies f1, f2 become larger than that at the frequencies f1, f2, it can be suppressed sufficiently small. AS a frequency becomes lower than the frequency f1, or as the frequency becomes higher than the frequency f2, the VSWR increases extremely. For example, if required VSWR is set not larger than 3, a bandwidth about 2.6 GHz–9.4 GHz becomes a transmittable/receivable band in the example shown in FIGS. 4A, 4B.

According to the antenna 100, wide transmittable/receivable band can be obtained by a combination of two resonant frequencies. However, since the VSWR at the intermediate frequency between the frequencies f1 and f2 could become excessively large due to the excessive difference between the frequencies f1 and f2, the frequencies f1, f2 should be appropriately selected so that the VSWR does not become excessively large.

Figure 5B:
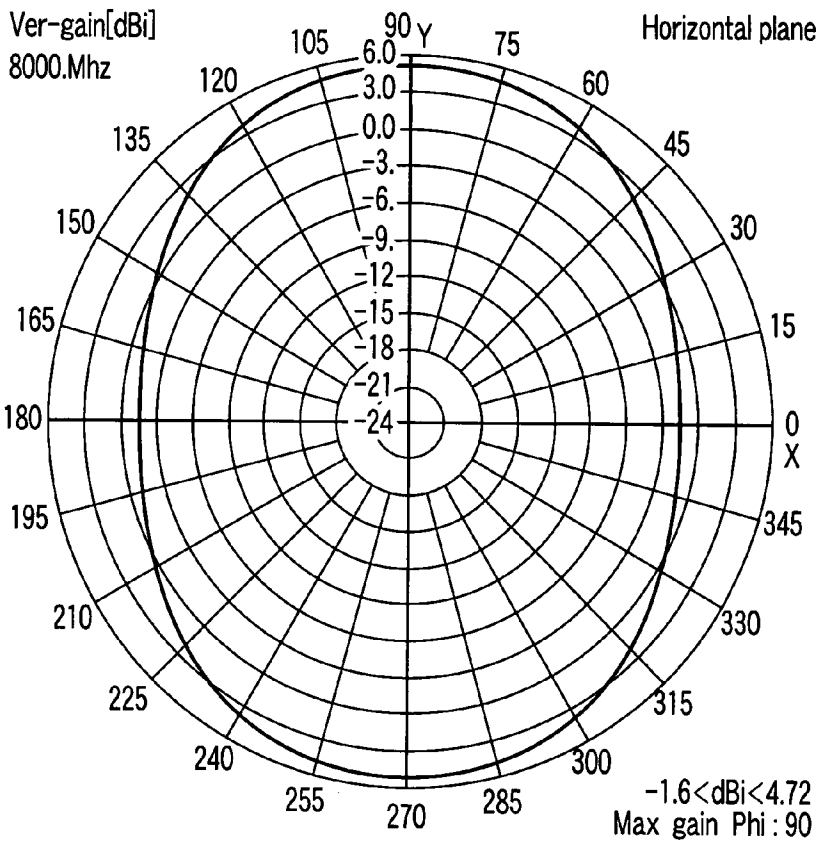
FIGS. 5A, 5B are illustrations showing radiation patterns of the antenna shown in FIG. 1.
Figure 5A:
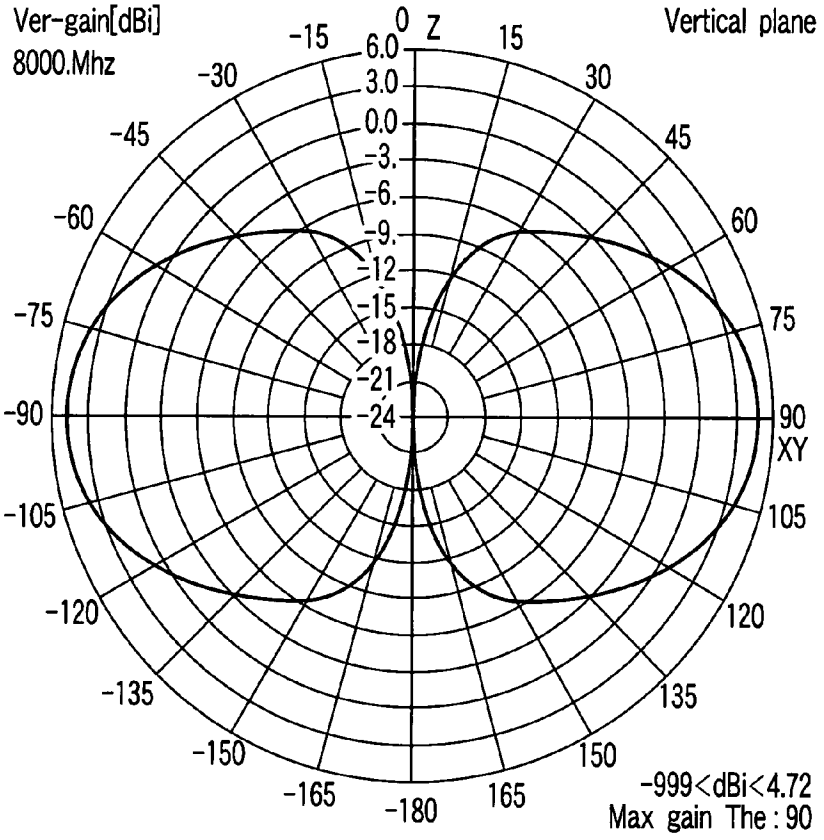

The antenna 100 radiates vertically polarized waves. Since the shapes of the elements 1, 2 are approximately congruent with each other, symmetric radiation patterns can be obtained as shown in FIGS. 5A, 5B. FIG. 5A shows a cross section pattern on a vertical plane, and FIG. 5B shows a cross section pattern on a horizontal plane.

Since each side of the elements 1, 2 of the antenna 100 is formed in a linear shape, the structure of the antenna 100 facilitates its manufacturing in comparison with the structure disclosed by the U.S. Pat. No. 4,843,403.

Figure 6:
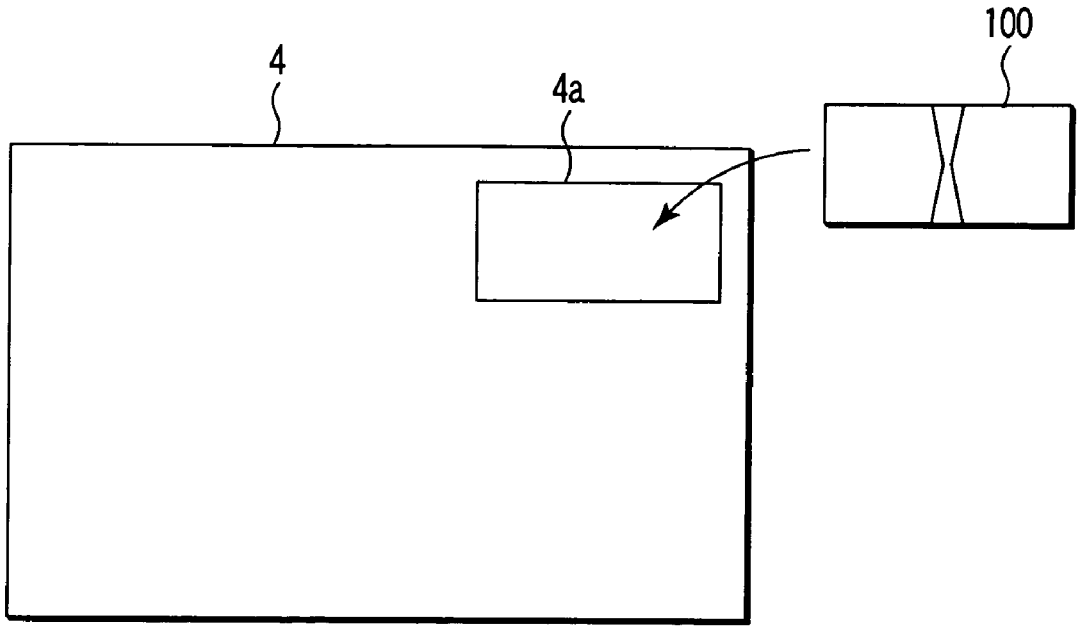
FIG. 6 is an illustration showing a first mounting method when mounting the antenna shown in FIG. 1 on a communication apparatus, etc.

FIG. 6 is the illustrate showing the first mounting method when mounting the antenna 100 on the communication apparatus, etc.

By the mounting method shown in FIG. 6, an opening 4*a* for mounting an antenna is disposed at a metal housing 4 of a device on which the antenna is mounted and the antenna 100 is mounted on the opening 4*a* from behind the housing 4.

By adopting such a mounting method, running change of the antenna 100 can be performed, and radio waves can be easily received thereby.

Figure 7:
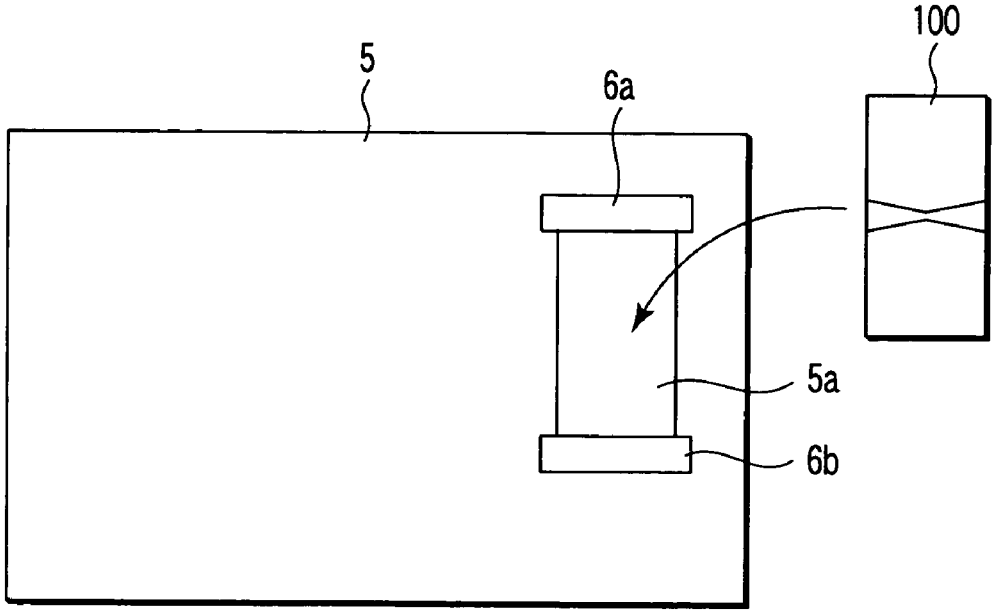
FIG. 7 is an illustration showing a second mounting method when mounting the antenna shown in FIG. 1 on a communication apparatus, etc.

FIG. 7 is the illustration showing the second mounting method when mounting the antenna 100 on the communication apparatus, etc.

By the mounting method shown in FIG. 7, an opening 5*a* for mounting an antenna is disposed at a metal housing 5 of a device on which the antenna is mounted and the antenna 100 is mounted on the opening 5*a* by using tools 6*a*, 6*b*.

Figures 8A, 8B, 8C:
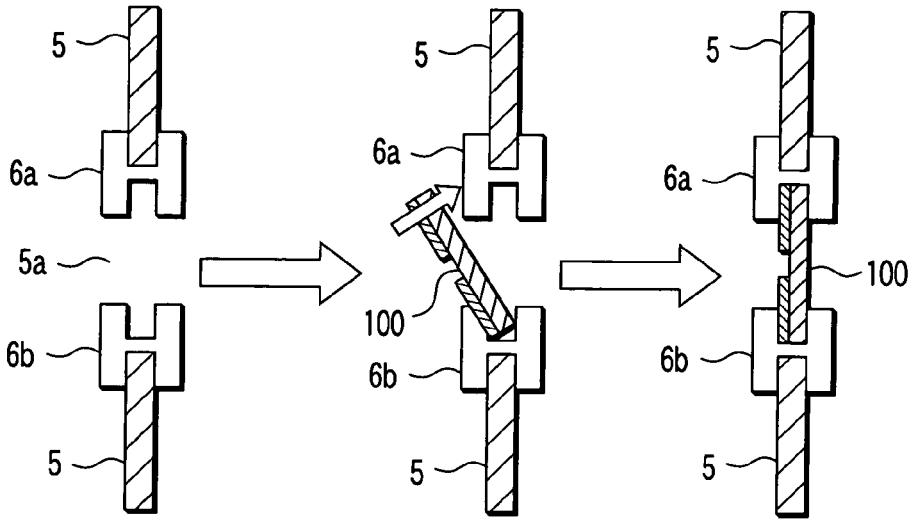
FIGS. 8A, 8B, 8C are illustrations showing procedures to mount the antenna by the second mounting method shown in FIG. 7.

FIGS. 8A, 8B, 8C are illustrations showing the procedures to mount the antenna 100 by the second mounting method.

Each tool 6*a*, 6*b* has two groves and H-like cross sections. As shown in FIG. 8A, the grooves of the tools 6*a*, 6*b* are respectively engaged at a top and a bottom of the opening 5*a*. Next, as shown in FIG. 8B, a lower end of the antenna 100 is engaged with the groove of the tool 6*a*, further, as shown by arrows, un upper end of the antenna is pushed into the groove of the tool 6*a*. Then, as shown in FIG. 8C, the upper end of the antenna 100 is engaged with the groove of the tool 6*a*.

By adopting the second mounting method, the antenna 100 can be easily and surely fixed to the metal housing 5.

(Second Embodiment)

Figure 9:
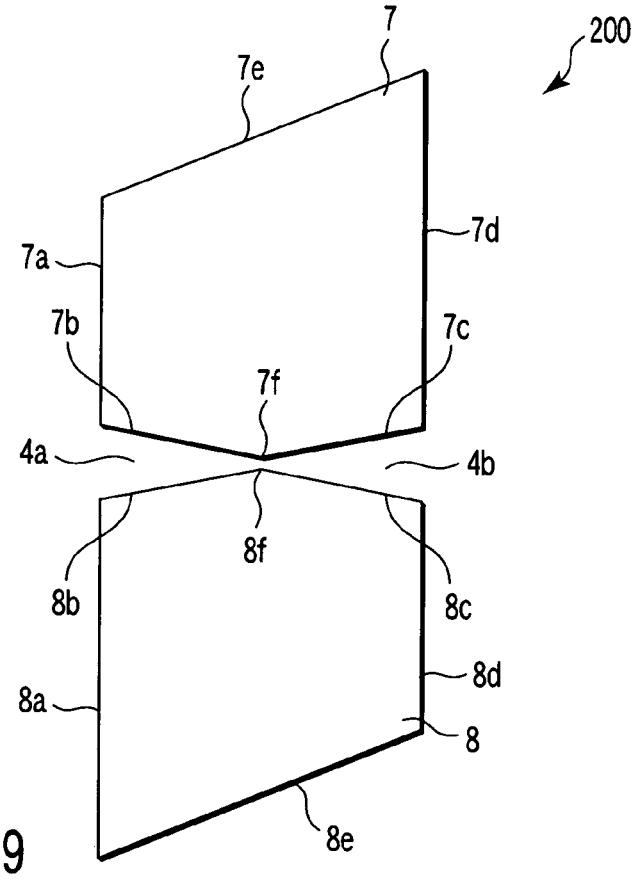
FIG. 9 is an illustration showing a structure of a wideband antenna regarding a second embodiment of the invention.

FIG. 9 is the illustration showing the structure of the wideband antenna 200 regarding the second embodiment of the invention. In FIG. 9, the same parts as those of FIG. 1 designated by the same reference numerals and detailed explanation thereof will be omitted.

As shown in FIG. 9, the antenna 200 comprises conductive elements 7 and 8. These elements 7, 8 are mounted on a dielectric substrate, but the substrate is not shown.

The elements 7, 8 are thin plates made of conductive material. The elements 7, 8 respectively have a pentagonal shape formed so that a first side of a rectangular thin plate is linearly notched with the same angle from its center to both sides and so that a second side facing the first side is linearly notched from one end of the second side. The shapes of the elements 7, 8 are approximately congruent with each other.

Five sides of the element 7 are referred to as sides 7*a*, 7*b*, 7*c*, 7*d* and 7*e* as shown in FIG. 9. Five sides of the element 8 are referred to as 8*a*, 8*b*, 8*c*, 8*d* and 8*e* as shown in FIG. 9. In this case, the sides 7*b*, 7*c*, 8*b* and 8*c*, correspond to the sides 1*b*, 1*c*, 2*b* and 2*c* of the antenna 100, respectively, and the elements 7, 8 are arranged so that the sides 7*b*, 7*c*, 8*b* and 8*c* have relations similar to the sides 1*b*, 1*c*, 2*b* and 2*c*. Accordingly, the notches 4*a*, 4*b* are formed between the elements 7 and 8 in the same way in the first embodiment.

Since the side 7*e* is inclined to the side 7*a*, 7*b*, the side 7*a* becomes shorter than the side 7*d*. Since the side 8*e* is inclined to the sides 8*a*, 8*d*, the side 8*d* becomes shorter than the side 8*a*. However, as shown in FIG. 9, since the sides 7*a*, 8*a* are positioned on the same straight line and the sides 7*d*, 8*d* are positioned on the same straight line, the length from an end of the side 7*a* up to an end of the side 8*b* along with the sides 7*a*, 7*b*, 8*b*, 8*a* becomes equal to the length from an end of the 7*d* up to an end of the 8*d* along with the sides 7*d*, 7*c*, 8*c*, 8*d*. Therefore, each of the these lengths can be set λ½ similar to the lengths L1, L2 in the first embodiment.

Figure 10A:
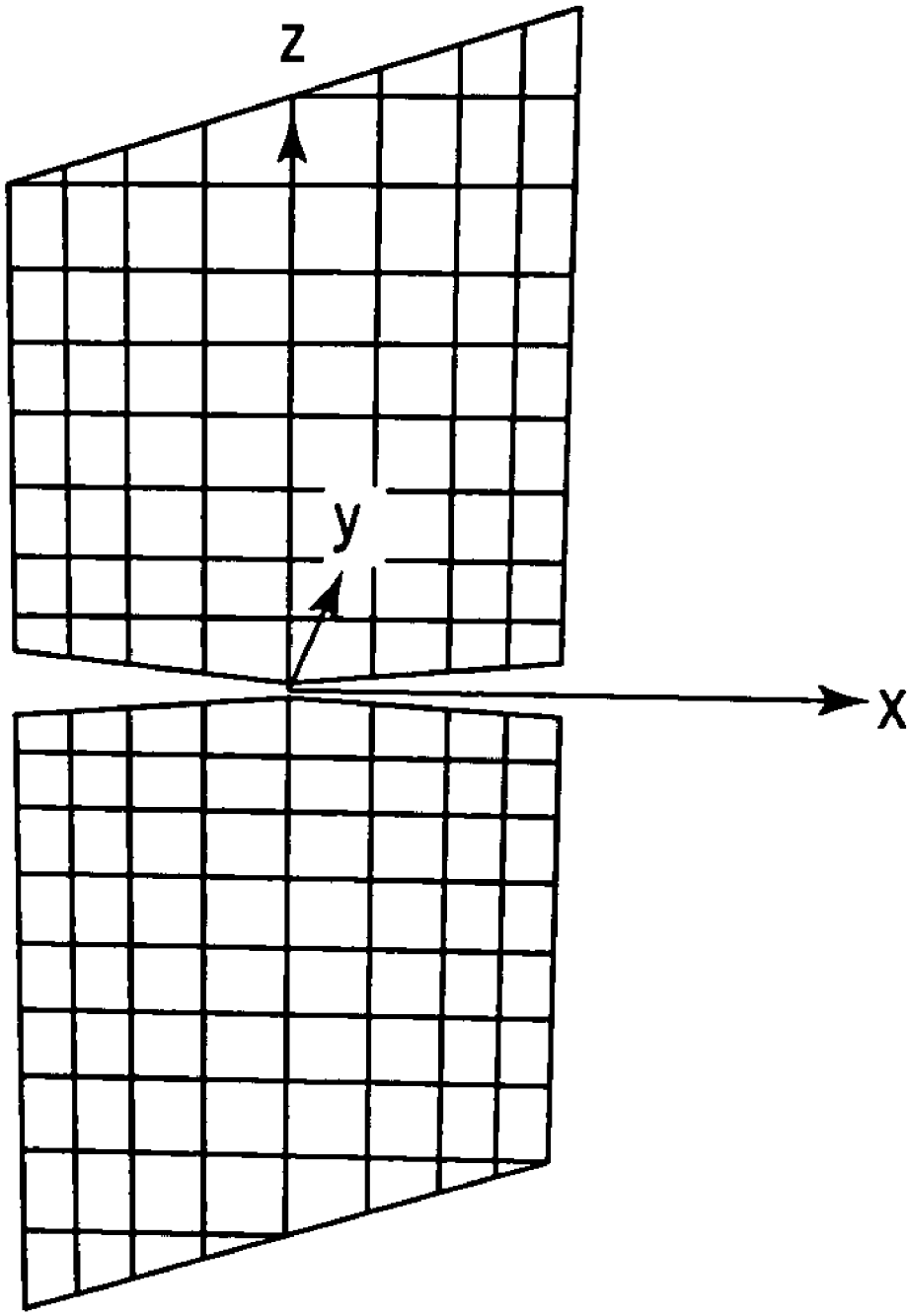
FIGS. 10A, 10B are illustrations showing characteristics of VSWR and reflection coefficient of the antenna shown in FIG. 9.
Figure 10B:
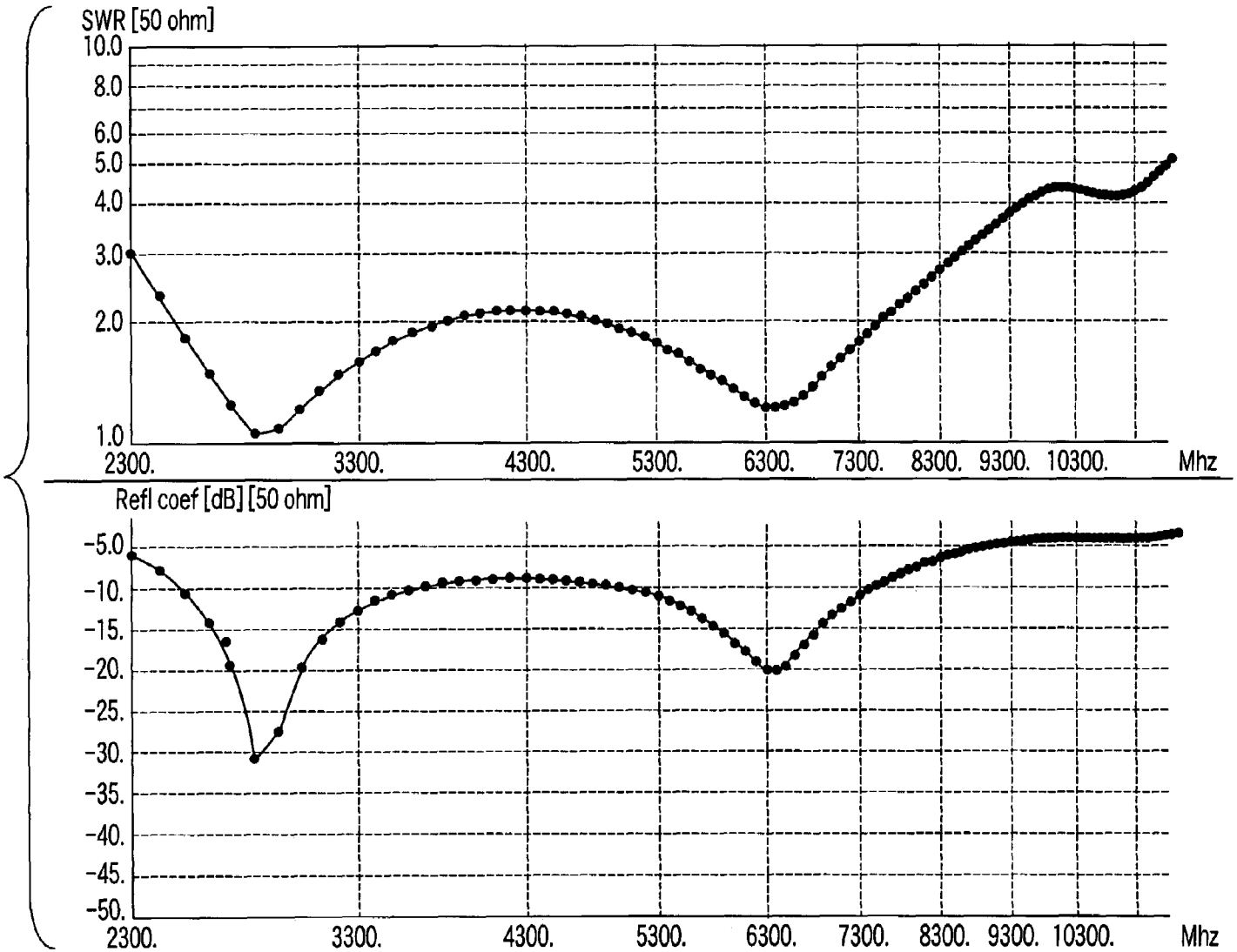

FIGS. 10A, 10B are illustrations showing the characteristics of the VSWR and the reflection coefficient of the antenna 200. By a simulation destined to a model shown in FIG. 10A, the characteristics shown in FIG. 10B are obtained.

As is known from FIGS. 10A, 10B, also the antenna 200 as well as the antenna 100, can offers wide transmittable/receivable band by a combination of two resonant frequencies. Moreover, the antenna 200 has flexibility in shape higher than the antenna 100 and facilitates to be an appropriate shape in response to a situation of a mounting space.

Figure 11B:
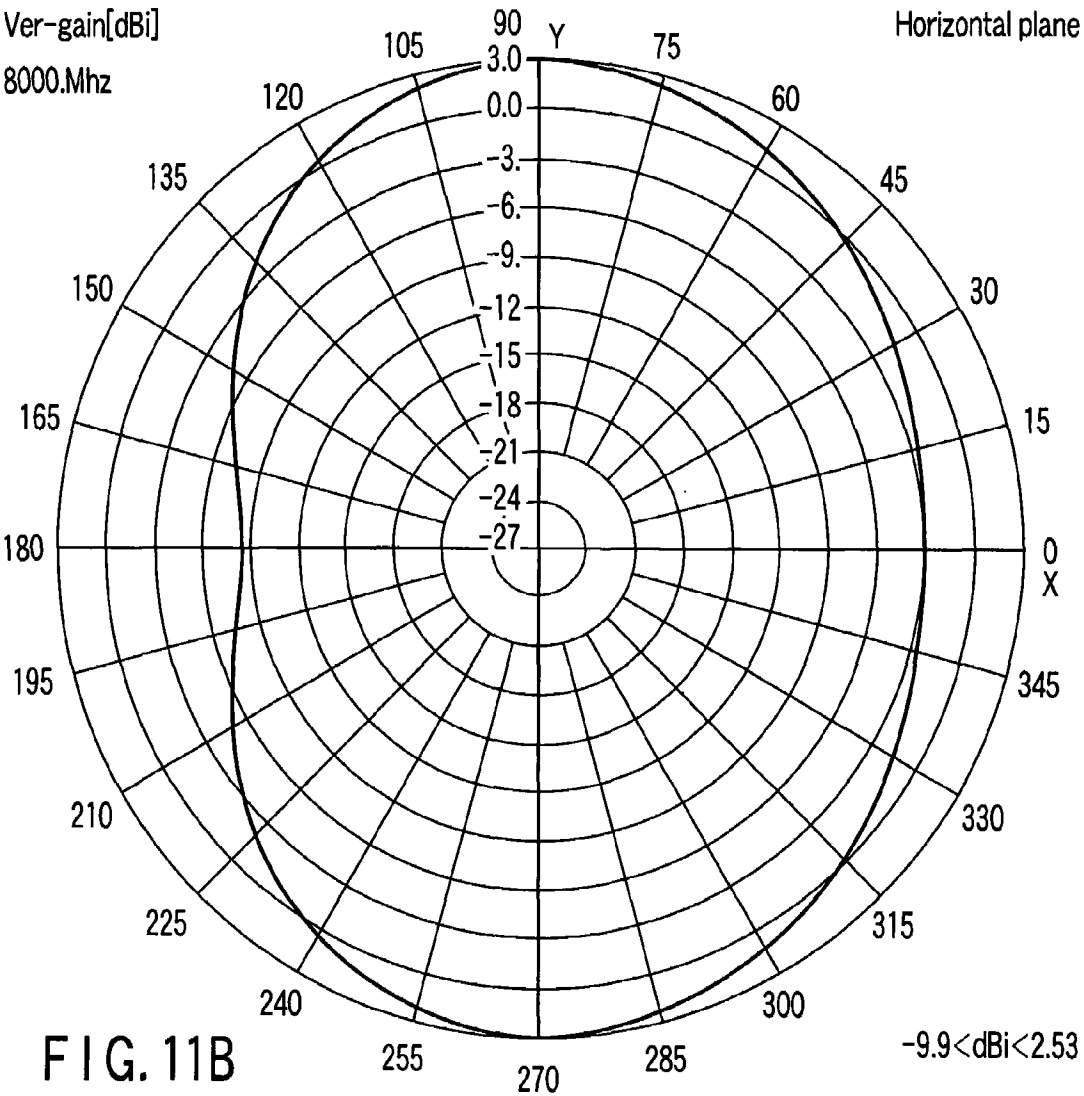
FIGS. 11A, 11B are illustrations showing radiation patterns of the antenna shown in FIG. 9.
Figure 11A:
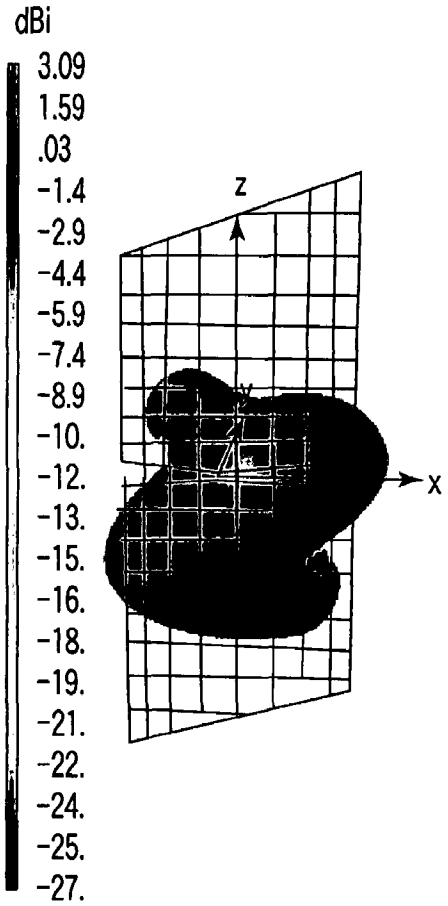
Figure 12:
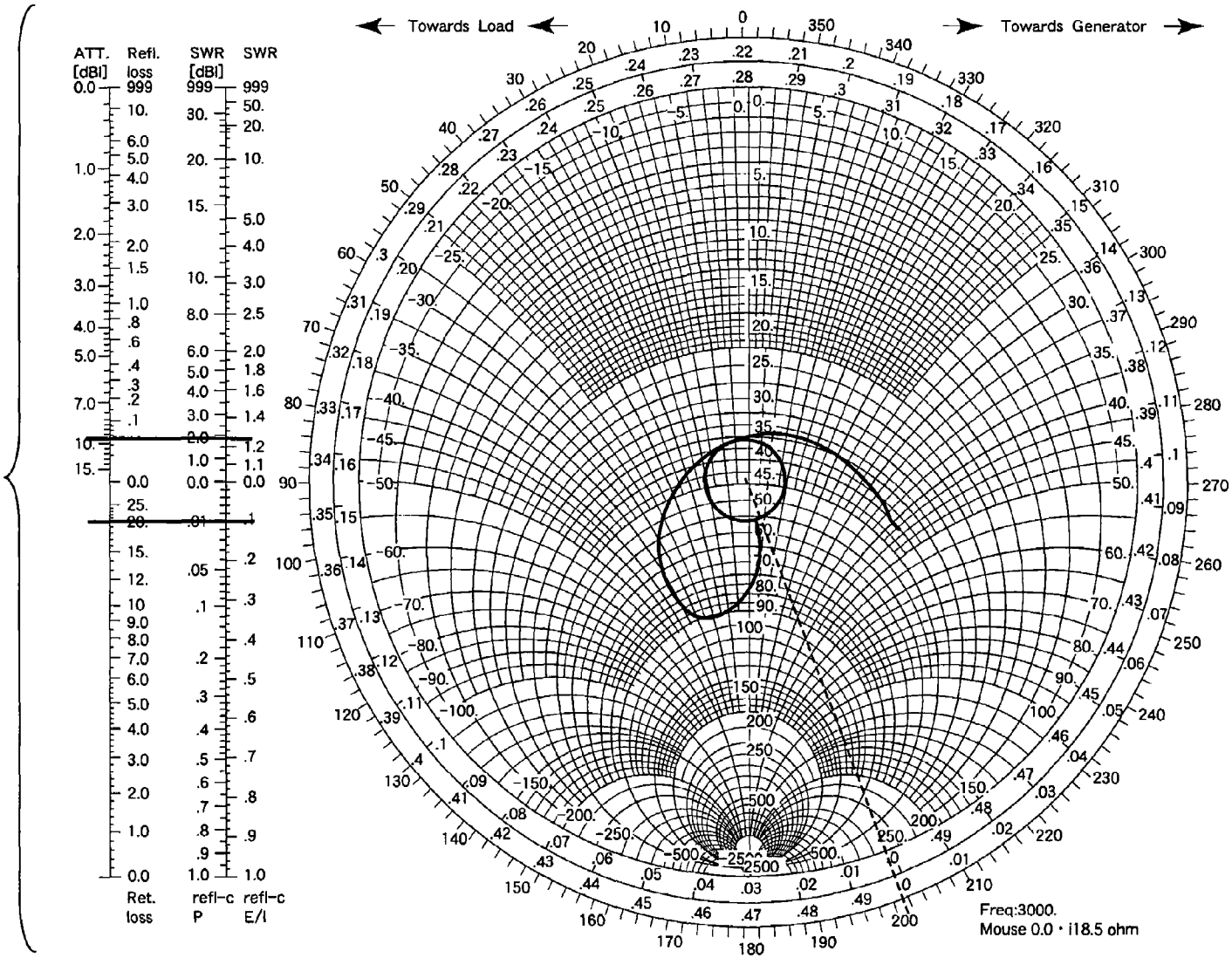
FIG. 12 is a Smith chart with respect to the antenna shown in FIG. 9.

FIGS. 11A, 11B are illustrations showing the radiation pattern of the antenna 200, the FIG. 11A shows a three-dimensional pattern and FIG. 11B shows a cross section pattern on a horizontal plane. FIG. 12 is the Smith chart with respect to the antenna 200.

As is known from FIGS. 10A, 10B and FIG. 12, the antenna 200 can maintain excellent radiation characteristics even though it has a vertically asymmetric shape.

(Third Embodiment)

Figure 13:
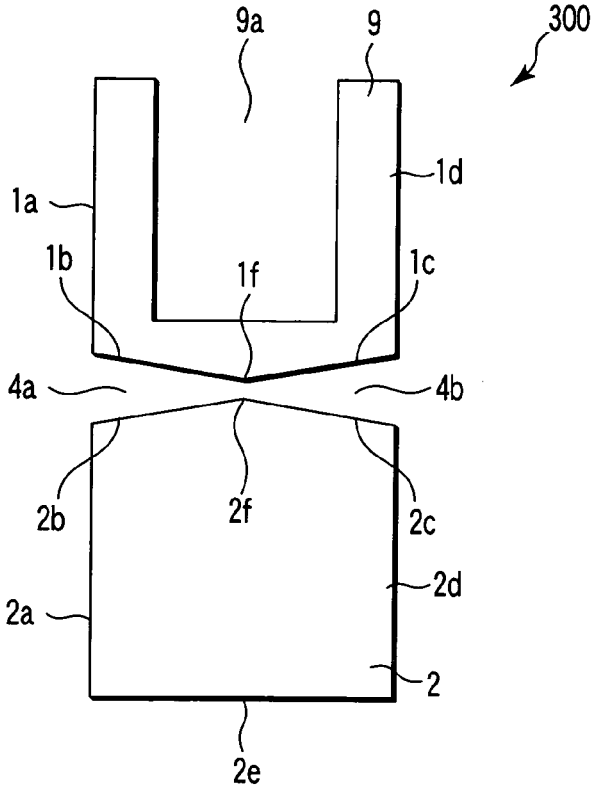
FIG. 13 is an illustration showing a structure of a wideband antenna regarding a third embodiment of the invention.

FIG. 13 is an illustration showing the structure of the wideband antenna 300 regarding the third embodiment of the invention. In FIG. 13 the same parts as that of FIG. 1 designated by the same reference numerals and detailed explanation thereof will be omitted.

As shown in FIG. 13, the antenna 300 comprises the elements 2 and an element 9. These elements 2, 9 are mounted on a dielectric substrate, but the substrate is not shown in FIG. 13. That is, the antenna 300 is equipped with the element 9 instead of the element 1 of the antenna 100.

The element 9 is a thin plate made of conductive material. The element 9 has a shape in which a part of the element 1 is notched in rectangle from the side of the side 1*e* of the element 1 and a notch 9*a* is provided. The element 9 is arranged opposite to the element 2 in the same positional relationship.

The element 9 has the sides 1*a*, 1*b*, 1*c*, 1*d* and the top 1*f* of the element 1 as they are. These sides are in the same positional relationship to the sides 2*a*, 2*b*, 2*c*, 2*d* and the top 2*f* as that of the antenna 100.

Figure 14A:
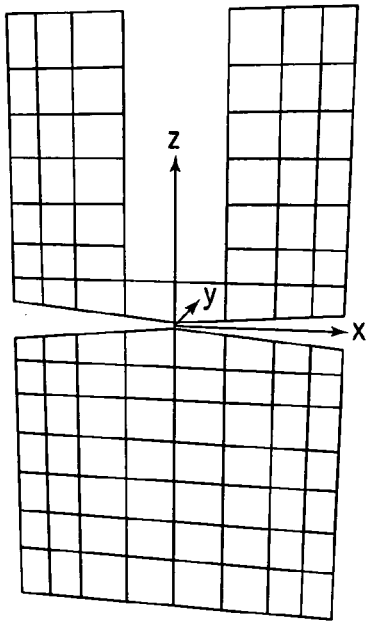
FIG. 14A, 14B are illustrations showing characteristics of VSWR and reflection coefficient of the antenna shown in FIG. 13.
Figure 14B:
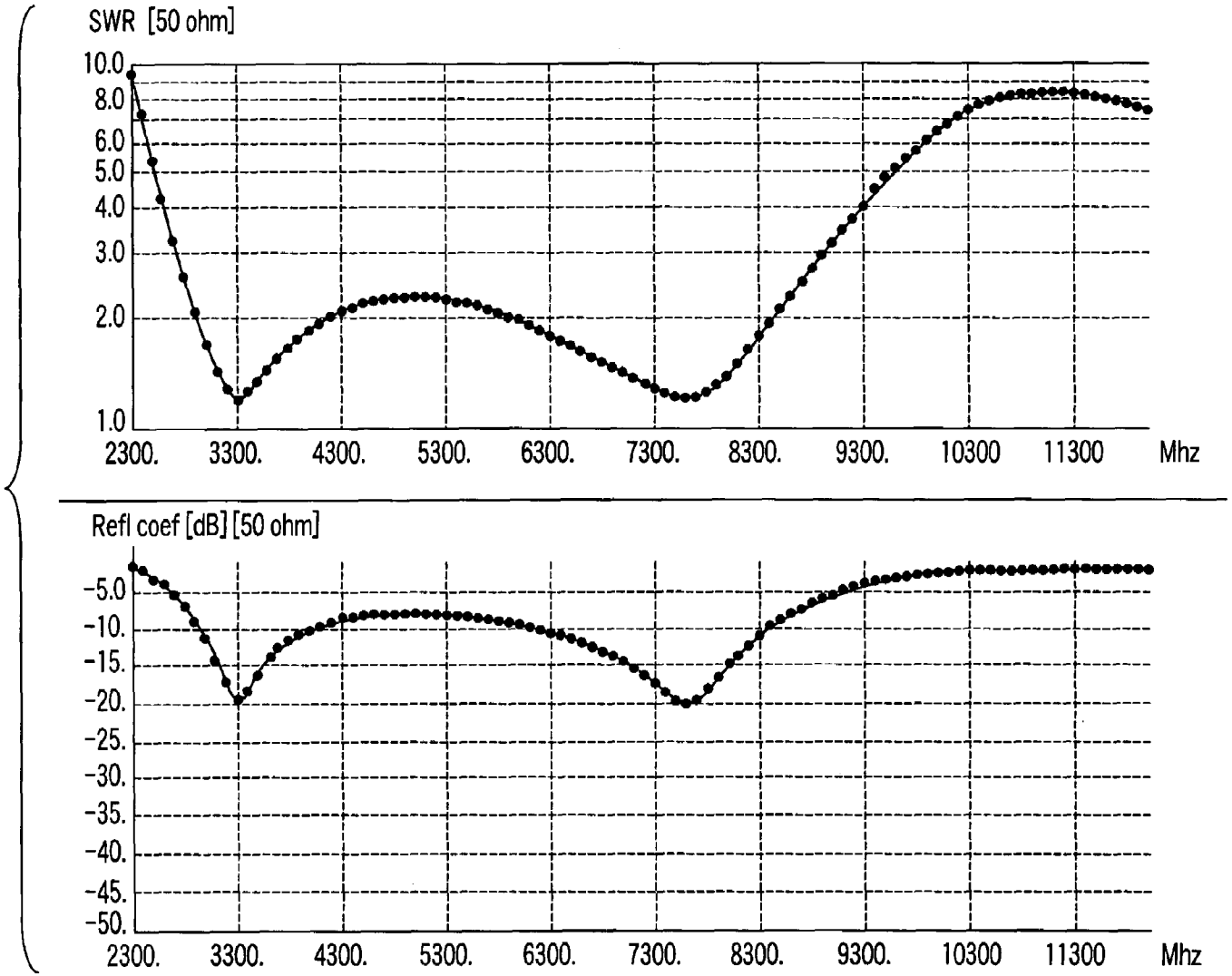

FIGS. 14A, 14B are the illustrations showing the characteristics of the VSWR and the reflection coefficient of the antenna 300. By a simulation destined to a model shown in FIG. 14A the characteristics shown in FIG. 14B are obtained.

As is known from FIGS. 14A, 14B, also the antenna 300 as well as the antenna 100, can offers a wide transmittable/receivable band by a combination of two resonant frequencies.

Moreover, the antenna 300 increases the flexibility in mounting because components, etc. can be arranged at the notch 9*a*.

Figure 15B:
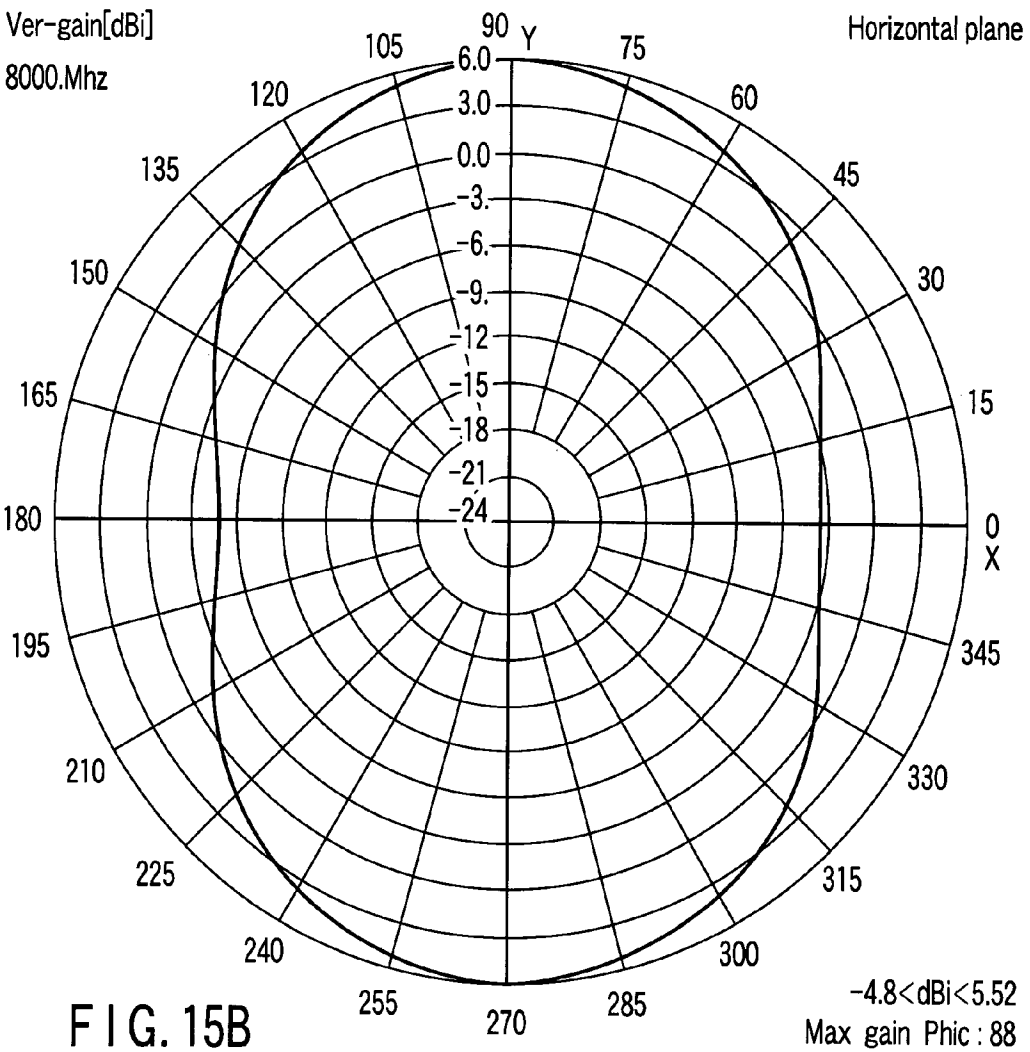
FIGS. 15A, 15B are illustrations showing radiation patterns regarding a horizontal plane of the antenna shown in FIG. 13.
Figure 15A:
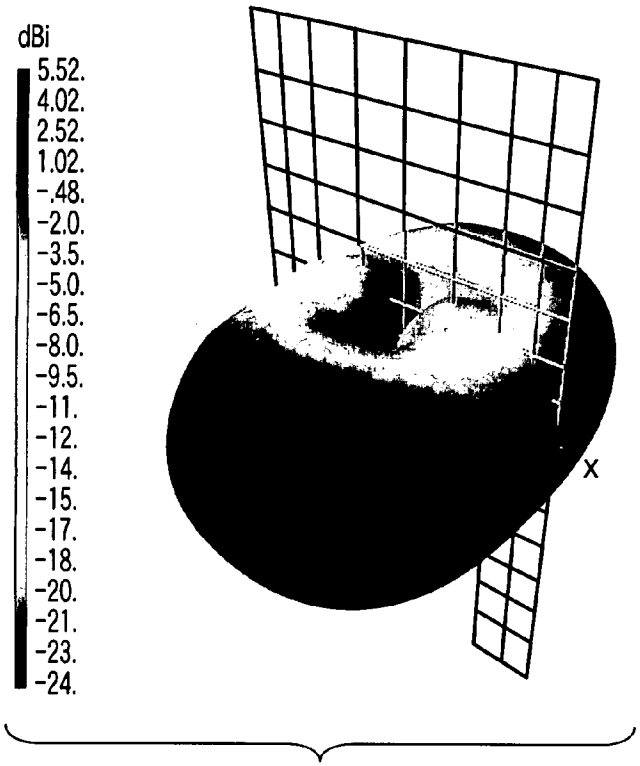
Figure 16:
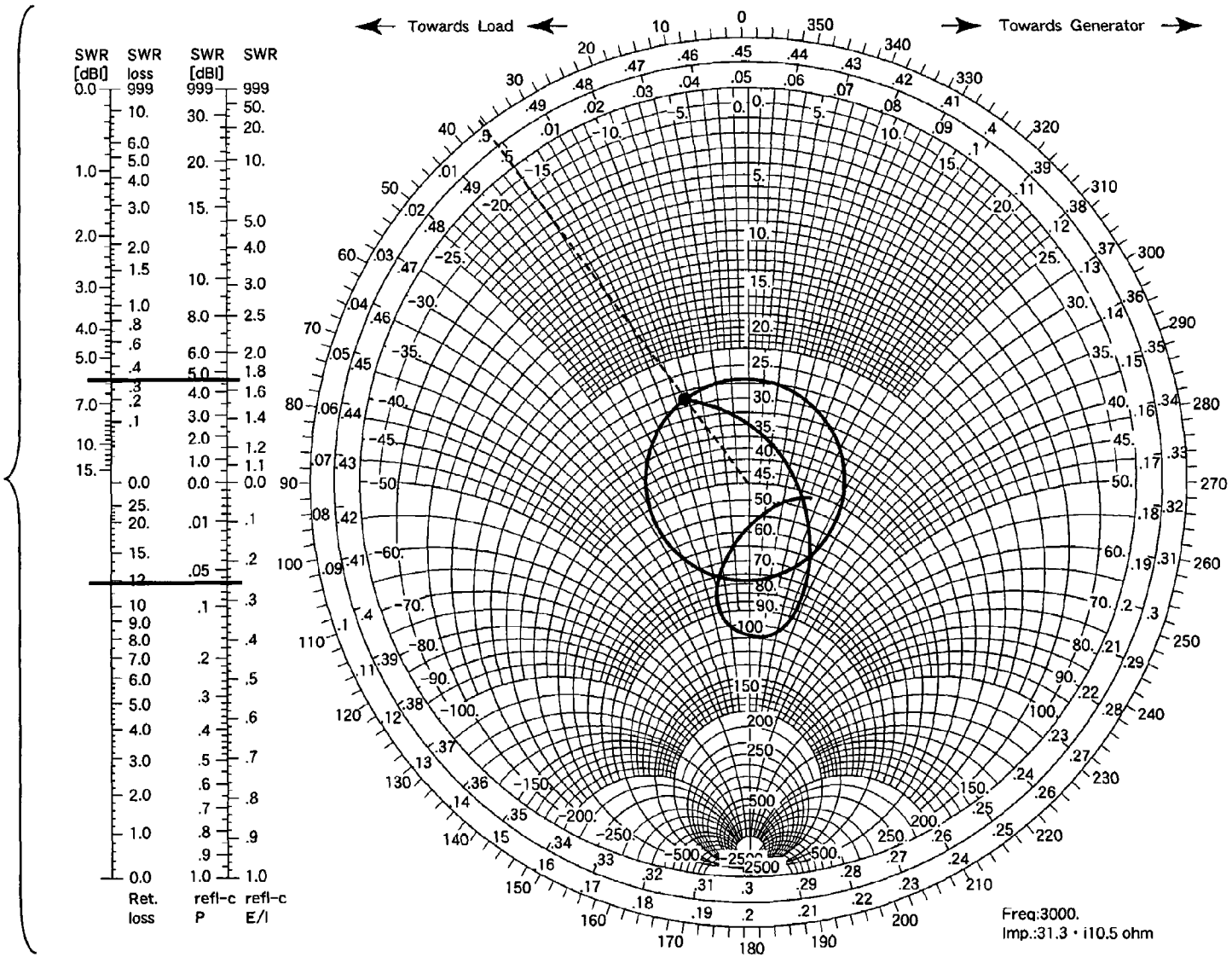
FIG. 16 is a Smith chart with respect to the antenna shown in FIG. 13.
Figure 17B:
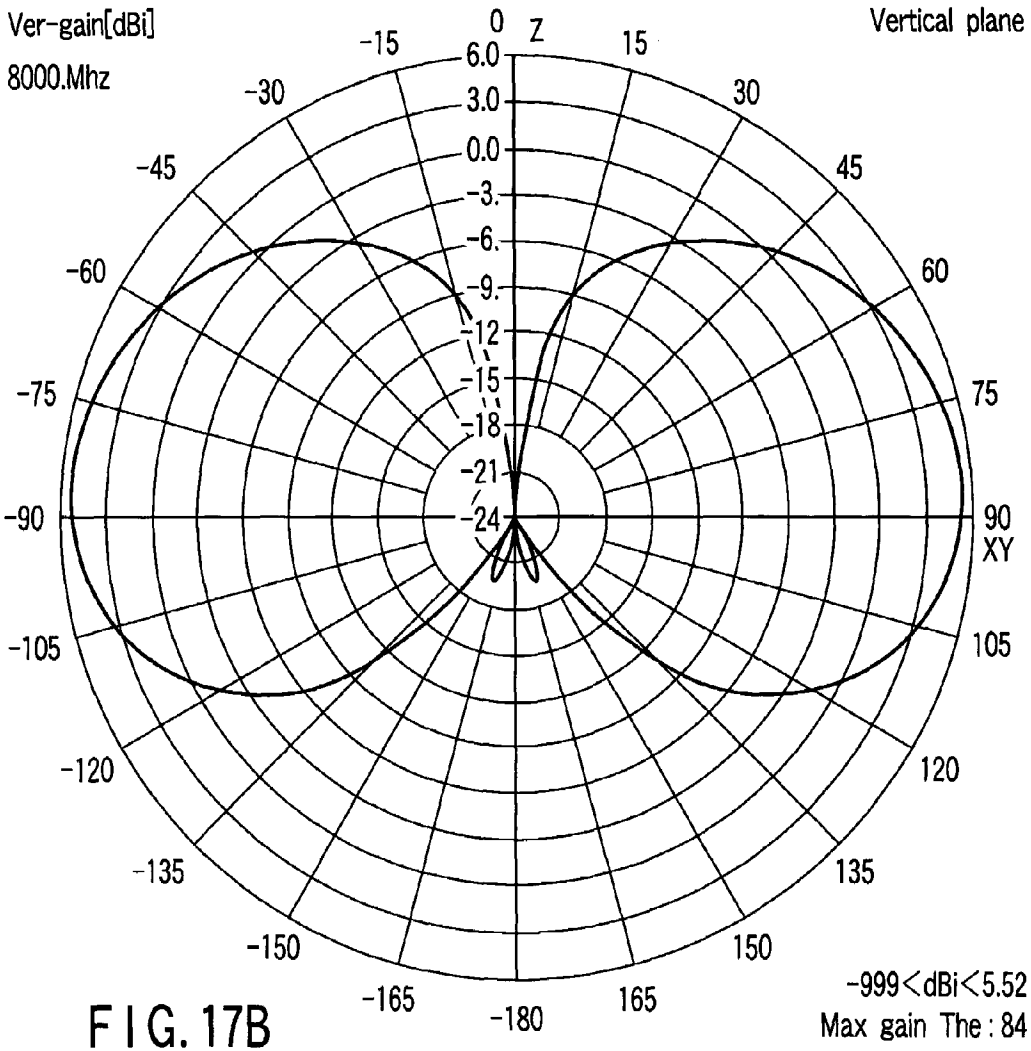
FIGS. 17A, 17B are illustrations showing radiation patterns regarding a vertical plane of the antenna shown in FIG. 13.
Figure 17A:
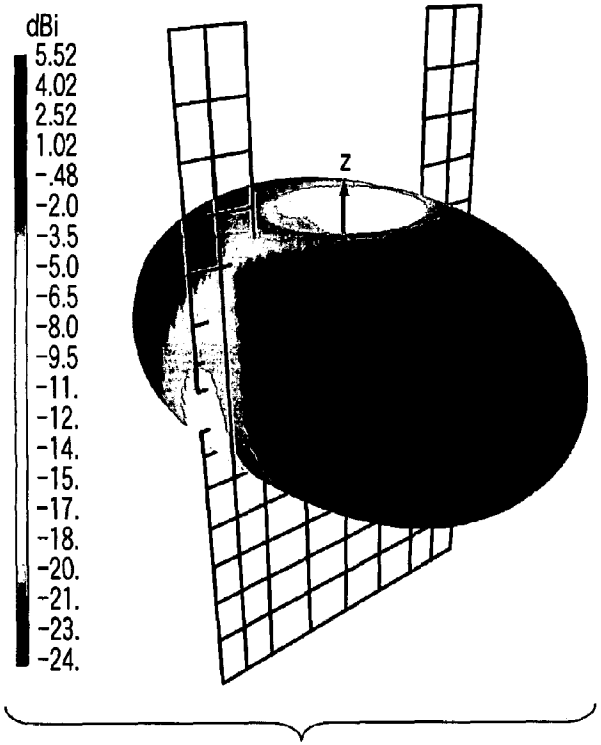

FIGS. 15A, 15B are illustrations showing the radiation patterns on a horizontal plane of the antenna 300, the FIG. 15A shows a three-dimensional pattern and FIG. 15B shows a cross section pattern on a horizontal plane. FIG. 16 is the Smith chart with respect to the antenna 300. FIGS. 17A, 17B shows the radiation patterns on a vertical plane of the antenna 300, and FIG. 17A shows the pattern as a three-dimensional pattern and FIG. 17B shows the pattern as a cross section pattern on a vertical plane.

As is known from FIGS. 14A, 14B to FIGS. 17A, 17B, the antenna 300 becomes excellent in the radiation characteristics even though the shapes of the elements 2, 9 are not congruent with each other. However, as shown in FIGS. 17A, 17B, the radiation patterns on the vertical plane present directivity. This directivity can be adjusted by varying the size of the notch 9*a* of the element 9.

(Fourth Embodiment)

Figure 18:
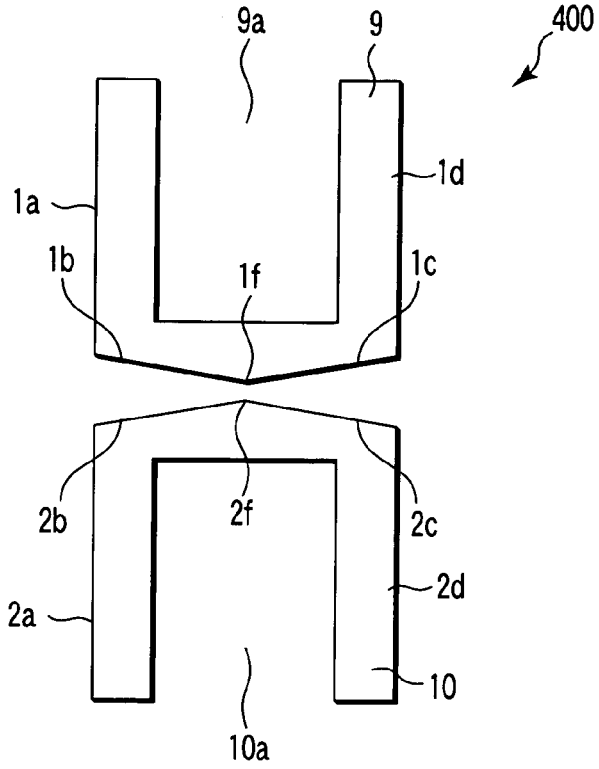
FIG. 18 is an illustration showing a structure of a wideband antenna regarding a fourth embodiment of the invention.

FIG. 18 is the illustration showing the structure of the wideband antenna 400 regarding the forth embodiment of the invention. In FIG. 18 the same parts as those of FIG. 1 designated by the same reference numerals and detailed explanation thereof will be omitted.

As shown in FIG. 18, the antenna 400 comprises the elements 9 and an element 10. These elements 9, 10 are mounted on a dielectric substrate, but the substrate is not shown in FIG. 18. That is, the antenna 400 is equipped with the elements 9, 10 instead of the elements 1, 2 of the antenna 100.

The element 10 is a thin plate made of conductive material. The element 10 has a shape in which a part of the element 2 is notched in rectangle from the side of the side 2*e* of the element 2 and a notch 10*a* is provided. The shape, size or position of the notch 10*a* may have nothing to do with the notch 9*a*, however, the notch 10*a* is formed similarly to the notch 9*a* so that the element 9 become approximately congruent with the element 10. The elements 9, 10 are arranged opposite each other in the same positional relationship as that of the elements 1, 2.

The element 10 is provided with the sides 2*a*, 2*b*, 2*c*, 2*d* and the top 2*f* of the element 2 as they are. These sides are in the same positional relationship to the sides 1*a*, 1*b*, 1*c*, 1*d* and the top 1*f* as those of the antenna 100.

Figure 19A:
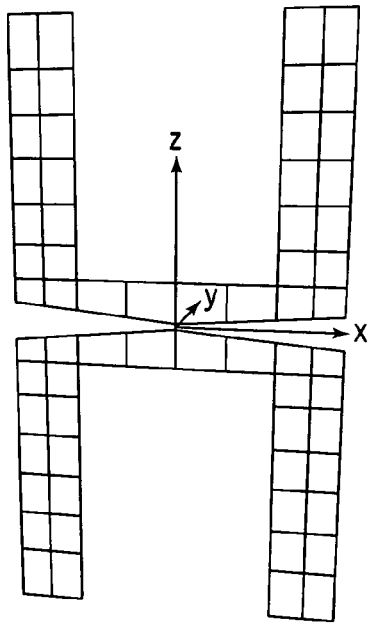
FIGS. 19A, 19B are illustrations showing characteristics of VSWR and reflection coefficient of the antenna shown in FIG. 18.
Figure 19B:
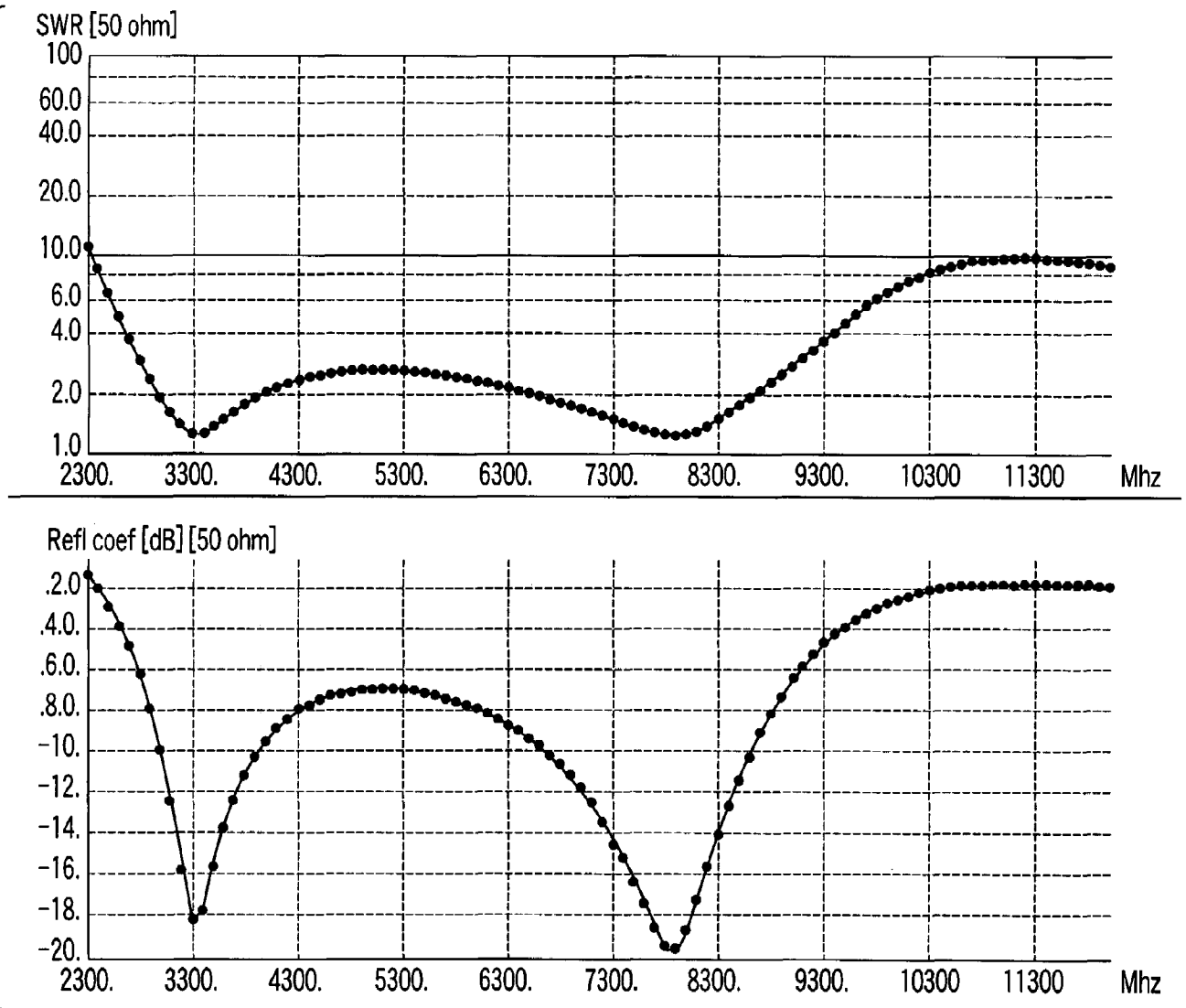

FIGS. 19A, 19B are illustrations showing the VSWR and the reflection coefficient of the antenna 400. By a simulation destined to a model shown in FIG. 19A the characteristics shown in FIG. 19B are obtained.

As is known from FIGS. 19A, 19B, also the antenna 400 as well as the antenna 100 can offer a wide transmittable/receivable band by a combination of two resonant frequencies.

Moreover, the antenna 400 becomes to make it possible to arrange components, etc., even at the notch 10*a* in addition to the notch 9*a*, so that the flexibility in mounting is improved more than that of the antenna 300.

(Fifth Embodiment)

Figure 20:
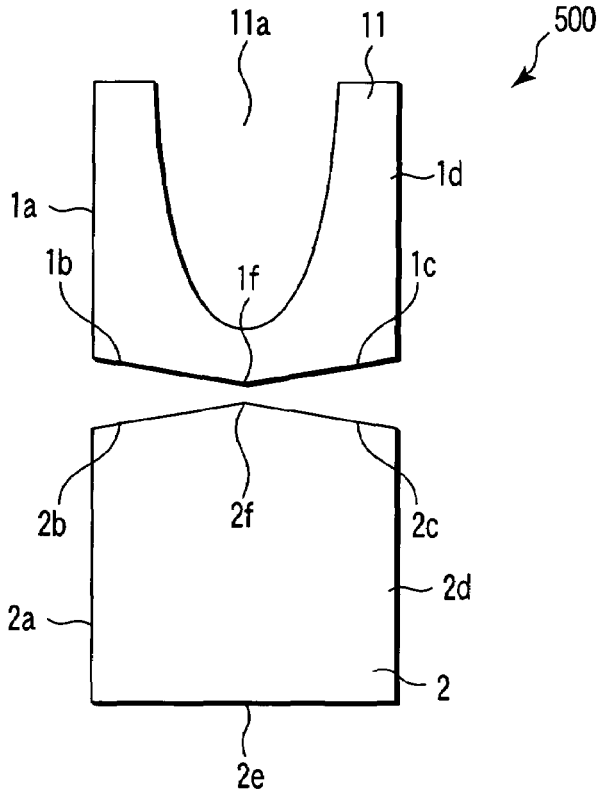
FIG. 20 is an illustration showing a structure of a wideband antenna regarding a fifth embodiment of the invention.

FIG. 20 is an illustration showing the structure of the wideband antenna 500 regarding the fifth embodiment of the invention. In FIG. 20, the same parts as those of the FIG. 1 are designated by the same reference numerals, and detailed explanation thereof will be omitted.

As shown in FIG. 20, the antenna 500 comprises the element 2 and a conductive element 11. These elements 2, 11 are mounted on a dielectric substrate, but the substrate is not shown. That is, the antenna 500 is equipped with the element 11 instead of the element 1 of the antenna 100.

The element 11 is a thin plate made of conductive material. The element 11 has a shape in which a part of the element 1 is notched in arch from the side of the side 1*e* of the element 1 and a notch 11*a* is provided. The element 11 is arranged opposite to the element 2 in the same positional relationship as that of the element 1.

The element 11 has the sides 1*a*, 1*b*, 1*c*, 1*d* and the top 1*f* of the element 1 as they are. These sides are in the same positional relationship to the sides 2*a*, 2*b*, 2*c*, 2*d* and the top 2*f* as that of the antenna 100.

Figure 21A:
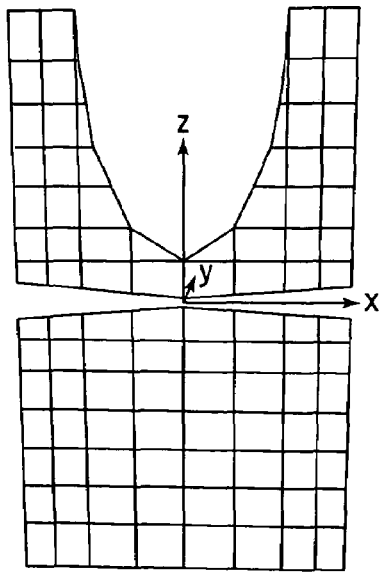
FIGS. 21A, 21B are illustrations showing characteristics of VSWR and reflection coefficient of the antenna shown in FIG. 20.
Figure 21B:
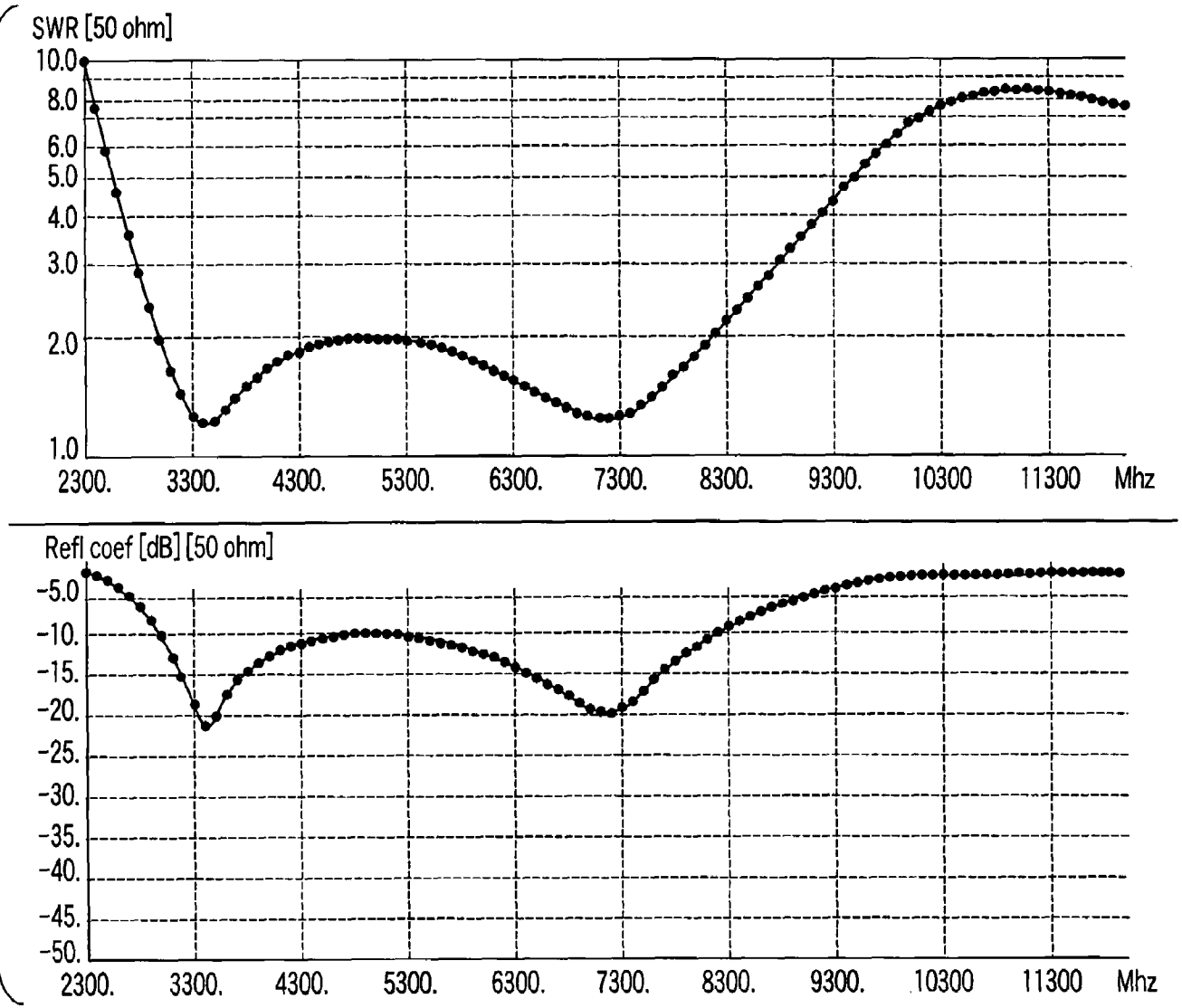

FIGS. 21A, 21B are the illustrations showing the characteristics of the VSWR and the reflection coefficient of the antenna 500. By a simulation destined to a model shown in FIG. 21A, the characteristics shown in FIG. 21B are obtained.

As known from FIGS. 21A, 21B, also the antenna 500 as well as the antenna 100 can offers a wide transmittable/receivable band by a combination of two resonant frequencies.

Moreover, the antenna 500 makes it possible to arrange components, etc., at the notch 11*a*, so that the flexibility in mounting is improved.

Furthermore, as known from this fifth embodiment and the third and the fourth embodiments, any shape of notch may be acceptable, only if the two elements 2, 11 have shapes so that the sides 1*a*, 1*b*, 1*c*, 1*d*, the top 1*f* and the sides 2*a*, 2*b*, 2*c*, 2*d*, the top 2*f* are provided as they are.

(Sixth Embodiment)

Figure 22:
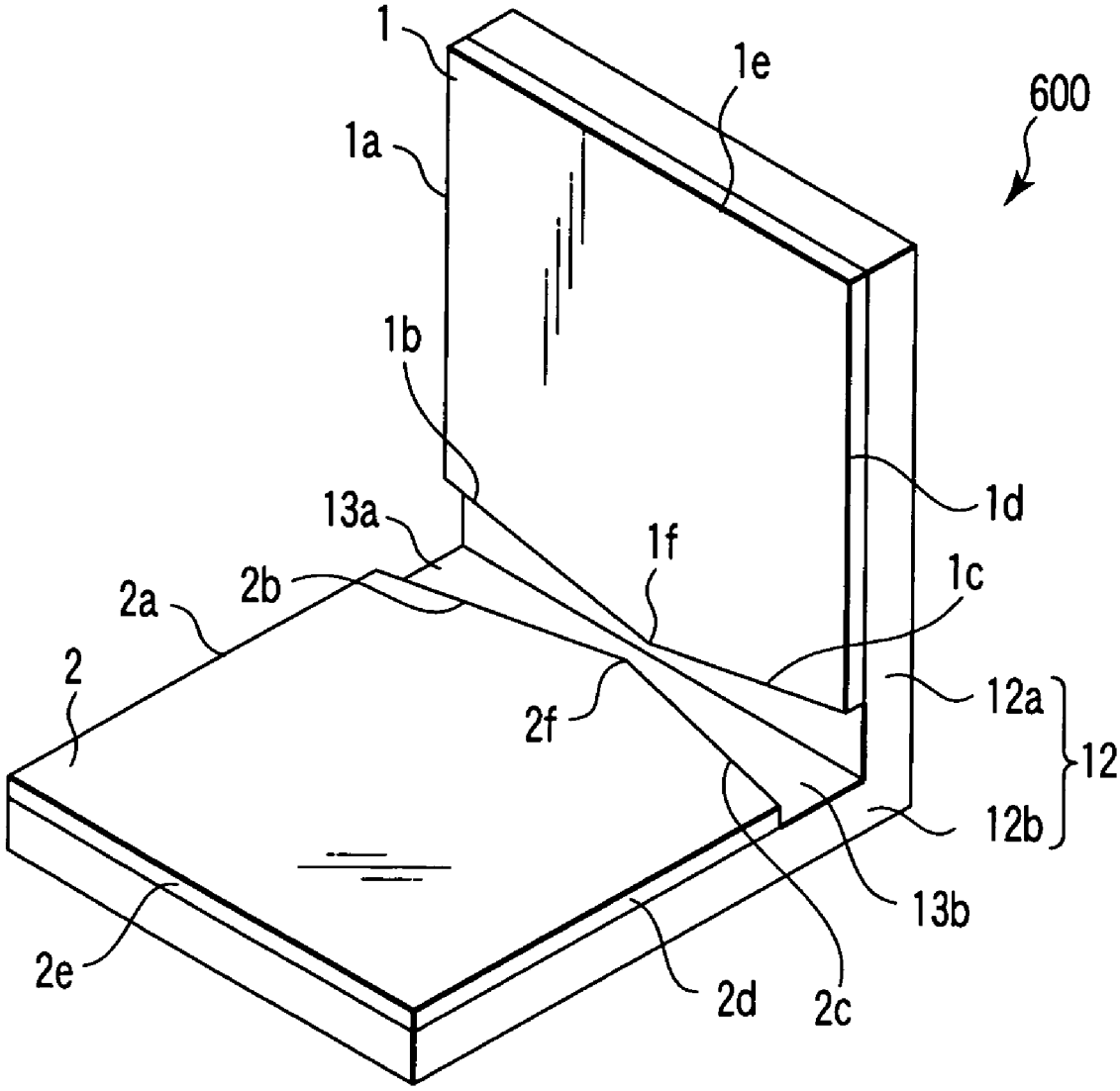
FIG. 22 is a perspective view showing a structure of a wideband antenna regarding a sixth embodiment of the invention.

FIG. 22 is the perspective view showing the structure of the wideband antenna 600 regarding the sixth embodiment of the invention. In FIG. 22 the same parts as those of FIG. 1 are referred to the same reference numerals and detailed explanation thereof will be omitted.

As shown in FIG. 22, the antenna 600 comprises the conductive elements 1, 2 and a dielectric substrate 12.

The substrate 12 is shaped so that the center of the dielectric substrate 3 is squarely bent. Hereinafter, two parts of the substrate 12 having different directions are referred to a vertical part 12*a* and a horizontal part 12*b*.

The elements 1, 2 are attached to the vertical part 12*a* and the horizontal part 12*b* of the substrate 12, in a state so that the top 1*f* and the top 2*f* are opposed to each other. A small gap is disposed between the top 1*f* and the top 2*f*. The sides 1*a* and 2*a* are positioned on two straight lines intersecting orthogonally with each other, and the sides 1*d* and 2*d* are positioned on another two straight lines intersecting orthogonally with each other.

Such arrangements of the elements 1, 2 forms two notches 13*a*, 13*b* by interposing the tops 1*f*, 2*f* between the elements 1 and 2. That is, the notch 13*a* is formed between the side 1*b* and the side 2*b*, and the notch 13*b* is formed between the sides 1*c* and the side 2*c*. The shapes of these notches 13*a*, 13*b* are approximately congruent with each other. The widths of the notches 13*a*, 13*b* are narrowest between the top 1*f* and the top 2*f* and gradually become wider toward both sides of the elements 1, 2.

Even the antenna 600 with such a structure, a resonant point is defined in the same way as that of the antenna 100.

Figure 23B:
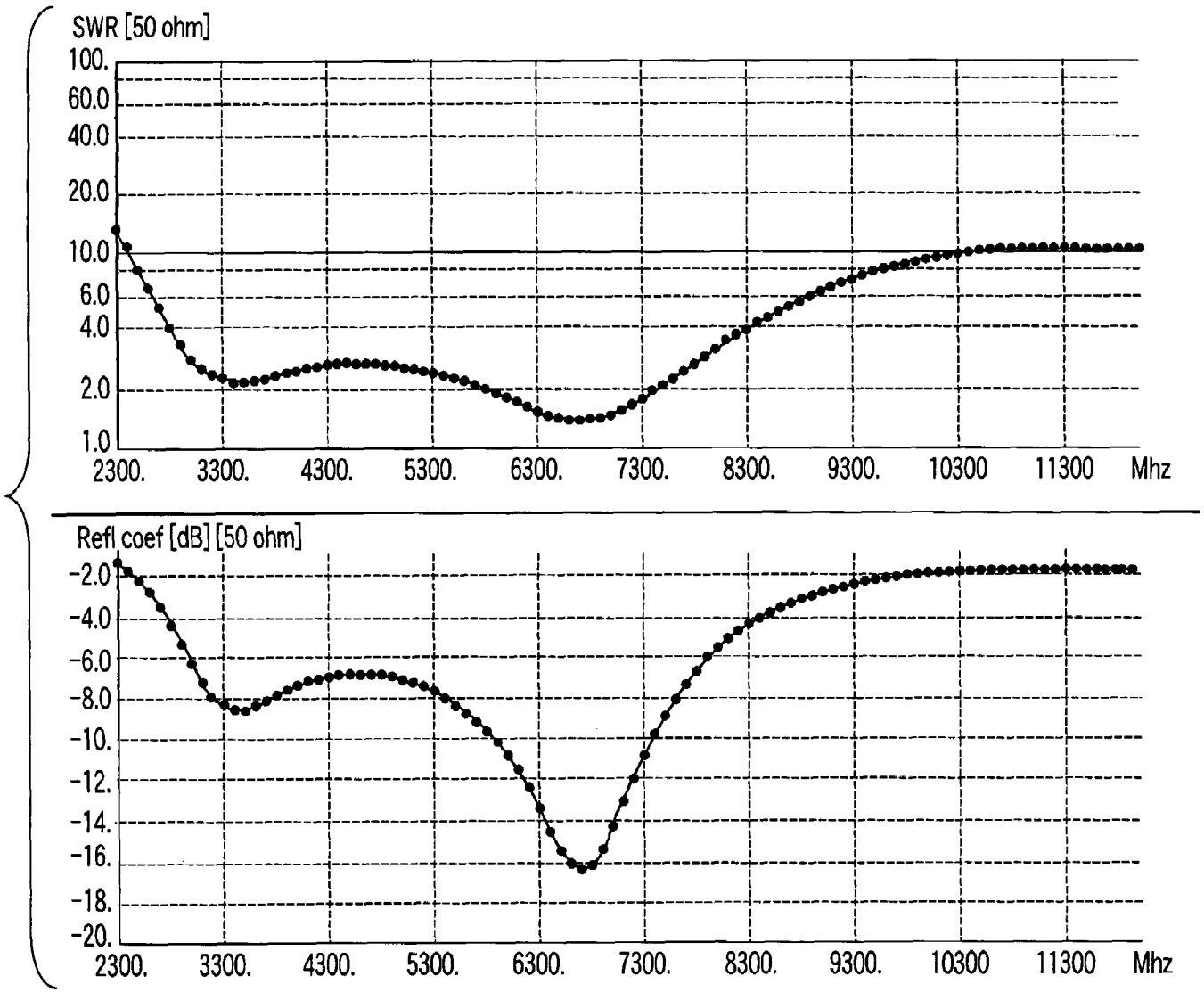

FIGS. 23A, 23B are the illustrations showing the characteristics of the VSWR and the reflection coefficient of the antenna 600. By a simulation destined to a model shown in FIG. 23A, the characteristics shown in FIG. 23B are obtained.

As is known from FIGS. 23A, 23B, also the antenna 600 as well as the antenna 100 can offers a wide transmittable/receivable band by a combination of two resonant frequencies.

Figure 24B:
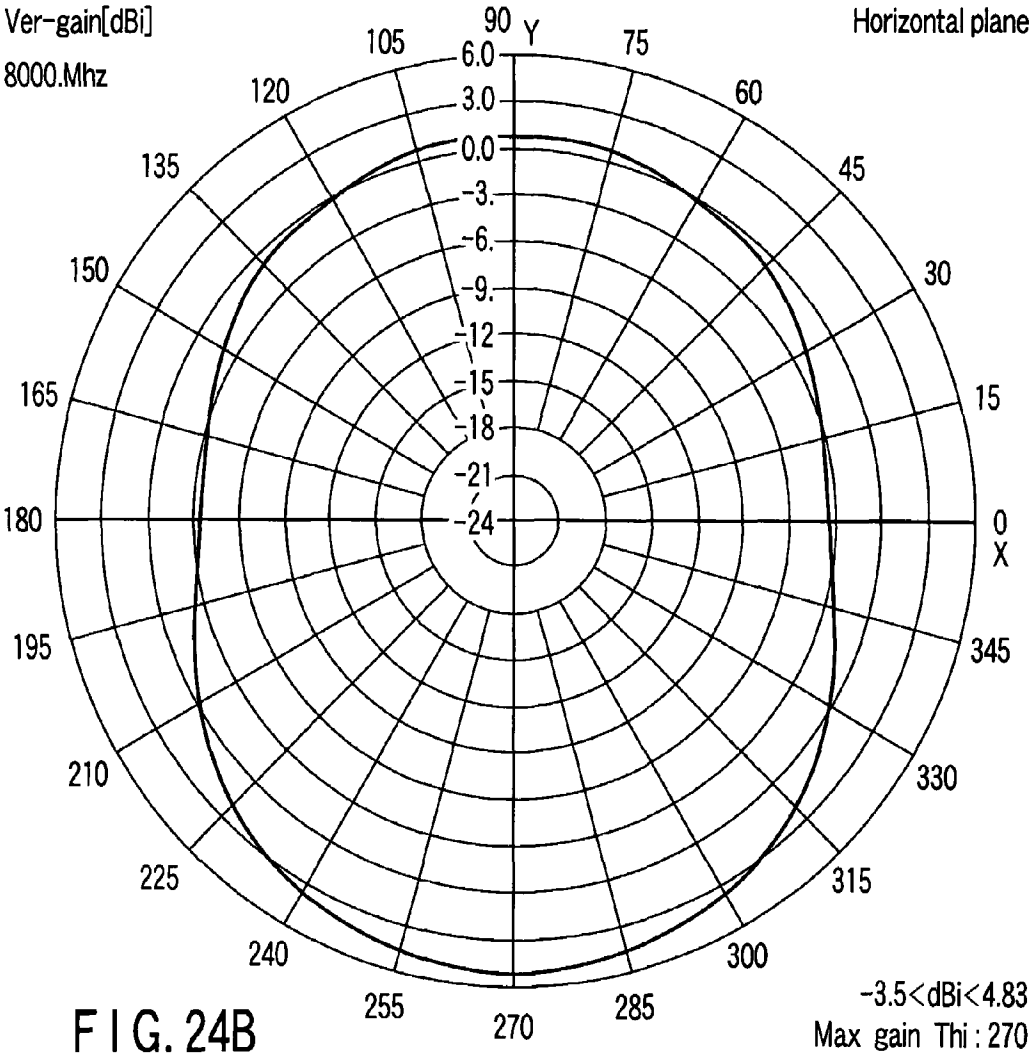
FIGS. 24A, 24B are illustrations showing radiation patterns regarding vertically polarized waves of the antenna shown in FIG. 22.
Figure 24A:
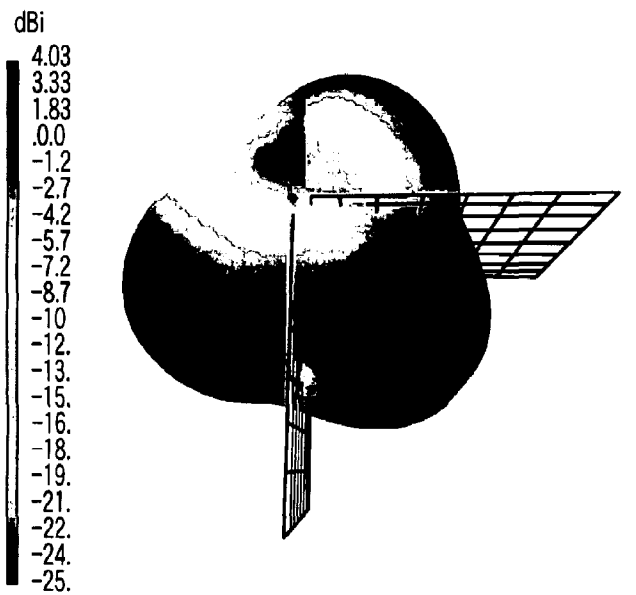
Figure 25B:
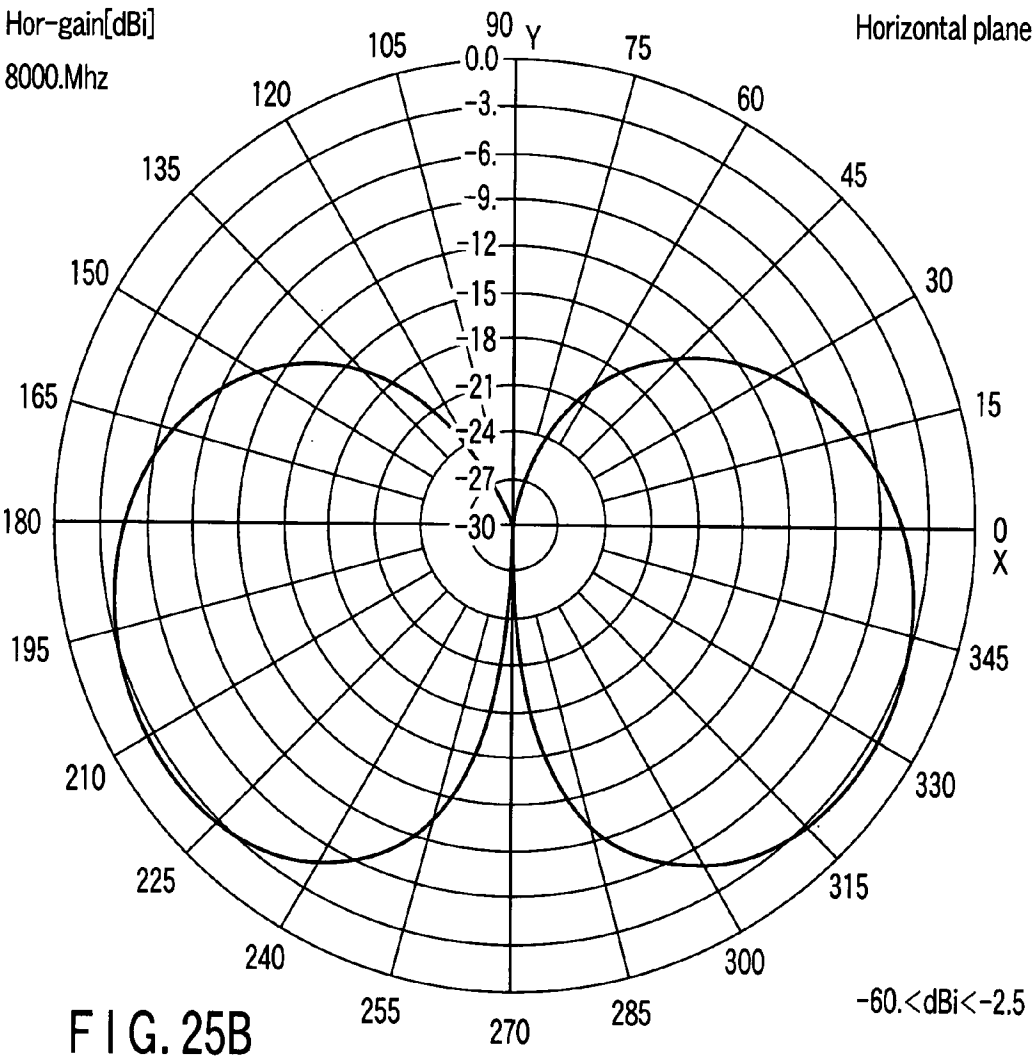
FIGS. 25A, 25B are illustrations showing radiation patterns regarding horizontally polarized waves of the antenna shown in FIG. 22.
Figure 25A:
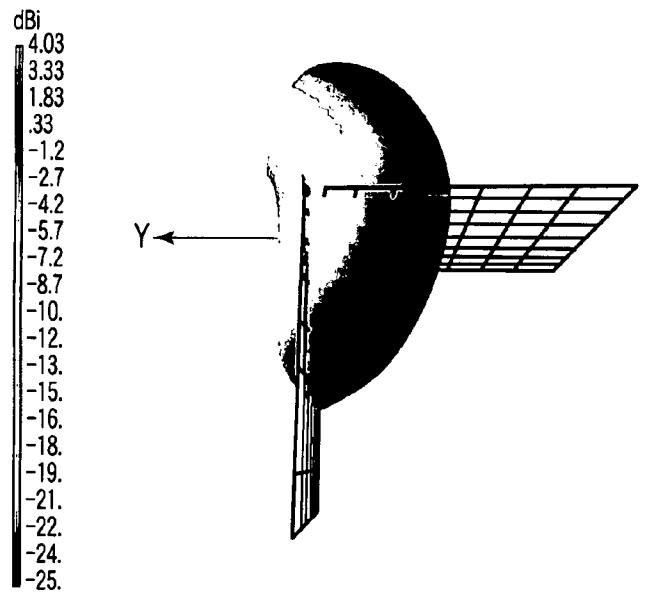

FIGS. 24A, 24B are illustrations showing radiation patterns of vertically polarized waves of the antenna 600. FIG. 24A shows a three-dimensional pattern and FIG. 24B shows a cross section pattern on a horizontal plane. FIGS. 25A, 25B are illustrations showing radiation patterns of horizontally polarized waves of the antenna 600, FIG. 25A shows a three-dimensional pattern and FIG. 25B shows a cross section pattern on a horizontal plane.

As known from FIGS. 24A, 24B and FIGS. 25A, 25B, the antenna 600 can radiates both vertically and horizontally polarized waves. Because the element 1 is toward in a vertical direction and the element 2 is toward in a horizontal direction.

Figure 26:
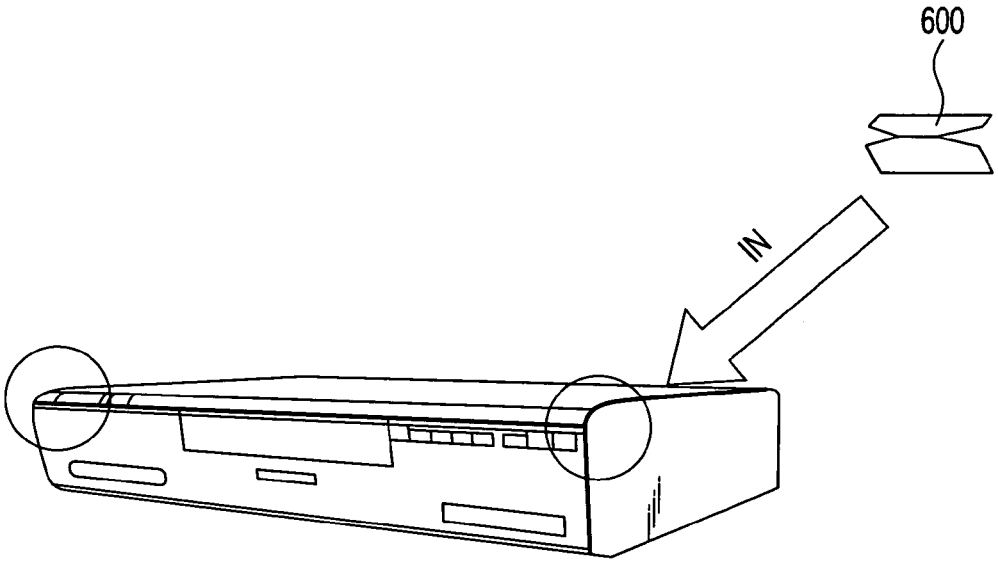
FIG. 26 is an illustration showing an example of mounting of the antenna shown in FIG. 22.
Figure 27:
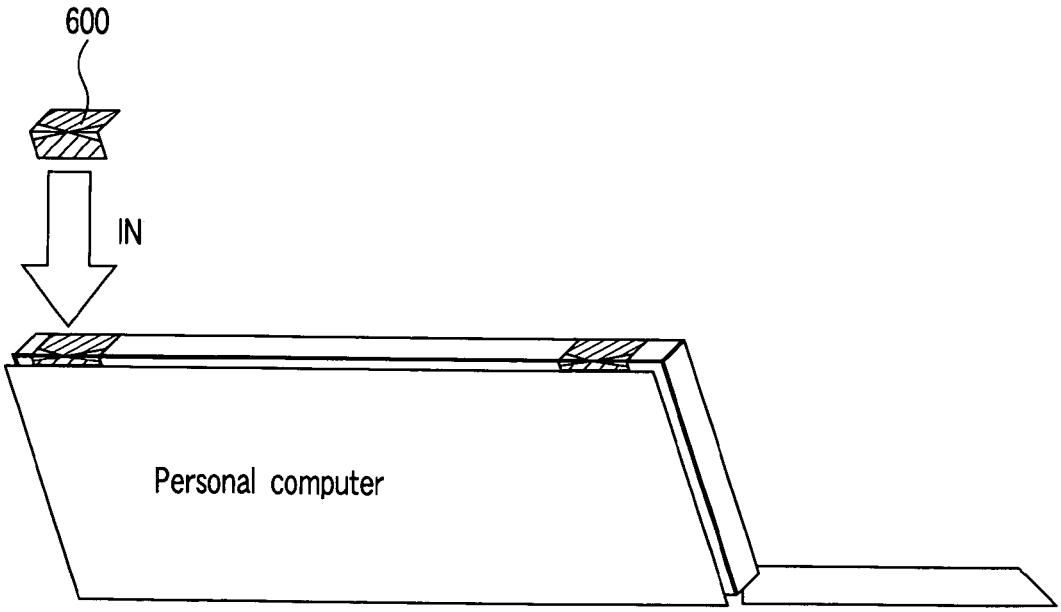
FIG. 27 is an illustration showing an example of mounting of the antenna shown in FIG. 22.

As shown in FIG. 26, the antenna 600 can be mounted on an edge of a video recorder, and as shown in FIG. 27, on an edge of a personal computer then can be efficiently mounted.

(Seventh Embodiment)

Figure 28:
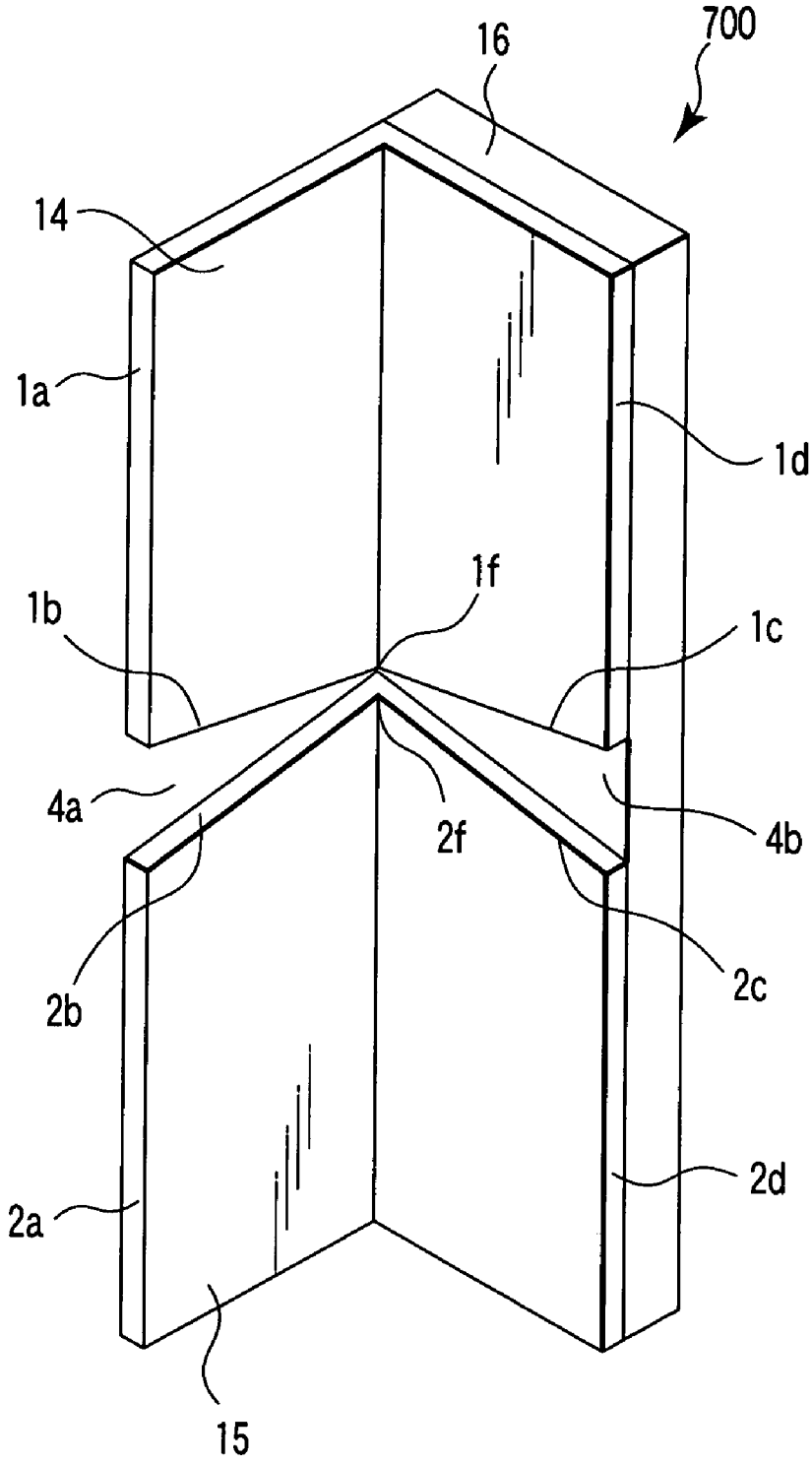
FIG. 28 is a perspective view showing a structure of a wideband antenna regarding a seventh embodiment of the invention.

FIG. 28 is the perspective view showing the structure of the wideband antenna 700 regarding the seventh embodiment of the invention. In FIG. 28 the same parts as those of FIG. 1 are referred to the same reference numerals and detailed explanation thereof will be omitted.

As shown in FIG. 28, the antenna 700 comprises conductive elements 14, 15 and a dielectric substrate 16.

The elements 14, 15 are shaped in such a manner to squarely bend the elements 1, 2 on a center line passing through the tops 1*f*, 2*f*. Thus, the elements 14, 15 present shapes equivalent to those of the elements 1, 2 by developing themselves, and respectively have the sides 1*a*, 1*b*, 1*c*, 1*d*, and 2*a*, 2*b*, 2*c*, 2*d* and the tops 1*f* and 2*f* of the elements 1, 2 as they are.

The elements 14, 15 are attached to the dielectric substrate 16, respectively, in a state so that the tops 1*f*, 2*f* are opposed to each other. A small gap is provided between the top 1*f* and the top 2*f*. The sides 1*a*, 2*a* and the sides 1*d*, 2*d* are respectively positioned on the respective straight lines.

Such arrangements of the elements 14, 15 form notches 4*a*, 4*b* are formed between the elements 14 and 15 in the same way as that of the antenna 100. However, the notches 4*a*, 4*b* are intersected orthogonally with each other.

Figure 29A:
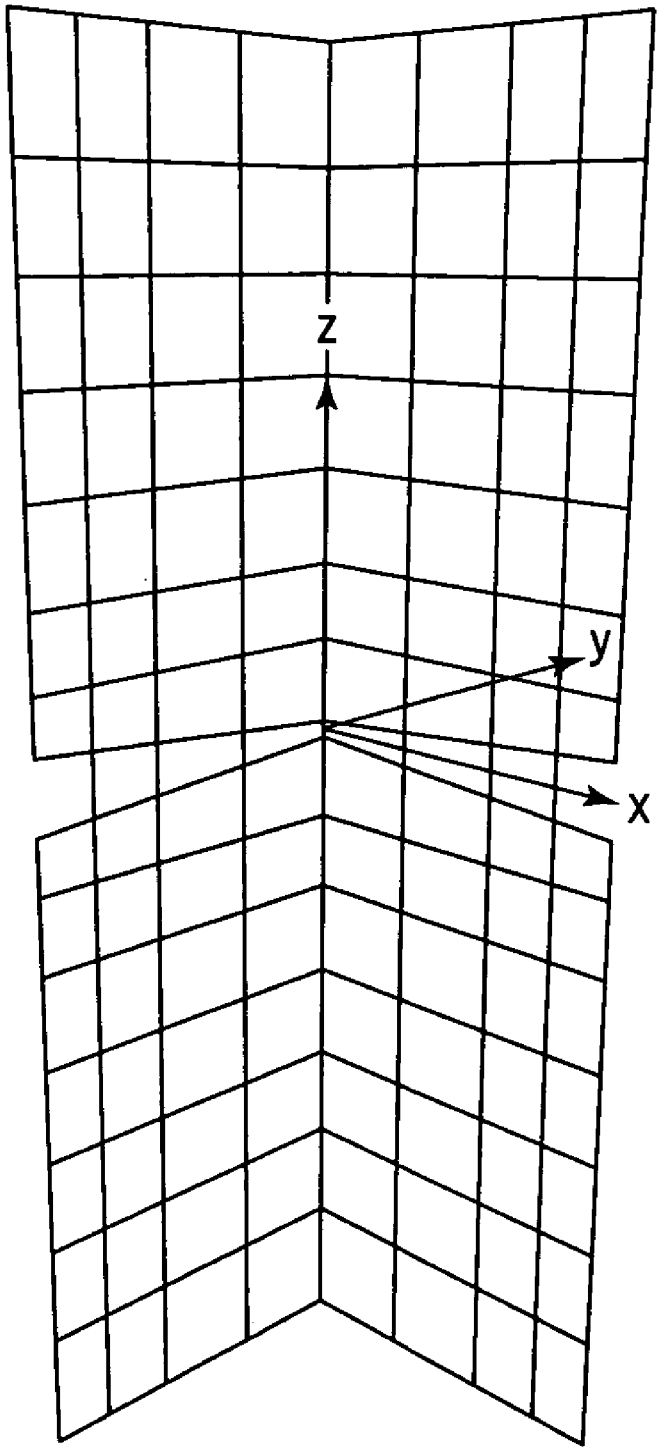
FIGS. 29A, 29B are illustrations showing characteristics of VSWR and reflection coefficient of the antenna shown in FIG. 28.
Figure 29B:
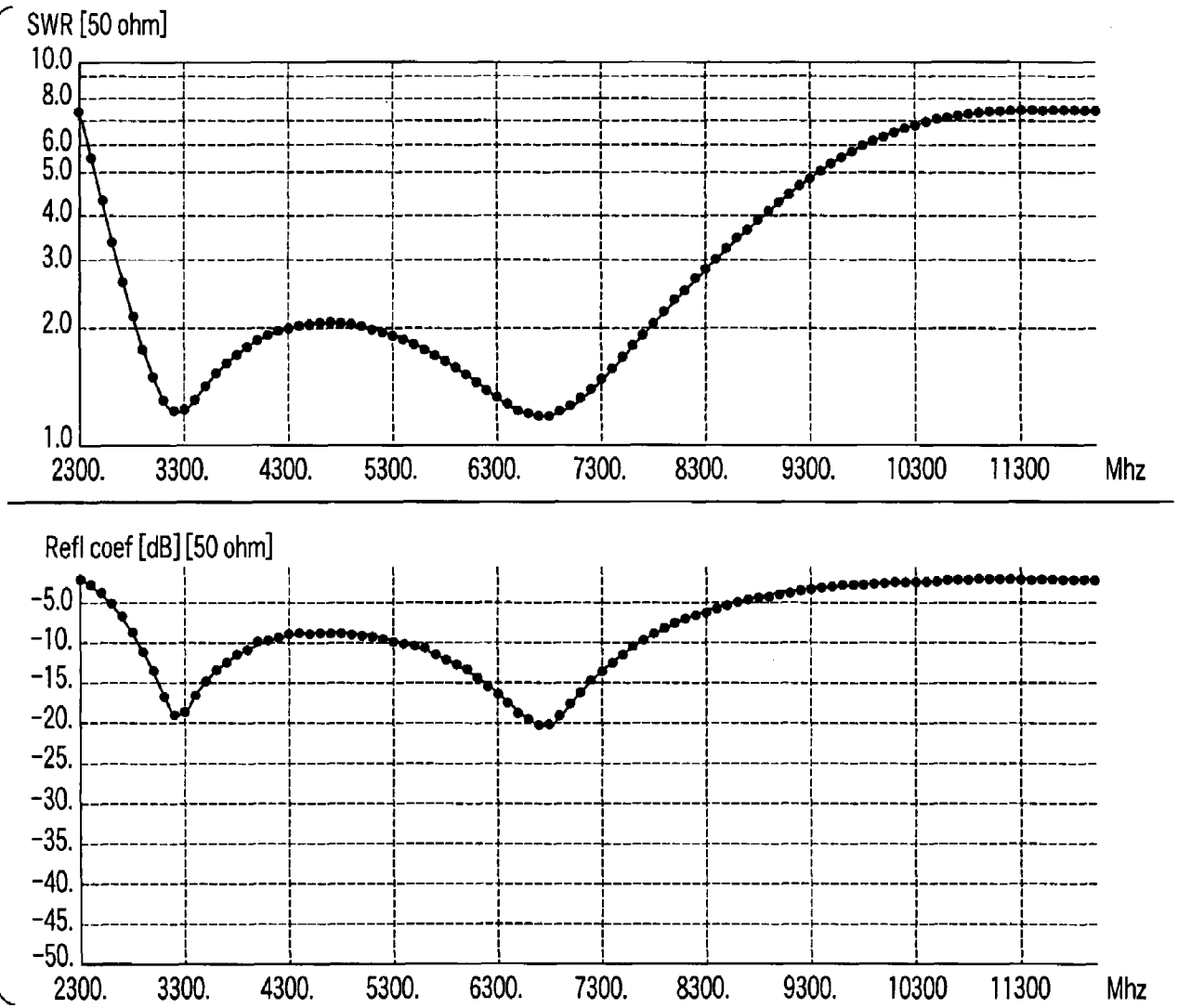

FIGS. 29A, 29B are the illustrations showing the characteristics of the VSWR and the reflection coefficient of the antenna 700. By a simulation destined to a model shown in FIG. 29A, the characteristics shown in FIG. 29B are obtained.

As is known from FIGS. 29A, 29B, also the antenna 700 as well as the antenna 100 can offers a wide transmittable/receivable band by a combination of two resonant frequencies.

Figure 30B:
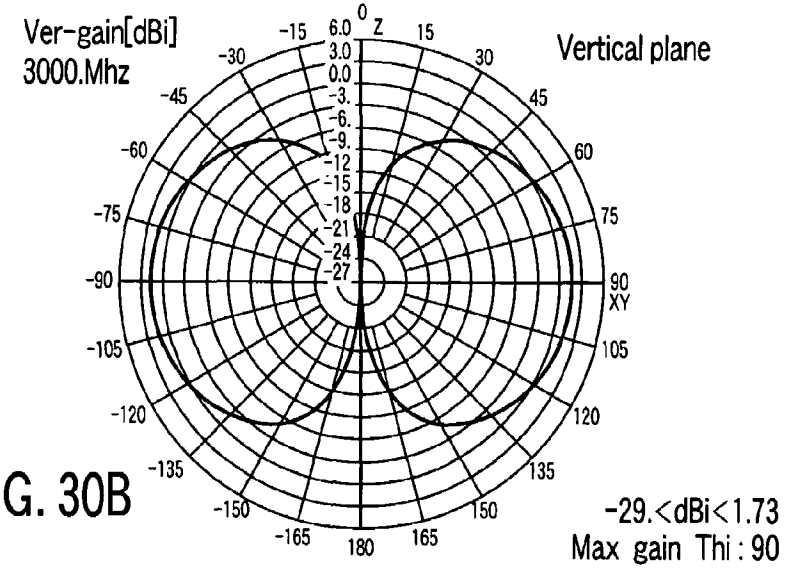
FIGS. 30A, 30B, 30C are illustrations showing radiation patterns of vertically polarized waves at 3 GHz of the antenna shown in FIG. 28.
Figure 30C:
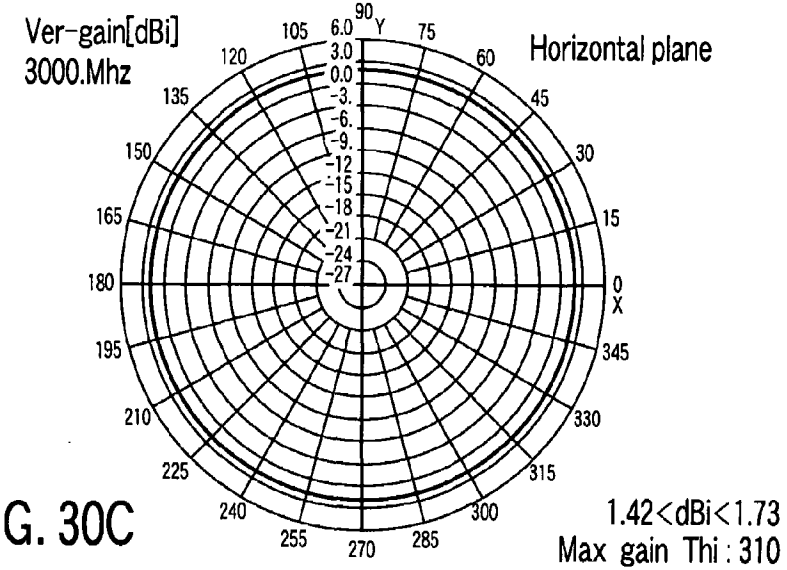
Figure 30A:
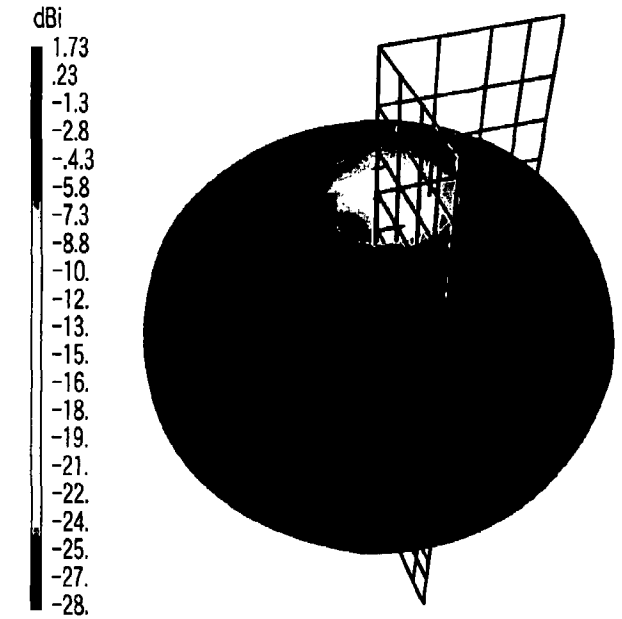
Figure 31B:
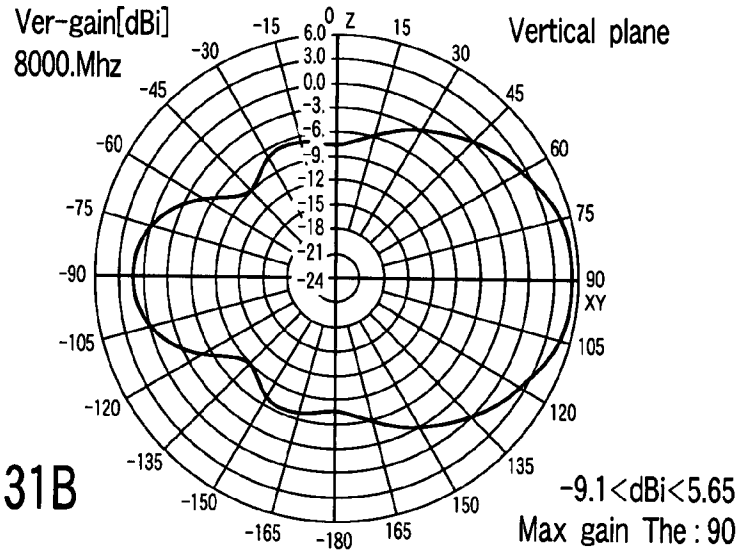
FIGS. 31A, 31B, 31C are illustrations showing radiation patterns of vertically polarized waves at 8 GHz of the antenna shown in FIG. 28.
Figure 31C:
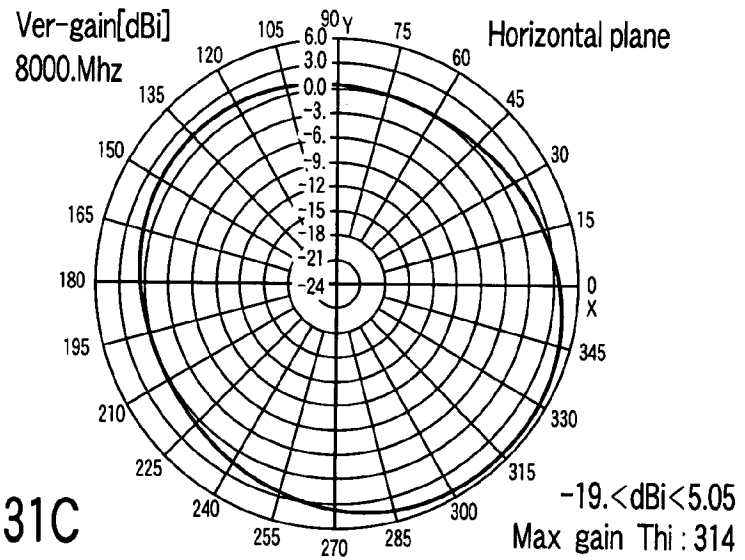
Figure 31A:
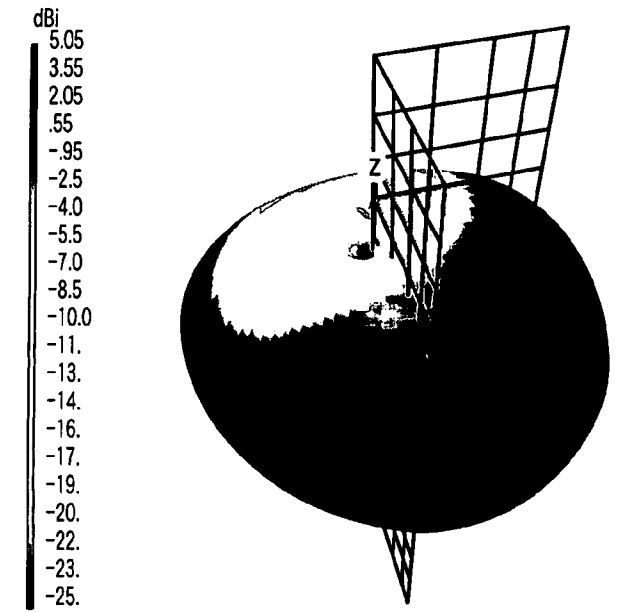

FIGS. 30A, 30B, 30C are illustrations showing radiation patterns of vertically polarized waves at 3 GHz of the antenna 700, FIG. 30A shows as a three-dimensional pattern, FIG. 30B shows as a cross section pattern on a vertical plane and FIG. 30C shows a cross section pattern on a horizontal plane. FIGS. 31A, 31B, 31C are illustrations showing radiation patterns of vertically polarized waves at 8 GHz of the antenna 700, FIG. 31A shows a three-dimensional pattern, FIG. 31B shows a cross section pattern on a vertical plane and FIG. 31C shows a cross section pattern on a horizontal pattern.

As known from these FIGS. 30A, 30B, 30C and FIGS. 31A, 31B, 31C, the antenna 700 has a radiation pattern symmetrical with respect to low frequencies within a band, however, has a radiation pattern with a diversity stronger than that of the antenna 100 with respect to high frequencies.

Thereby, the antenna 700 can be mounted on the edge of the housing, etc., like the antenna 600 and can be efficiently mounted.

(Eighth Embodiment)

Figure 32:
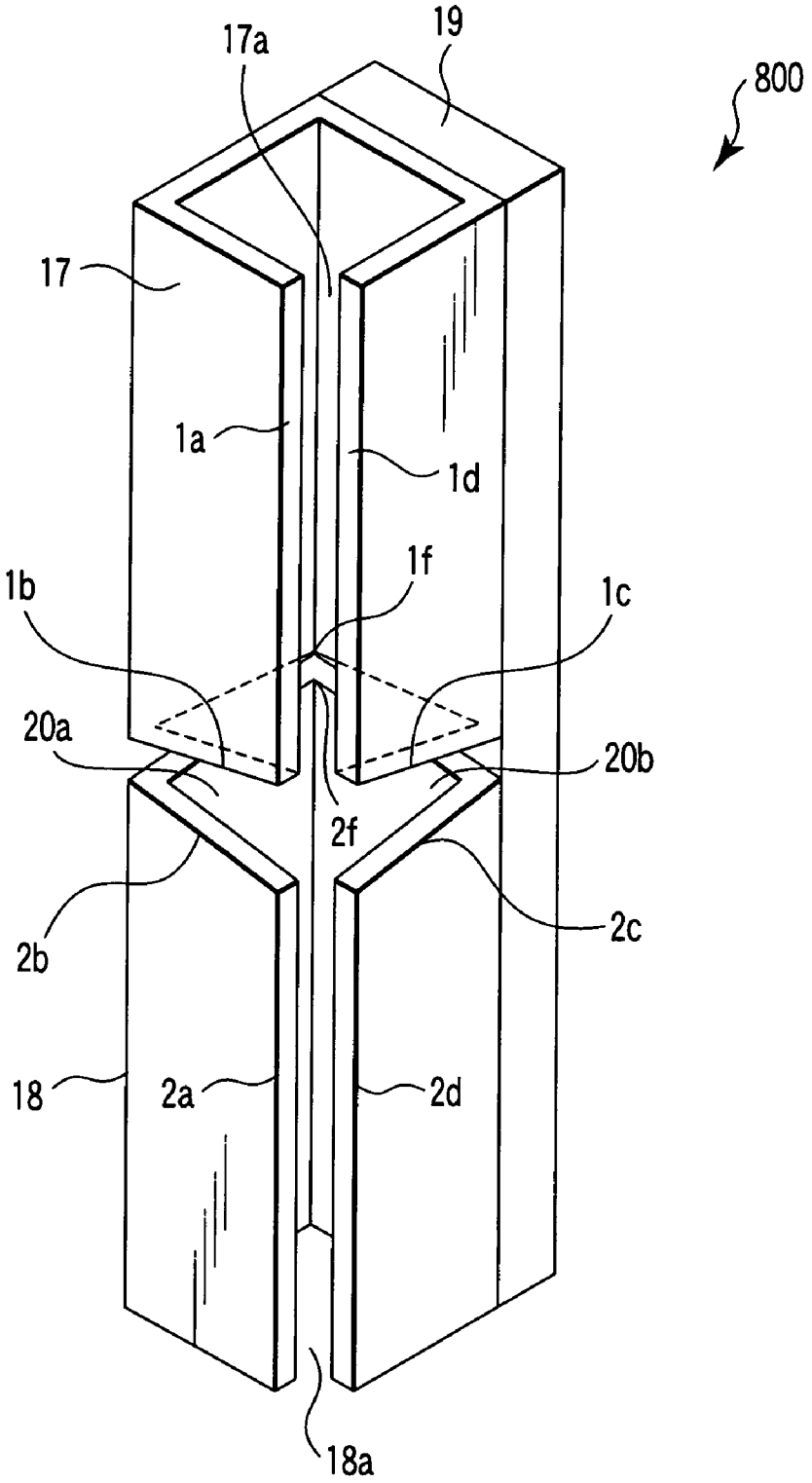
FIG. 32 is a perspective view showing a structure of a wideband antenna regarding a eighths embodiment of the invention.

FIG. 32 is a perspective view showing the structure of the wideband antenna 800 regarding the eighth embodiment of the invention. In FIG. 32 the same parts as those of FIG. 1 are referred to the same reference numerals and detailed explanation thereof will be omitted.

As shown in FIG. 32, the antenna 800 comprises conductive elements 17, 18 and a dielectric substrate 19.

The elements 17, 18 are shaped in such a manner that the elements 1, 2 are squarely bent on a center line passing through the tops 1*f*, 2*f* and both ends of the elements 1, 2 are squarely bent inward. Thus, the elements 17, 18 are formed in square column shapes. However, gaps 17*a*, 18*a* are formed between the ends of the elements 17, 18. Since the elements 17, 18 present shapes equivalent to those of the elements 1, 2 by developing themselves, and respectively have the sides 1*a*, 1*b*, 1*c*, 1*d*, 2*a*, 2*b*, 2*c*, 2*d* and the tops 1*f*, 2*f* as they are.

The elements 17, 18 are attached to the dielectric substrate 19, in a state so that the tops 1*f*, 2*f* are opposed to each other. A small gap is provided between the top 1*f* and the top 2*f*. The sides 1*a*, 2*a* and the sides 1*d*, 2*d* are positioned on the respective straight lines.

Such arrangements of the elements 17, 18 form notches 60*a*, 60*b* between the elements 17 and 18 in the same way as that of the antenna 100. The shapes of the notches 60*a*, 60*b* are approximately congruent with each other. Each width of the notches 60*a*, 60*b* is narrowest between the tops 1*f* and 2*f* and gradually becomes wider toward both side sections of the elements 17, 18.

Figure 33A:
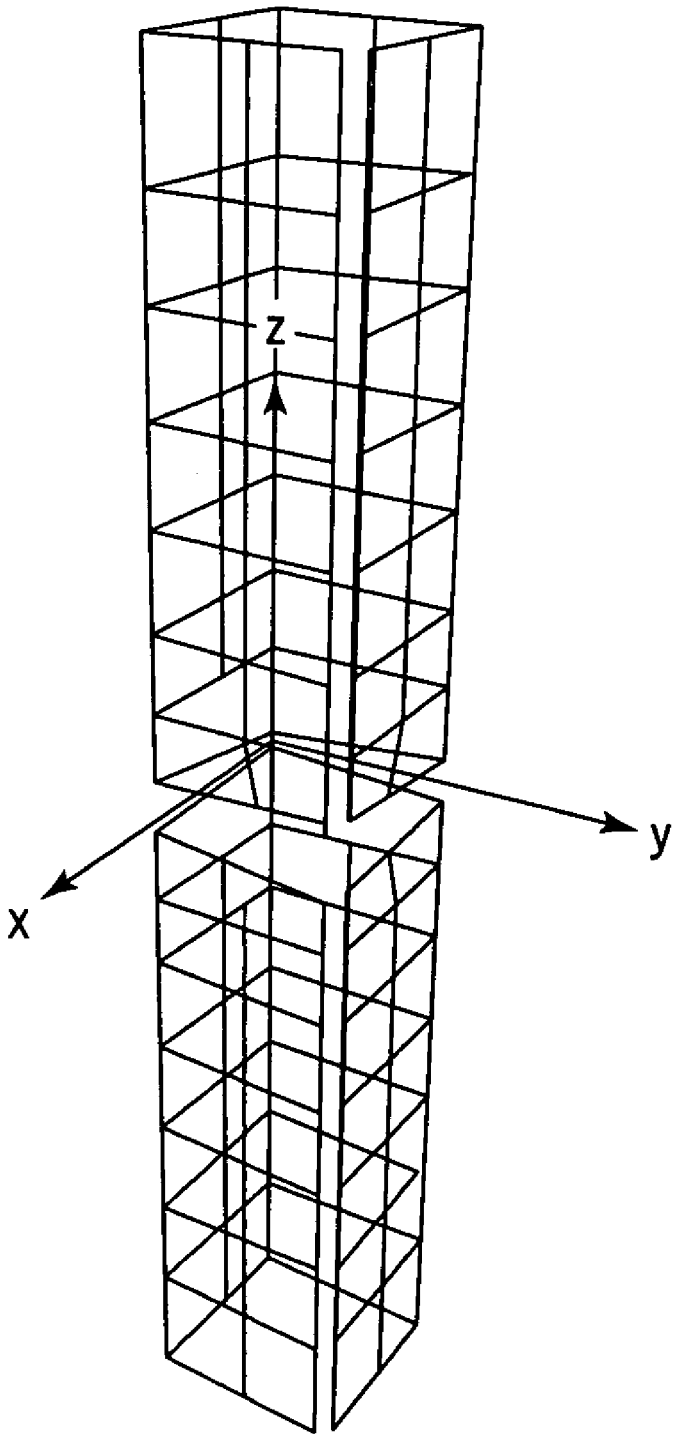
FIGS. 33A, 33B are illustrations showing characteristics of VSWR and reflection coefficient of the antenna shown in FIG. 32.
Figure 33B:
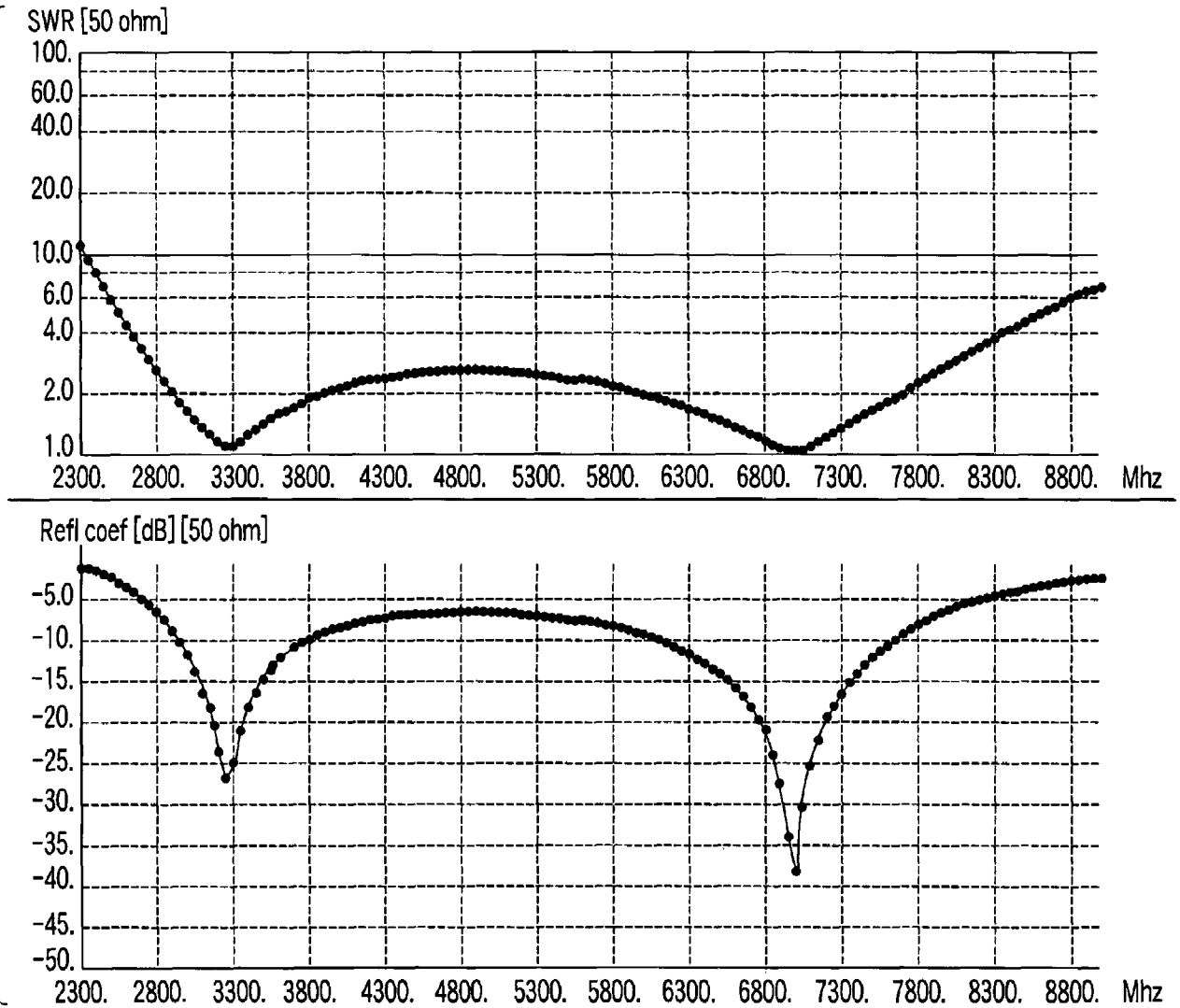

FIGS. 33A, 33B are the illustrations showing the characteristics of the VSWR and the reflection coefficient of the antenna 800. By a simulation destined to a model shown in FIG. 33A, the characteristics shown in FIG. 33B are obtained.

As is known from FIGS. 33A, 33B, also the antenna 800 as well as the antenna 100 can offers a wide transmittable/receivable band by a combination of two resonant frequencies.

Figure 34B:
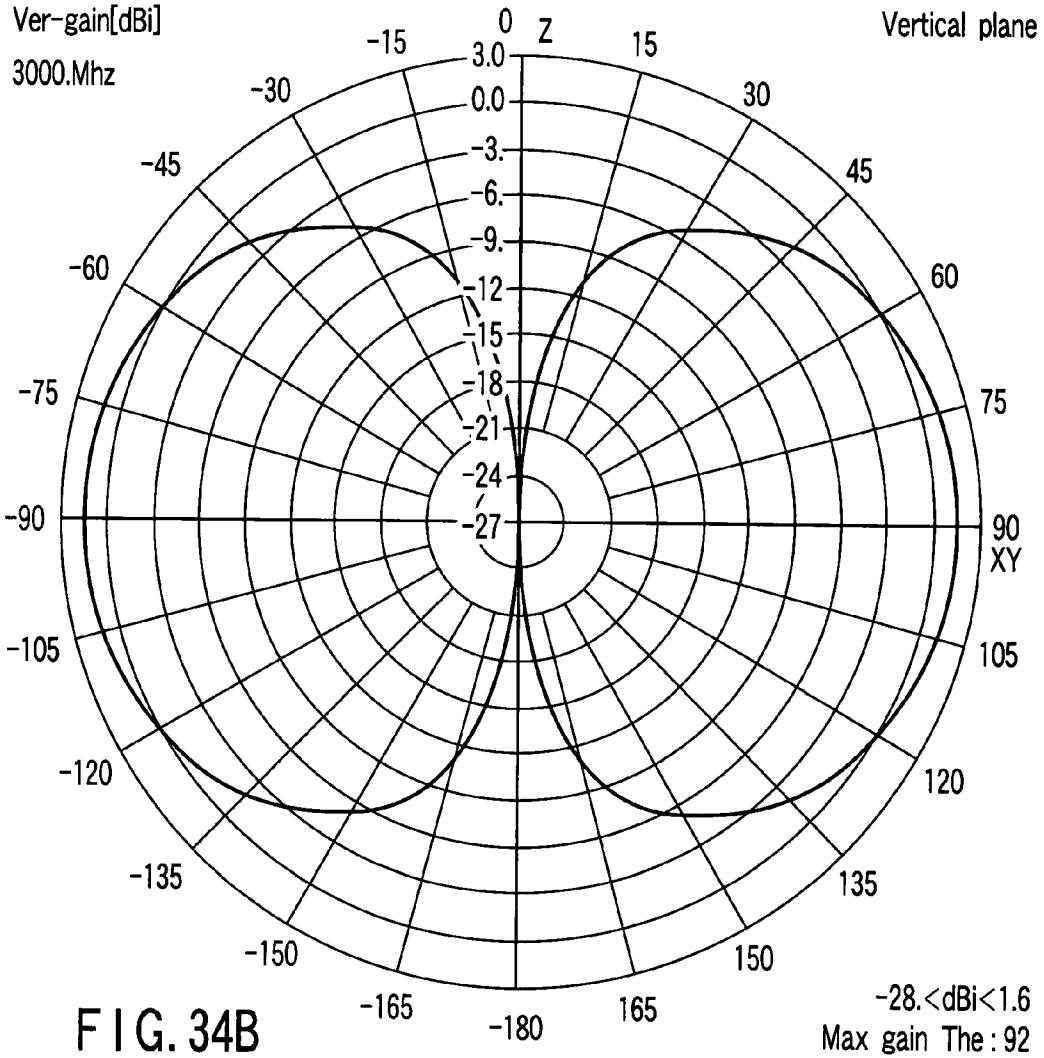
FIGS. 34A, 34B are illustrations showing radiation patterns at 3 GHz of the antenna shown in FIG. 32.
Figure 34A:
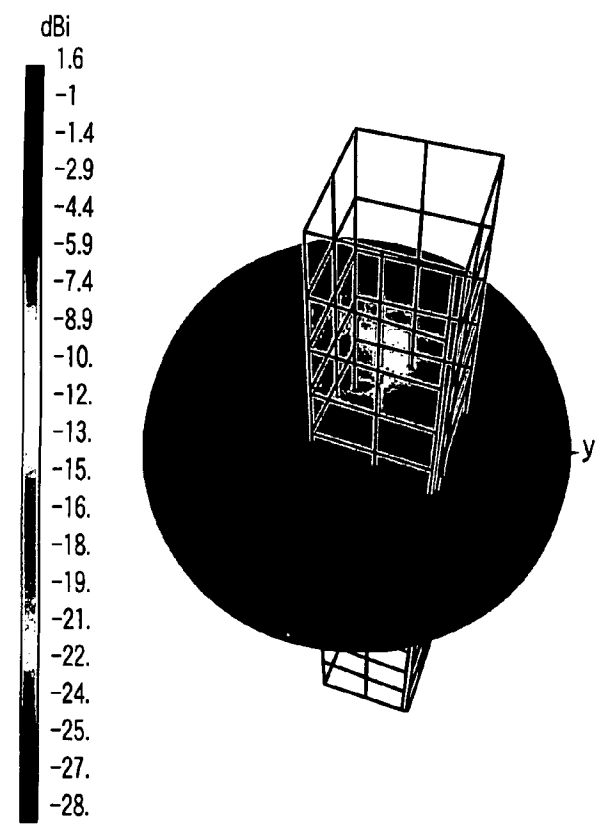
Figure 35B:
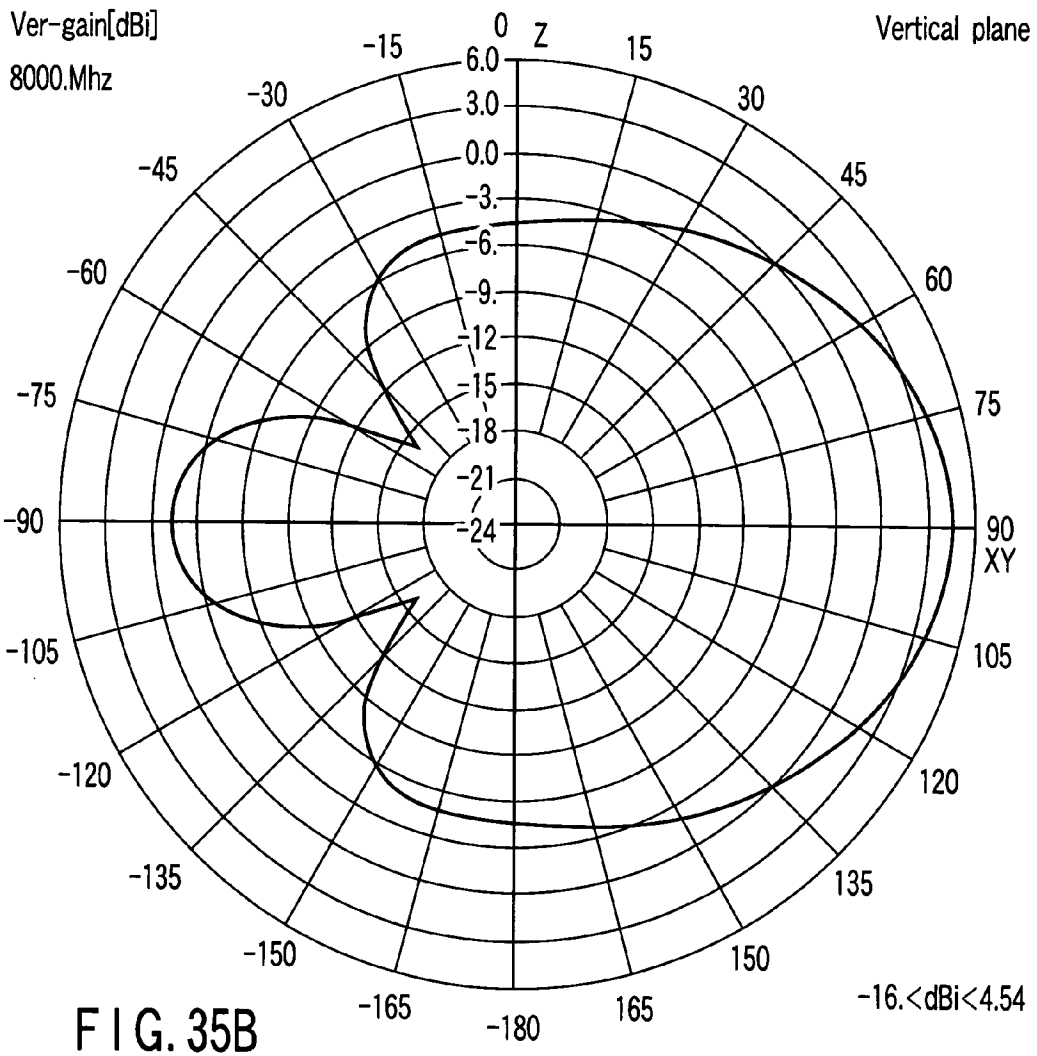
FIGS. 35A, 35B are illustrations showing radiation patterns at 8 GHz of the antenna shown in FIG. 32.
Figure 35A:
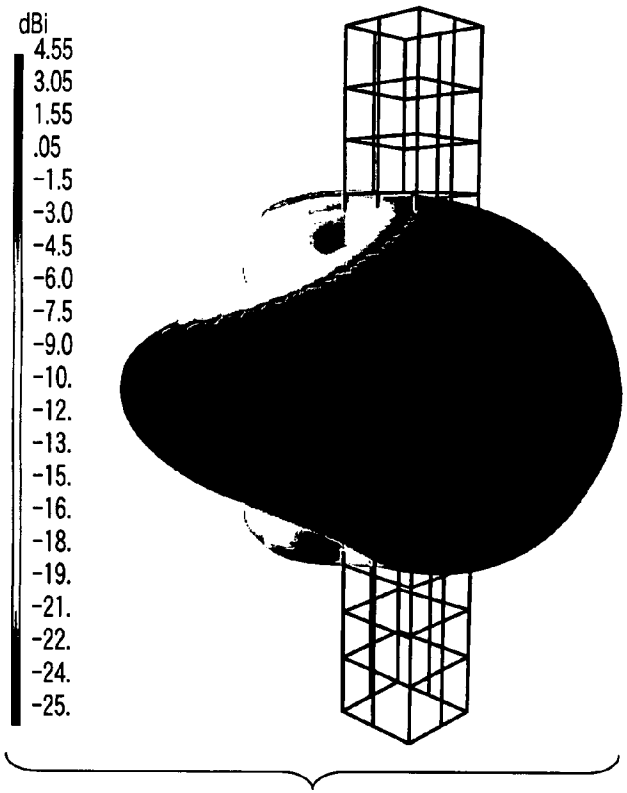

FIGS. 34A, 34B are illustrations showing radiation patterns of vertically polarized waves at 3 GHz of the antenna 800, FIG. 34A shows as a three-dimensional pattern, and FIG. 34B shows as a cross section pattern on a vertical plane. FIGS. 35A, 35B are illustrations showing radiation patterns of vertically polarized waves at 8 GHz of the antenna 800, FIG. 35A shows as a three-dimensional pattern and FIG. 35B shows as a cross section pattern on a vertical plane.

As known from these FIGS. 34A, 34B and FIGS. 35A, 35B, the antenna 800 has a radiation pattern symmetrical with respect to low frequencies within a band, however, has a radiation pattern with a diversity stronger than that of the antenna 100 with respect to high frequencies. Thereby, the antenna 800 is appropriate for an application required the diversity.

(Ninth Embodiment)

Figure 36:
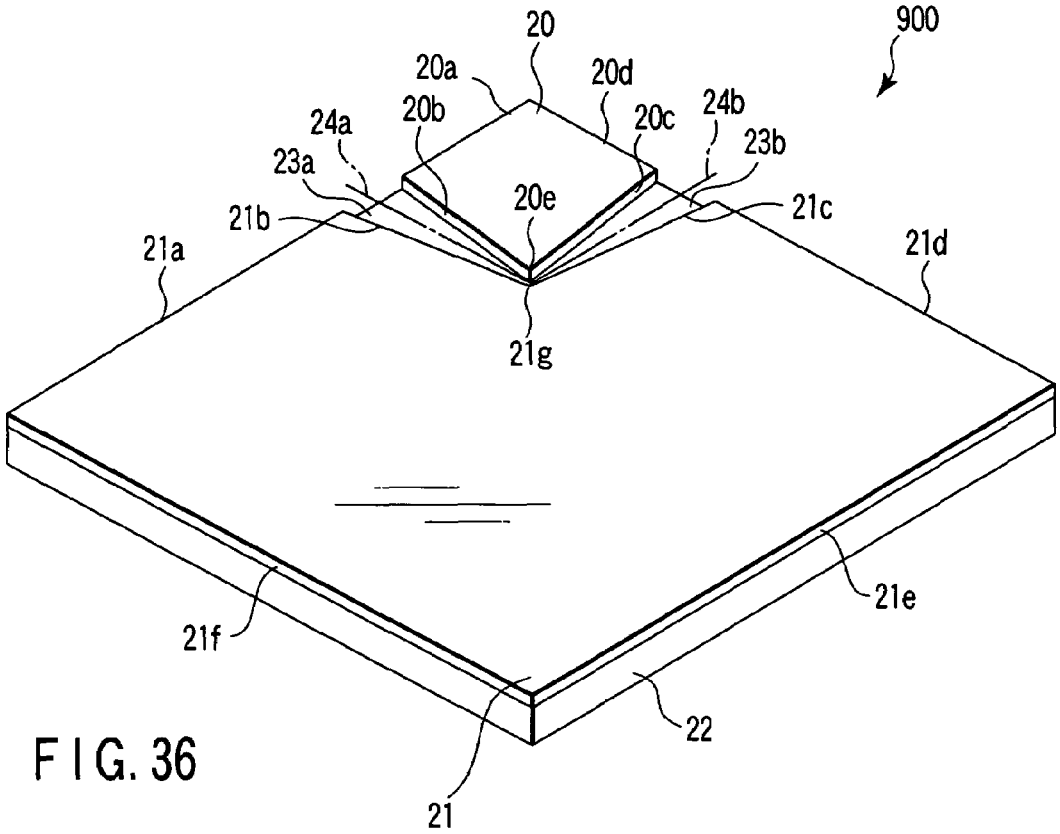
FIG. 36 is a perspective view showing a structure of a wideband antenna regarding a ninth embodiment of the invention.

FIG. 36 is the perspective view showing the structure of the wideband antenna 900 regarding the ninth embodiment of the invention. In FIG. 36, the same parts as those of FIG. 1 are referred to the same reference numerals and detailed explanation thereof will be omitted.

As shown in FIG. 36, the antenna 900 comprises conductive elements 20, 21 and a dielectric substrate 22.

The elements 20, 21 respectively have shapes which are cut off and formed by forming notches 23*a*, 23*b* onto a thin plate made of one piece of conductive material having an approximately square shape. Each notch 23*a*, 23*b* has a shape in linear symmetry with line segments 24*a*, 24*b* as the centers to cut off the thin plate from the thin plate described above, wherein the cut-off thin plate is smaller than the thin plate described above and approximately square. Each width of the notches 23*a*, 23*b* gradually becomes wider toward both side sections of the elements 20, 21. The shapes of the notches 23*a*, 23*b* are approximately congruent with each other.

The elements 20, 21 are attached onto the dielectric substrate 3 in a state to maintain a relative positional relationship so that the notches 23*a*, 23*b* to stay in the states described above.

The element 20 has four sides. As shown in FIG. 36, these four sides of the elements 20 are sides 20*a*, 20*b*, 20*c* and 20*d*. The sides 20*b*, 20*c* are the sides facing the notches 23*a*, 23*b*, and contact each other. A top 20*e* is formed at the part with which the sides 20*b*, 20*c* contact each other. The side 20*a* contacts the side 20*b*. The side 20*d* contacts the sides 20*a* and 20*c*.

The element 21 has six sides. As shown in FIG. 36, these six sides are sides 21*a*, 21*b*, 21*c*, 21*d*, 21*e* and 21*f*. The sides 21*b*, 21*c* are the sides facing the notches 23*a*, 23*b*, and contact each other. A valley section 21*g* is formed at the part with which the sides 21*b*, 21*c* contact each other. The side 21*a* contacts the side 21*b*, and the side 21*d* contacts the side 21*c*.

The top 20*e* of the element 20 and the valley section 21*g* of the element 21 are opposed to each other. A small gap is provided between the top 20*e* and the valley section 21*g*. The sides 20*a*, 21*a* and the sides 20*d*, 21*d* are positioned on the same straight lines, respectively.

The antenna 900 structured in a manner as described above is different in shape from the antenna 100 in a manner that the valley section 21*g* but not the top 20*e* is formed at the part with which the sides 21*b* 21*c* contact each other, however, it is possible for the sides 20*a*, 20*b*, 20*c*, 20*d*, 21*a*, 21*b*, 21*c* and 21*d* to be considered to correspond to the sides 1*a*, 1*b*, 1*c*, 1*d*, 2*a*, 2*b*, 2*c*, 2*d* of the antenna 100, respectively. The lengths of the sides 20*a*, 20*b*, 20*c*, 20*d*, 21*a*, 21*b*, 21*c*, 21*d* are set to the same lengths as those of the sides 1*a*, 1*b*, 1*c*, 1*d*, 2*a*, 2*b*, 2*c*, 2*d* of the antenna 100.

Figure 37A:
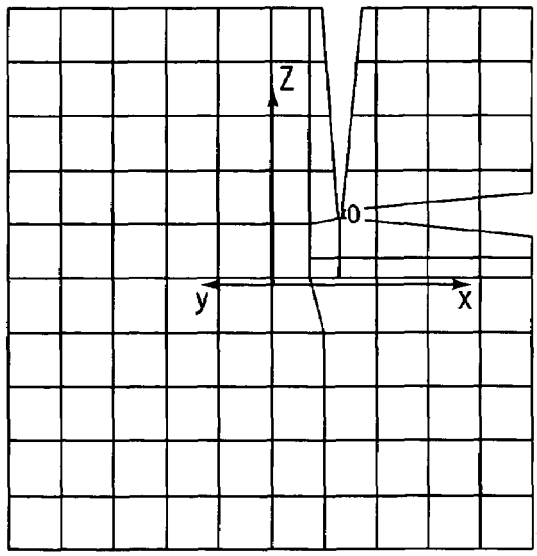
FIGS. 37A, 37B are illustrations showing characteristics of VSWR and reflection coefficient of the antenna shown in FIG. 36.
Figure 37B:
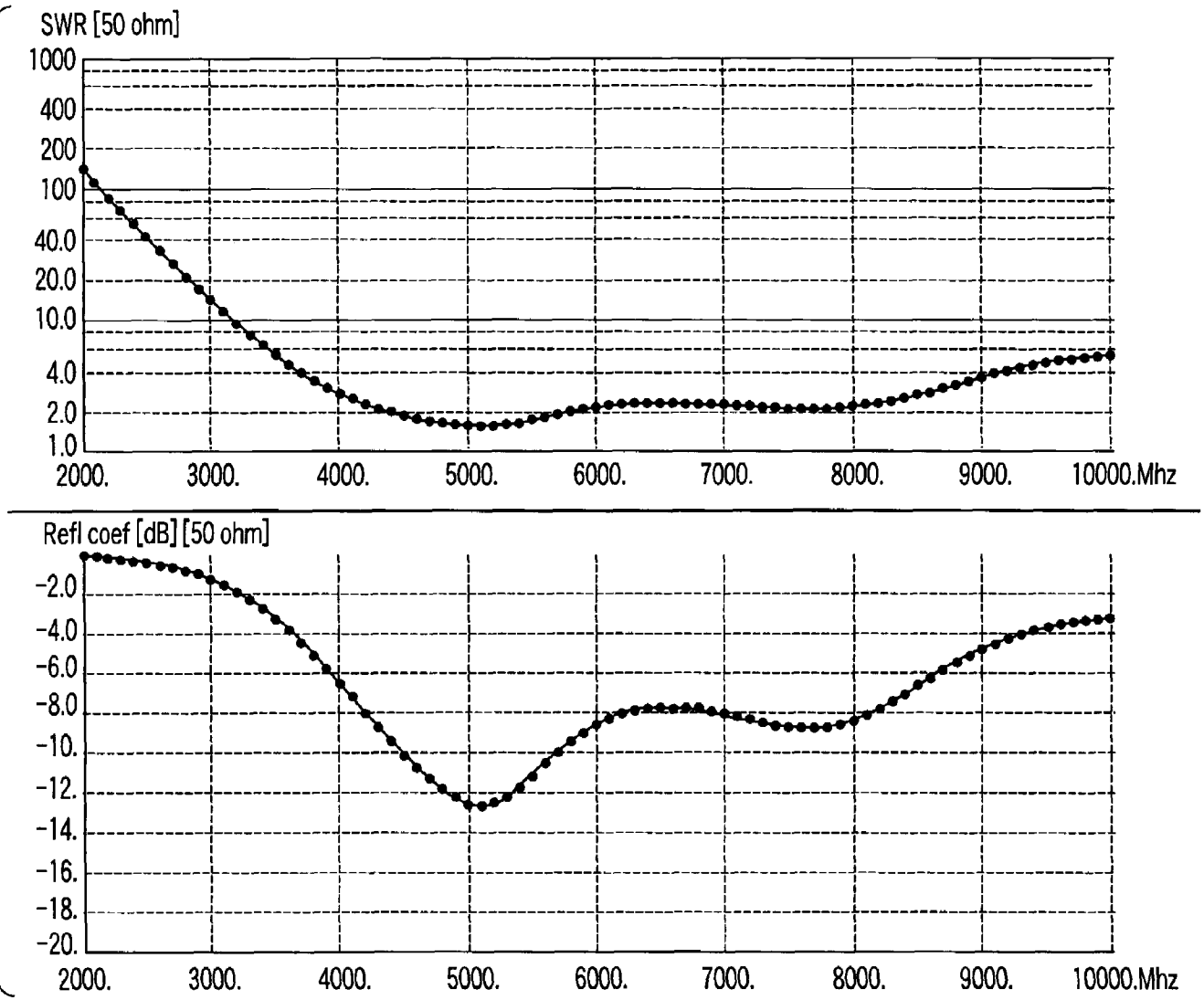

FIGS. 37A, 37B are the illustrations showing the characteristics of the VSWR and the reflection coefficient of the antenna 900. By a simulation destined to a model shown in FIG. 37A, the characteristics shown in FIG. 37B are obtained.

As is known from FIGS. 37A, 37B, also the antenna 900 as well as the antenna 100 can offers a wide transmittable/receivable band by a combination of two resonant frequencies.

The antenna 900 has the notches 23*a*, 23*b* intersecting orthogonally with each other, so that the antenna 900 can direct one of the notches 23*a*, 23*b* toward a vertical direction and direct the other toward a horizontal direction. By using the antenna 900 in such an attitude, the antenna 900 can transmit and receive the vertically polarized waves and the horizontally polarized waves.

Figure 38B:
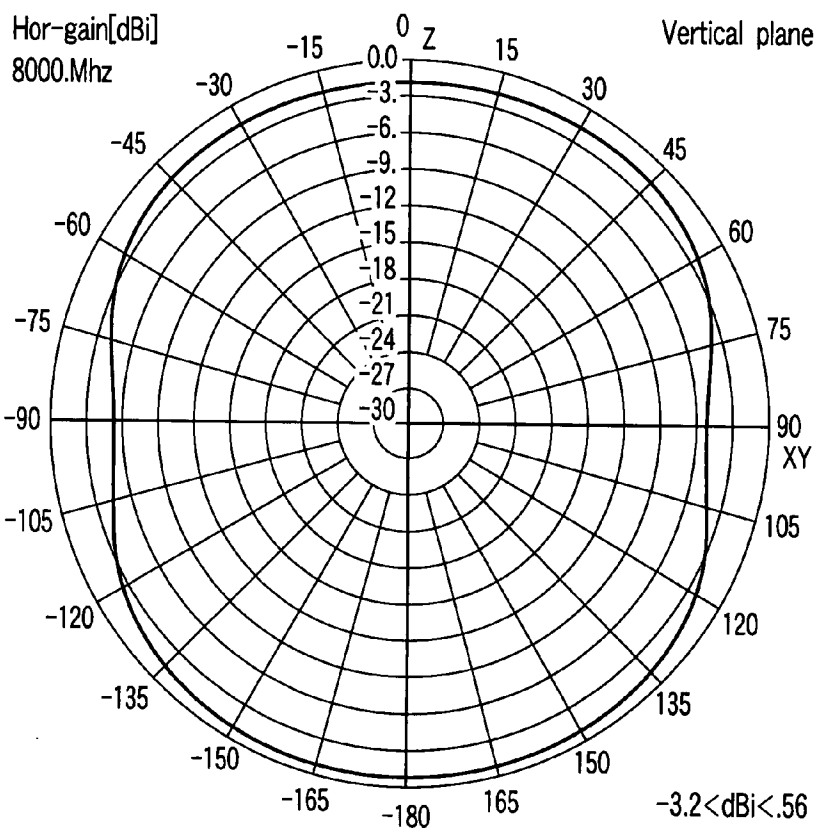
FIGS. 38A, 38B are illustrations showing radiation patterns of the antenna shown in FIG. 36.
Figure 38A:
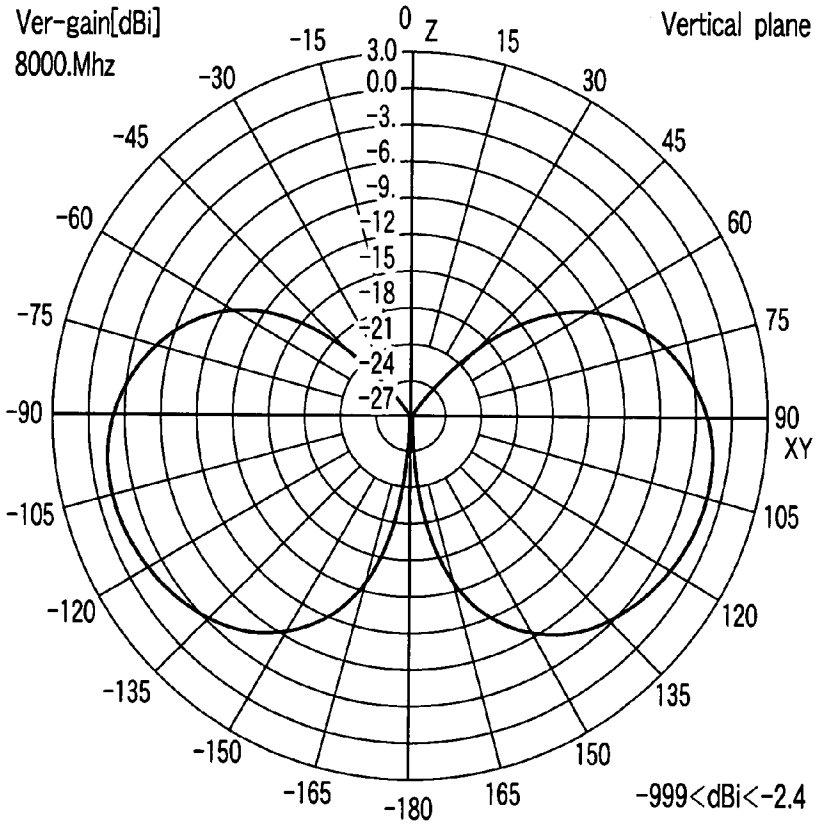

FIGS. 38A, 38B are illustrations showing radiation patterns of the antenna 900, FIG. 38A shows a radiation pattern of the vertically polarized waves as a cross section pattern on a vertical plane, and FIG. 38B shows a radiation pattern of the horizontally polarized waves as a cross section pattern on a vertical plane.

(Tenth Embodiment)

Figure 39:
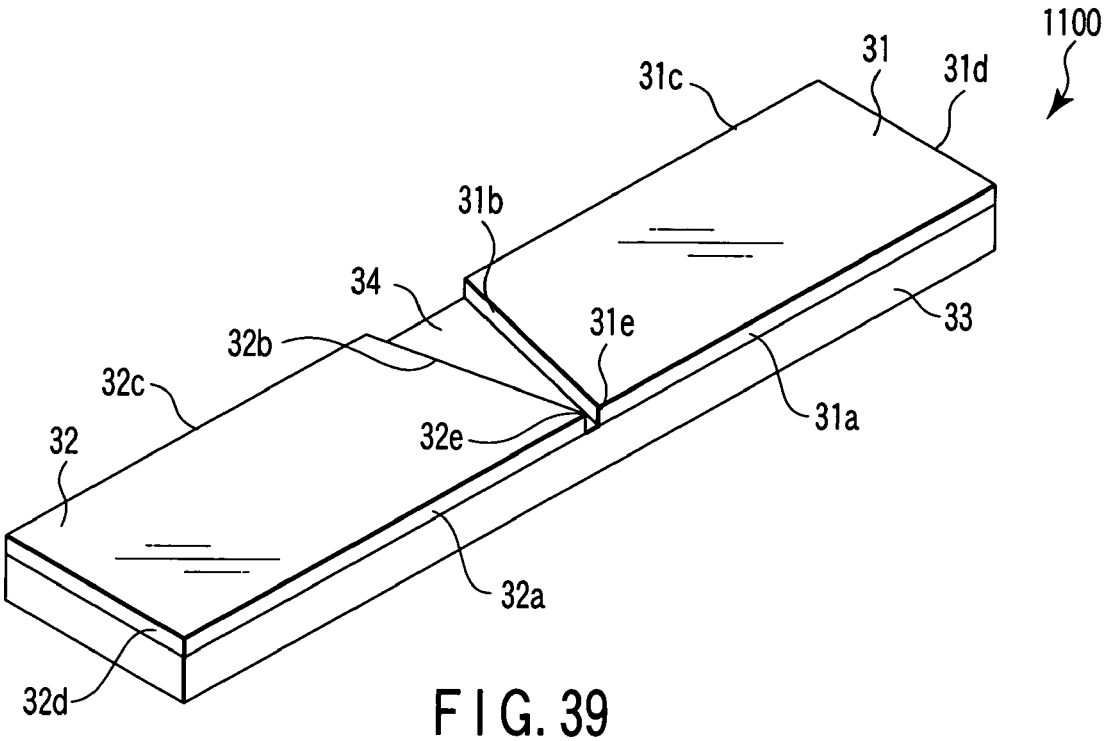
FIG. 39 is a perspective view showing a structure of a wideband antenna regarding a tenth embodiment of the invention.

FIG. 39 is the perspective view showing the structure of the wideband antenna 1100 regarding the tenth embodiment of the invention.

As shown in FIG. 39, the antenna 1100 comprises conductive elements 31, 32 and a dielectric substrate 33.

The elements 31, 32 are thin plates made of conductive material. Each element 31, 32 are shaped in trapezoid in which only one side is inclined. The elements 31, 32 are approximately symmetric in shape with each other.

As shown in FIG. 39, four sides of the element 31 are sides 31*a*, 31*b*, 31*c* and 31*d*. The side 31*b* is the inclined side as described above. Each side 31*a*, 31*c* contacts opposed ends of the side 31*b*. The sides 31*a*, 31*c* are approximately parallel to each other. A top 31*e* is formed at a part with which the side 31*a*, 31*b* are contacted. The opposed ends of the side 31*d* contact the sides 31*a* and 31*c*, respectively.

As shown in FIG. 39, four sides of the element 32 are sides 32*a*, 32*b*, 32*c* and 32*d*. The side 32*b* is the inclined side as described above. Each side 32*a*, 32*c* contacts opposed ends of the side 32*b*. The sides 32*a*, 32*c* are approximately parallel to each other. A top 32*e* is formed with which the sides 32*a*, 32*b* are contacted. The opposed ends of the side 32*d* contact the sides 32*a* and 32*c*, respectively.

The elements 31, 32 are mounted on the same surface of the substrate 33 in a state that the tops 31*e*, 32*e* are opposed to each other. A small gap is provided between the tops 31*e* and the 32*e*. The sides 31*a*, 32*a* and the sides 31*c*, 32*c* are respectively positioned on the same straight lines.

By such arrangements of the elements 31, 32 described above, a notch 34 is formed between the elements 31 and 32. The width of the notch 34 is narrowest between the tops 31*e* and 32*e*, and gradually becomes wider with getting apart from the tops 31*e*, 32*e*. That is, the notch 34 is shaped so that the notch 34 makes an intermediate point of the tops 31*e*, 32*e* be a reference point and has a width becoming wider with getting apart from the reference point. A wider opening end at which the notch 34 becomes widest coincides with each one end of the sides 31*c*, 32*c*.

Figure 40A:
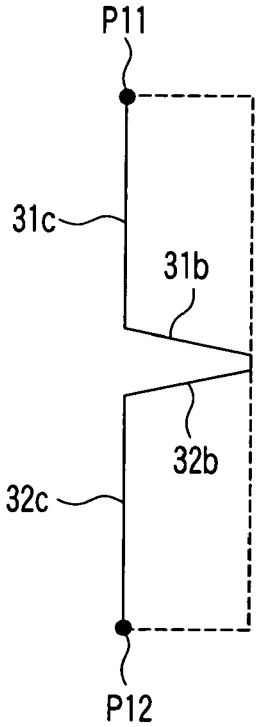
FIGS. 40A, 40B are illustrations explaining conditions to define sizes of conductive elements shown in FIG. 39.
Figure 40B:
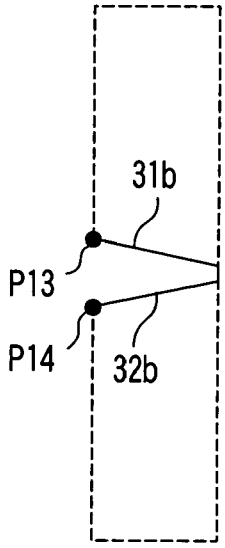

Sizes of the elements 31, 32 are defined in consideration with the required frequency band. That is, two frequencies f1, f2 (f1<f2) within the frequency band, and wavelength of the frequencies f1, f2 are set to $\lambda 1$, $\lambda 2$. As shown by a solid line in FIG. 40A, the length L11 from an end P11 of the side 31*c* up to an end P12 of the side 32*c* along with the sides 31*c*, 31*b*, 32*b*, 32*c* is set to approximately $\lambda 1 \times 1/2$. As shown by a solid line in FIG. 40B, the length L12 from an end P13 (positioned at an wider opening end of the notch 34) of the side 31*b* up to an end P14 (positioned at an wider opening end of the notch 34) of the side 32*b* is set to approximately $\lambda 2 \times 1/2$. Although the lengths L11 should be $\lambda 1 \times 1/2$, i.e., $\lambda 1 \times 0.5$ ideally, the extent from $\lambda 1 \times 0.4$ to $\lambda 1 \times 0.6$ may be sufficient. Although the lengths L12 should be $\lambda 2 \times 0.5$ ideally, the extent from $\lambda 2 \times 0.4$ to $\lambda 2 \times 0.6$ may be sufficient.

The gap between the top 31*e* and the top 32*e* is very small in comparison with the lengths of each side of the elements 31, 32. Whereby, the length L11 is substantially equal to the sum of the respective lengths of the sides 31*b*, 31*c*, 32*b* and 32*c*. The length L12 is substantially equal to the sum of the respective lengths of the sides 31*b* and 32*b*.

The elements 31, 32 can be made of, for example, sheet metal, flexible substrate, insert molding, MID (plated resin), etc.

The antenna 1100 structured in the manner described above sets a power feeding point between a section near the top 31*e* and a section near the top 32*e*, i.e., at a section near the reference point.

Figure 41A:
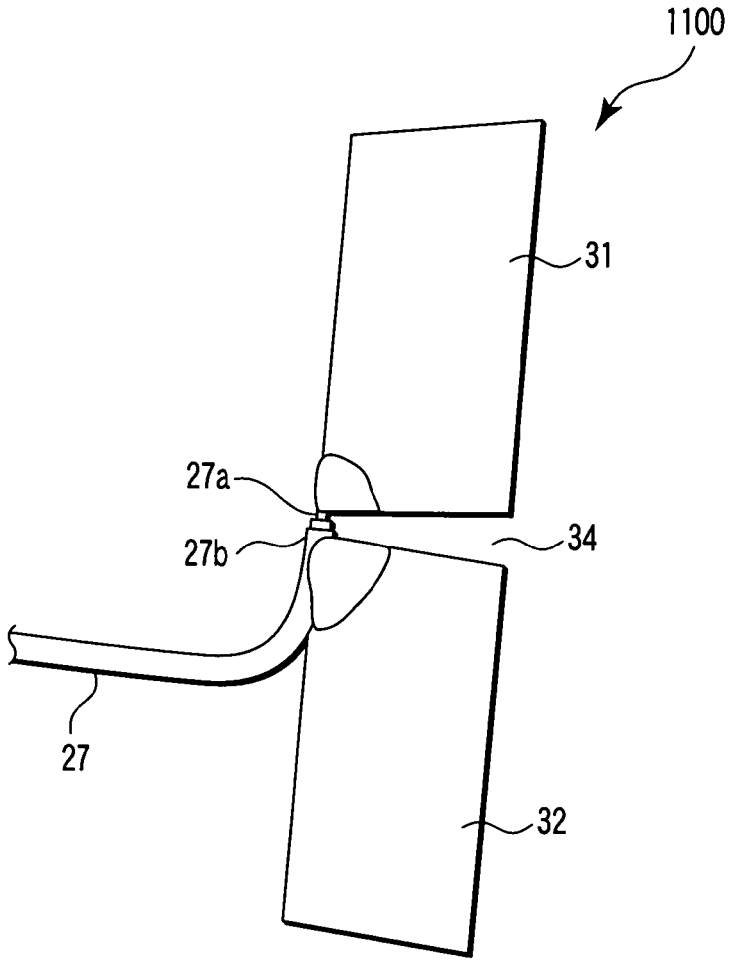
FIGS. 41A, 41B are illustrations showing power feeding forms to the antenna shown in FIG. 39.
Figure 41B:
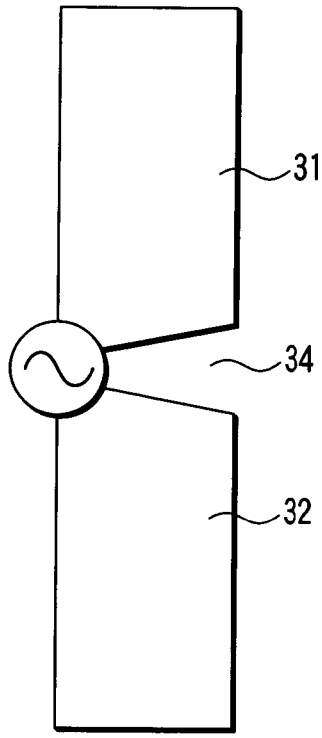

FIGS. 41A, 41B are the illustrations showing forms of power feeding to the antenna 1100. As shown FIG. 41A, an inner conductor 27*a* of a coaxial cable 27 is soldered to the element 31 in the vicinity of the top 31*e*. An outer conductor 27*b* of the cable 27 is soldered to the element 32 in the vicinity of the top 32*e*. By such a structure shown in FIG. 41B, the feeding point is positioned at the section near the reference point.

Figure 42:
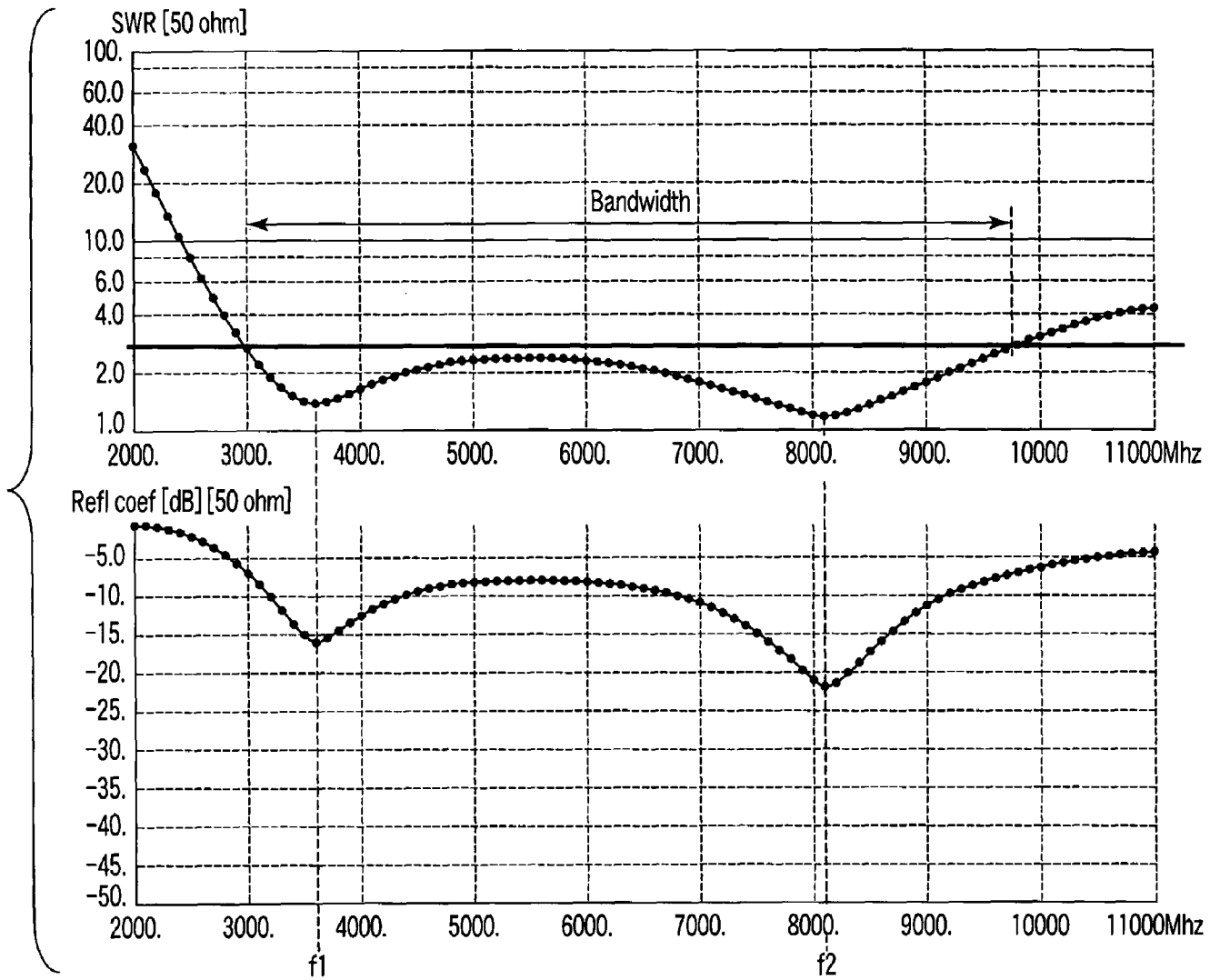
FIG. 42 is an illustrations showing characteristics of VSWR and reflection coefficient of the antenna shown in FIG. 39.

FIG. 42 is the illustration showing the characteristics of the VSWR and the reflection coefficient when the frequencies f1 and f2 are set to 3.6 GHz and 8.1 GHz, and when power is fed between the top 31*e* and the 32*e*.

As shown in FIG. 42, the two frequencies f1, f2 become resonant points, and the VSWR and the reflection coefficient become extremely small. The VSWR as to intermediate frequencies between the frequencies f1 and f2 becomes larger than at the frequencies f1 and f2, however, the VSWR is suppressed sufficiently small. As the frequency becomes lower than the frequency f1, or as the frequency becomes higher than the frequency f2, the VSWR increases drastically. For example, if the upper limit of the required VSWR is set to around 3, the range of about 3.0 GHz–9.8 GHz becomes the transmittable/receivable band in an example shown in FIG. 42.

The antenna 1100 as described above, a wider transmittable/receivable band can be obtained by a combination of two resonant frequencies. By appropriately setting the frequencies f1 and f2, the transmittable/receivable band can coincide with the required frequency band. However, if the difference between the frequencies f1 and f2 is set excessively large, it is feared that the VSWR at the intermediate frequency between the frequencies f1 and f2 becomes excessively large, so that the frequencies f1 and f2 should be appropriately set within a range so as not to produce such a state.

Figure 43:
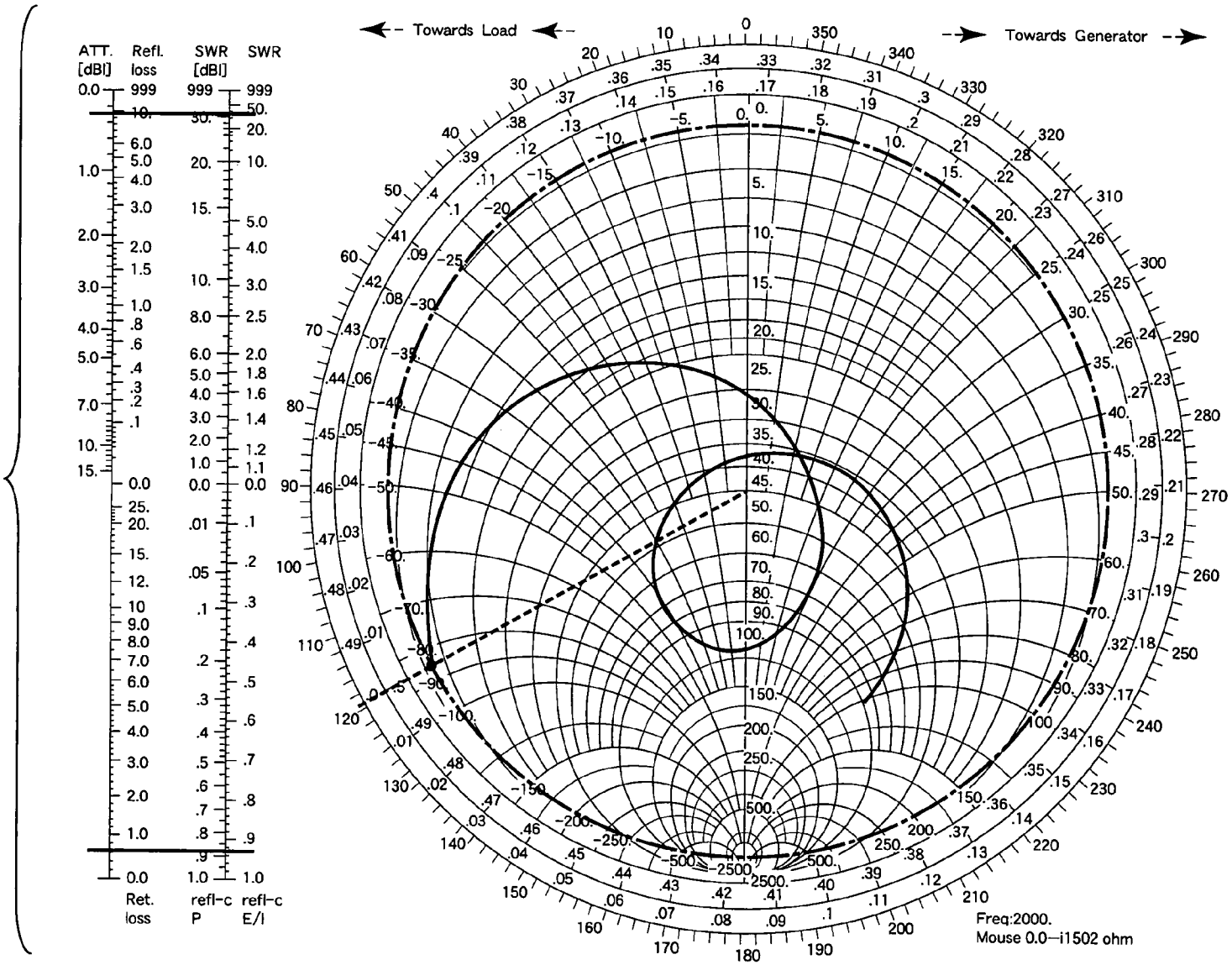
FIG. 43 is a Smith chart with respect to the antenna shown in FIG. 39.
Figure 44A:
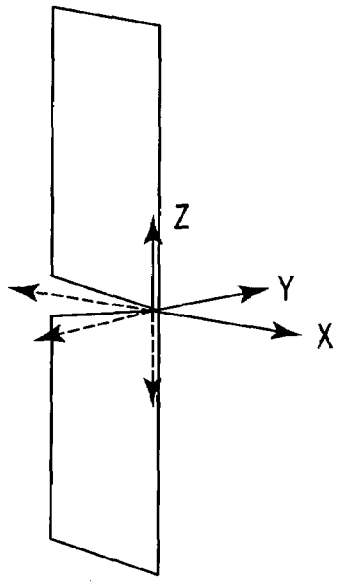
FIGS. 44A–44G are illustrations showing radiation patterns of the antenna shown in FIG. 39.
Figure 44B:
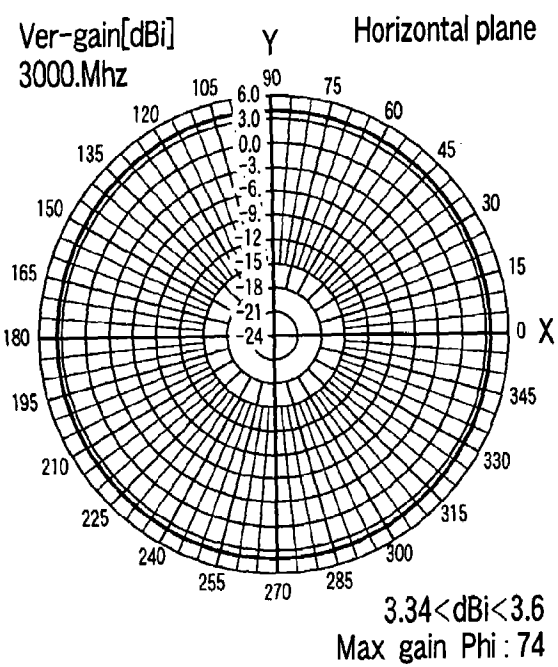
Figure 44C:
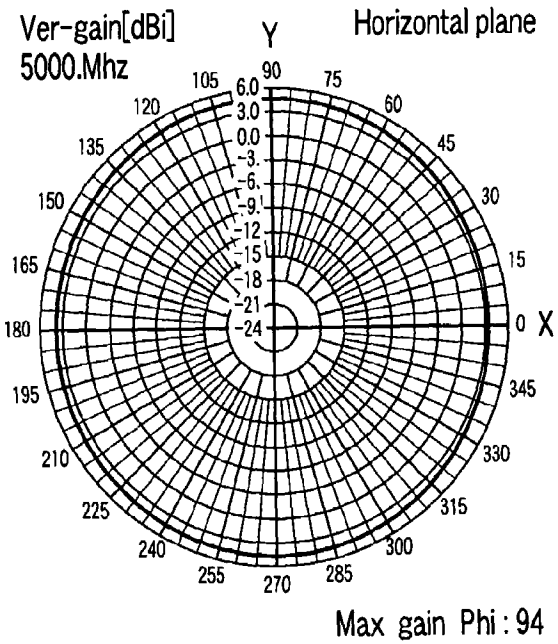
Figure 44D:
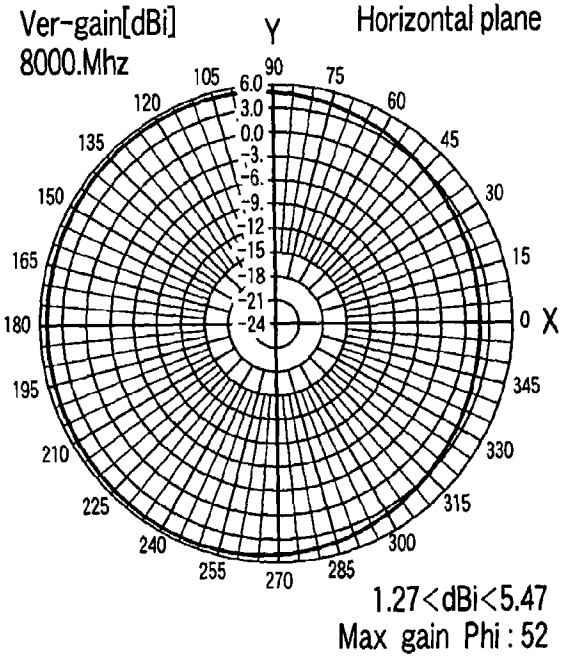
Figures 44E, 44F, 44G:
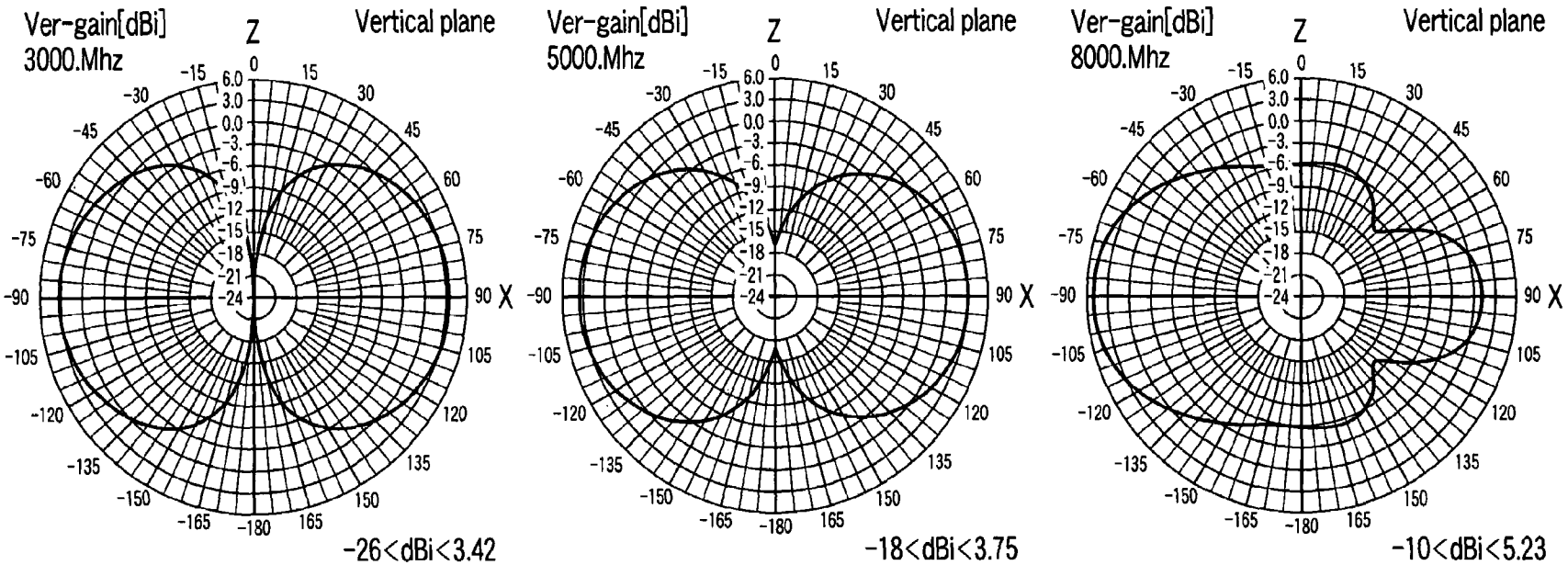

FIG. 43 is the Smith chart with respect to the antenna 1100. FIGS. 44A–44G are the illustrations showing radiation patterns of the antenna 1100. FIGS. 44B–44D show radiation patterns on an XY plane of a coordinate system shown in FIG. 44A, and FIGS. 44E–44G show radiation patterns on an XZ plane of the coordinate system shown in FIG. 44A. Moreover, FIG. 44B and FIG. 44E show radiation patterns at 3 GHz, FIG. 44C and FIG. 44F show radiation patterns at 5 GHz, and FIG. 44D and FIG. 44G show radiation patterns at 8 GHz.

As known from these FIG. 43 and FIGS. 44A–44G, the antenna 1100 can obtain radiation patterns excellent in balance in the whole range of the transmittable/receivable band. Although the balance of the radiation patterns in a high-frequency range is disturbed, the disturbance is of such a level as is no practical problem.

The element 31 has sides 31*a* and 31*c* approximately parallel to each other. Thereby, the width of the element 31 in a direction orthogonally intersection to the sides 31*a*, 31*b* can be suppressed to a minimum width to form the notch 34 satisfying the condition described above. Whereby, the antenna 1100 can be downsized.

For example, the antenna 1100 can reduce its width in the direction described above to be half as wide as the antenna 100. The antenna 1100 has advantages as follows in mounting on a communication terminal.

For example, the antennas 100, 1100 are sometimes housed in a housing of the communication terminal together with a liquid crystal display. At this time, as shown FIGS. 45A, 45B, a metal frame 28*a* to support the liquid crystal display is mounted on a housing 28. The antennas 100, 1100 are disposed inside the housing 28 so as to get off the metal frame 28*a*.

Figure 45A:
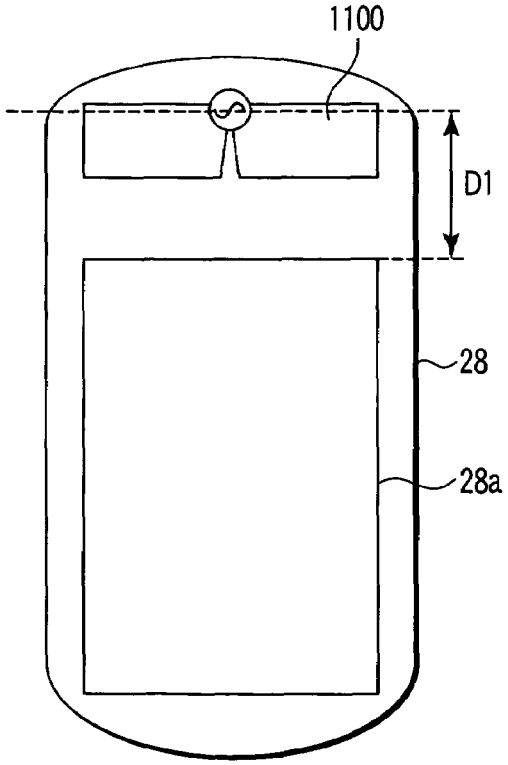
FIGS. 45A, 45B are illustrations explaining advantages of the antenna shown in FIG. 39.
Figure 45B:
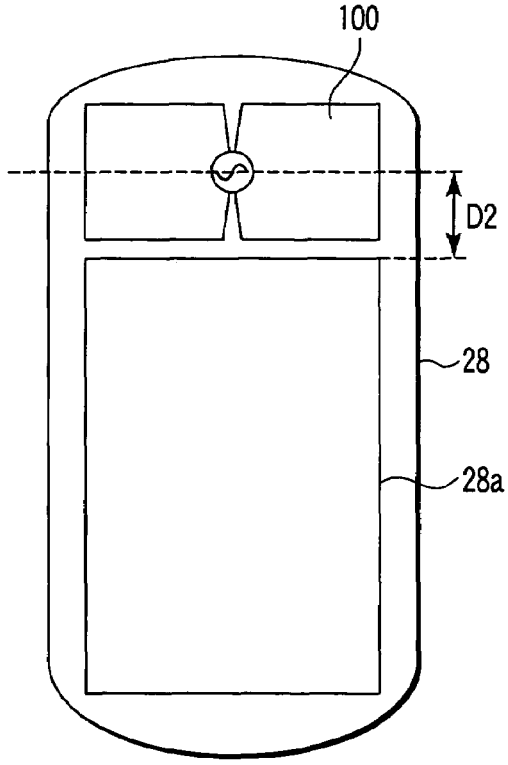

In this case, as clarified by FIGS. 45A, 45B, it is possible to make a distance D1 from a power feeding point up to the metal frame 28*a* of the antenna 1100 longer than a distance D2 from the power feeding point up to the metal frame 28*a* of the antenna 100. Thereby, the antenna 1100 can suppress electromagnetic field coupling by the metal frame 28*a* in comparison with the antenna 100 and reduce disturbance of radiation characteristics.

On the other hand, the housing 28 also houses a circuit board. Preferably components to be mounted on the circuit board are arranged apart from a wideband antenna in some case.

Figure 46B:
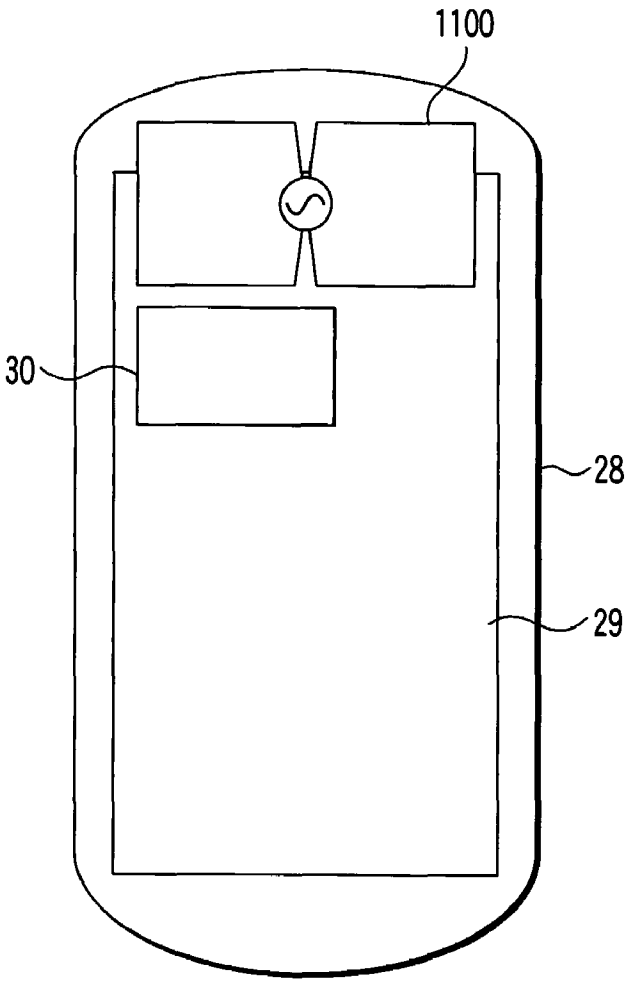
FIGS. 46A, 46B are illustrations explaining advantages of the antenna shown in FIG. 39.
Figure 46A:
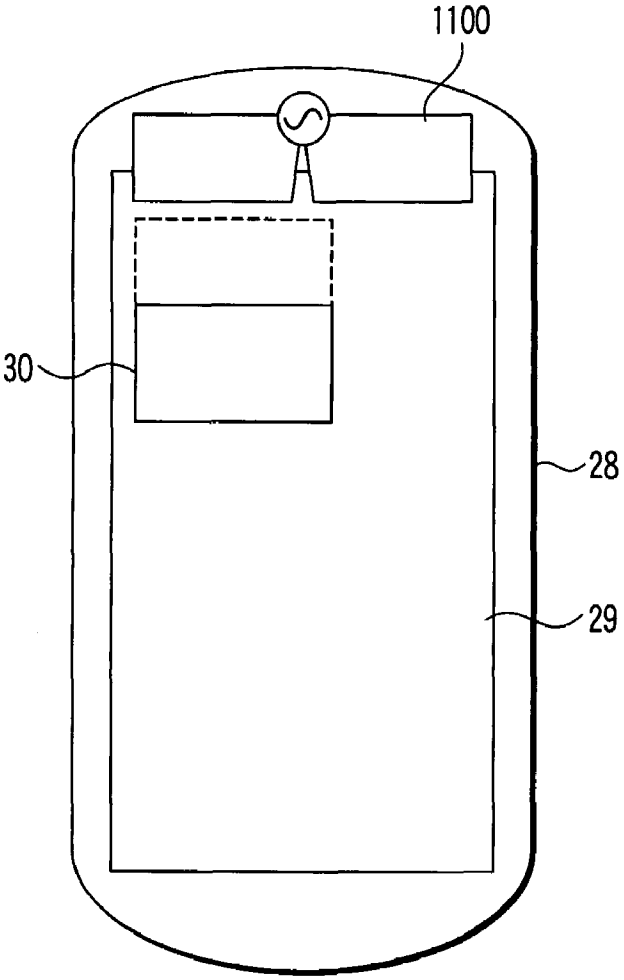

In this case, as clarified by FIGS. 46A, 46B, the antenna 1100, rather than the antenna 100, is arranged apart from a component 30 mounted on a circuit board 29. Since the space in which a component can be mounted apart from the antenna 1100 becomes large resulting from the use of the antenna 1100, the antenna 1100 allows a further large-sized component shown by a dot line to be mounted instead of the component 30, or allows an another component to be mounted between the antenna 1100 and the component 30. That is, the use of the antenna 1100 improves the flexibility in arranging the component.

Since each side of the elements 31, 32 of the antenna 1100 formed in a straight line shape, the antenna 1100 becomes easy to be manufactured in comparison with the structure of a wideband antenna described in U.S. Pat. No. 4,843,403.

The power feeding point of the antenna 1100 is positioned at the end thereof. Whereby, a signal wire, etc., to feed power to the feeding point is easily positioned. The mounting of the antenna 1100 on a communication apparatus allows the feeding point not to overlap on other device such as a display while overlapping and disposing most of the antenna 1100 with the other device.

(Eleventh Embodiment)

Figure 47:
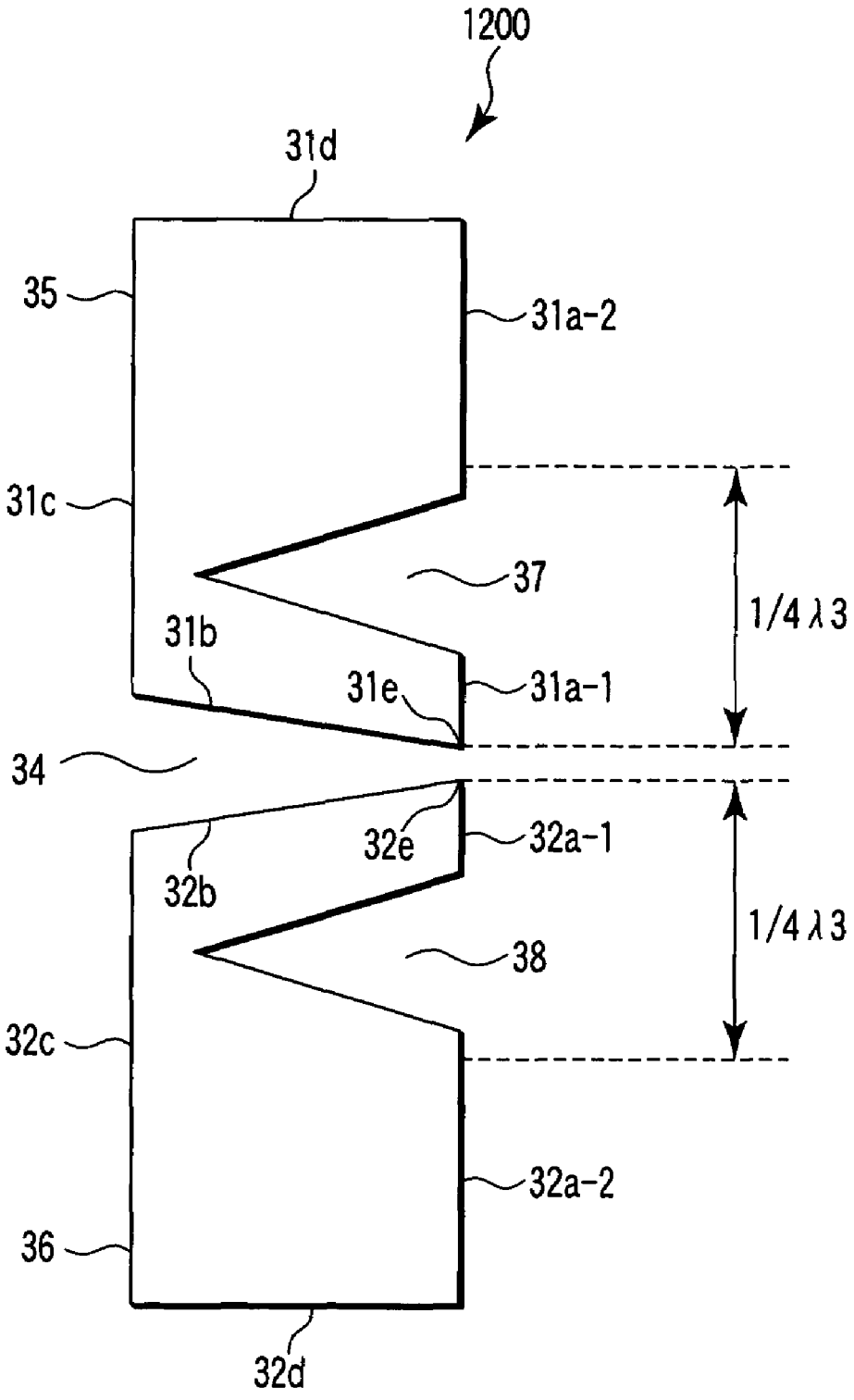
FIG. 47 is an illustration showing a structure of a wideband antenna regarding a eleventh embodiment of the invention.

FIG. 47 is the illustration showing the structure of the wideband antenna 1200 regarding the eleventh embodiment of the invention. The same parts as those of FIG. 39 are referred to the same reference numerals, and detailed explanation thereof will be omitted.

As shown in FIG. 47, the antenna 1200 comprises a conductive element 35 and a conductive element 36. These elements 35, 36 are mounted on a dielectric substrate however, the substrate is not shown.

The elements 35, 36 are thin plates made of conductive material. The element 35 has a basic shape of the element 31 of the tenth embodiment. The element 35 forms a notch 37 so as to divide the side 31*a* of the element 31 into two of a side 31*a*-1 and a side 31*a*-2. The element 36 has a basic shape of the element 32 of the tenth embodiment. The element 36 forms a notch 38 so as to divide the side 32*a* of the element 32 into two of a side 32*a*-1 and a side 32*a*-2. Positions to form the notches 37, 38 are within a rage of $\lambda 3 \times 1/4$ from the tops 31*e*, 32*e*. Here, $\lambda 3$ indicates a wavelength at an upper limit frequency in the required frequency band. The shapes of the notches 37, 38 may be determined arbitrarily.

Figure 48B:
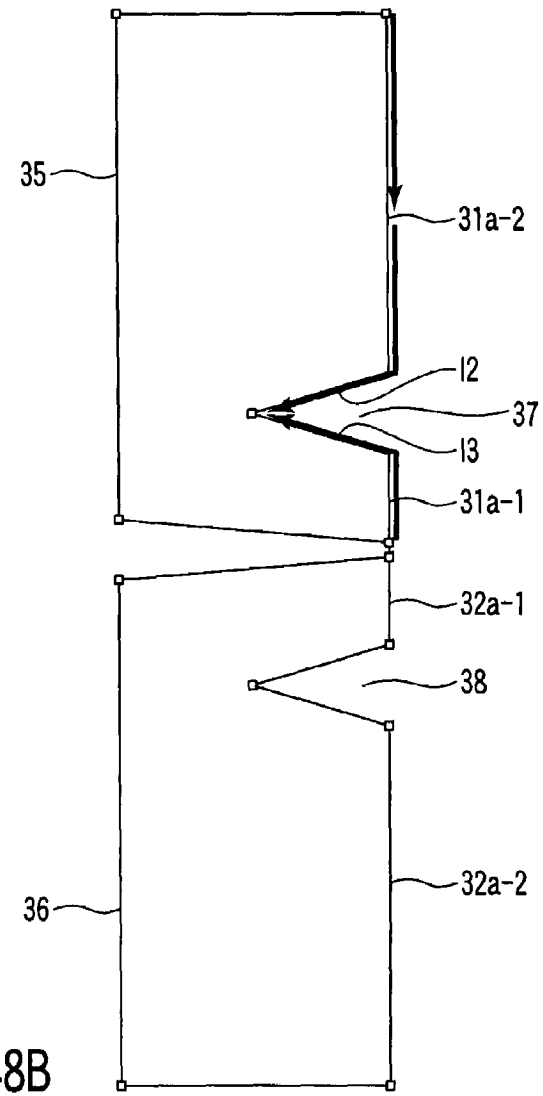
FIGS. 48A, 48B are illustrations explaining functions of notches shown in FIG. 47.
Figure 48A:
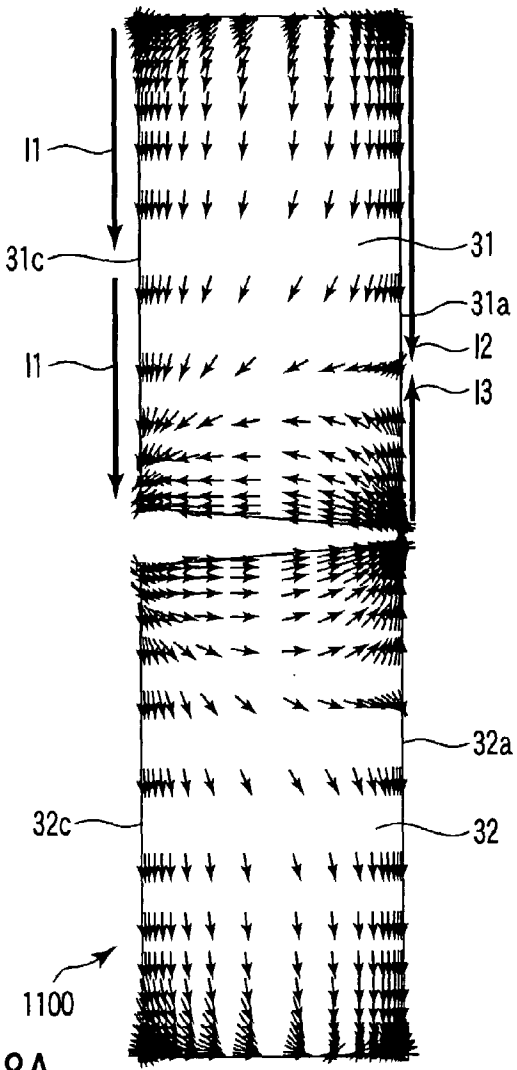

FIGS. 48A, 48B are illustrations explaining functions of the notches 37, 38.

FIG. 48A shows a current distribution of the upper limit frequency in the antenna 1100 of the tenth embodiment. Currents through the peripheral edges of the elements 31, 32 contribute on a large scale. Through the side 31*c* of the element 31, a current I1 flows in approximately one direction over the whole of the side 31*c*. Although through the side 31*a*, a current I2 with the same phase as that of the current I1 flows on a side apart from the top 31*e*, a current I3 with inverted phase to the current I1, I2 flows on a side near the top 31*e*. Radiation toward the side 31*a* of the antenna 100 is reduced due to the influence of the inverted current I3. This phenomenon symmetrically occurs in the element 32 and reduces the radiation toward the side of the side 32*a*.

As shown in FIG. 48B, in the element 35 of the antenna 1200, the direction of the current I3 through the notch 37 varies and vertical components (vertical components in FIGS. 48A, 48B) of the current I3 decrease. Thus, current components inverted to the current I2 decrease and the current I2 efficiently generates radiation. That is, the radiation toward sides of the sides 31*a*-1 and 31*a*-2 increases in comparison with that of the antenna 1100. The radiation from the element 36 toward sides of the sides 32*a*-1 and 32*a*-2 similarly increases in comparison with that of the antenna 1100.

FIGS. 49A to 49F are illustrations showing degree of improvements of radiation patterns from the antenna 1200.

Figure 49A:
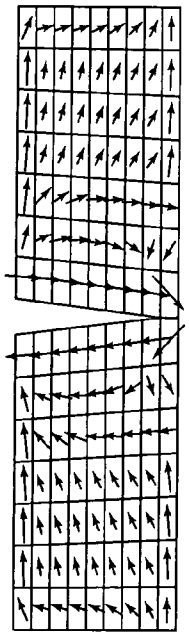
FIGS. 49A–49F are illustrations showing degrees of improvements of radiation patterns by the antenna shown in FIG. 47.
Figure 49B:
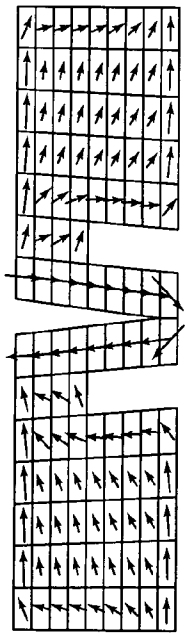
Figure 49C:
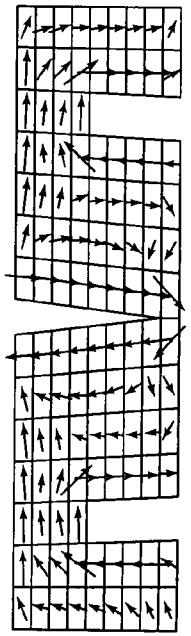
Figure 49D:
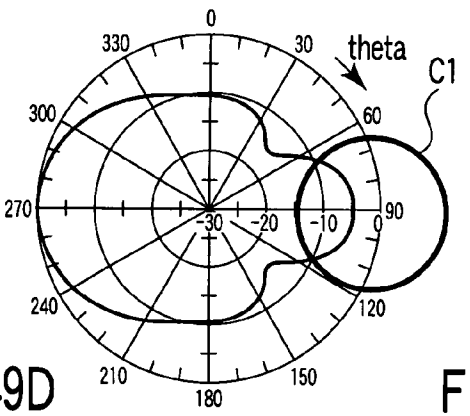
Figure 49E:
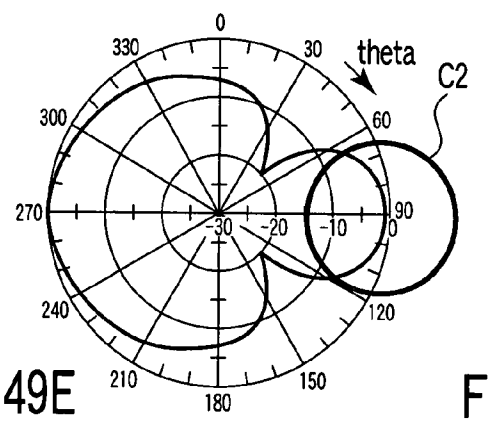
Figure 49F:
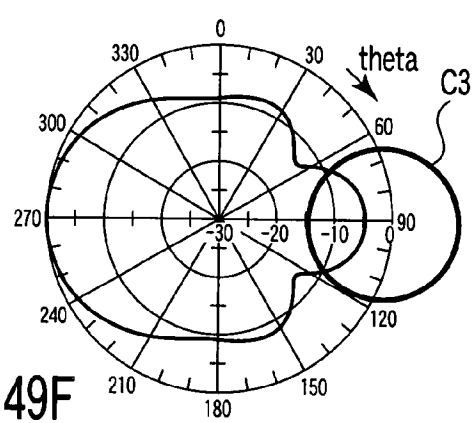

By a simulation destined to a model shown in FIGS. 49A–49C, the characteristics shown in FIGS. 49D–49F are obtained. FIG. 49A, FIG. 49B and FIG. 49C show the respective models respectively simulating the antenna 1100, the antenna 1200 and a wideband antenna in which positions of the notches 37, 38 of the antenna 1200 are changed. The wideband antenna simulated by the model in FIG. 49C forms notches outside the range λ3×¼ from the tops 31*e*, 32*e*.

As clarified in comparison with each FIG. 49D–49F, the radiation patterns of the antenna 1200 show the best balance. In particular, the radiation characteristics of the antenna 1200 are more improved at the part surrounded with circle C2 than at the parts surrounded with circles C1 and C3.

The reason why the model in FIG. 49C does not improve the radiation pattern results from incompletion of the actions described above though the notch has been formed outside the range λ3×¼ from the tops 31*e*, 32*e* due to the fact that the current I3 is mainly generated within the range.

Figure 50:
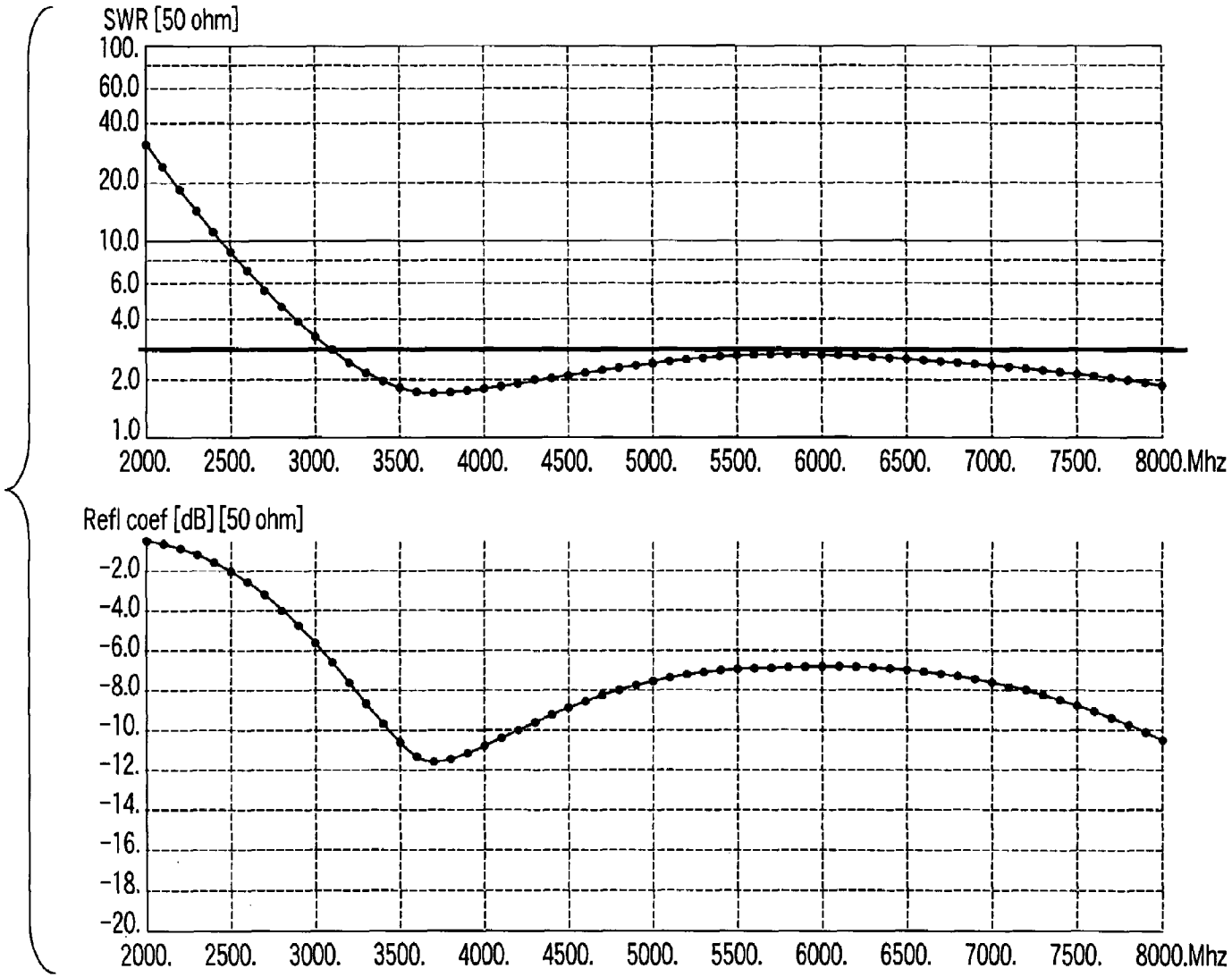
FIG. 50 is an illustration showing characteristics of VSWR and reflection coefficient of the antenna shown in FIG. 47.
Figure 51:
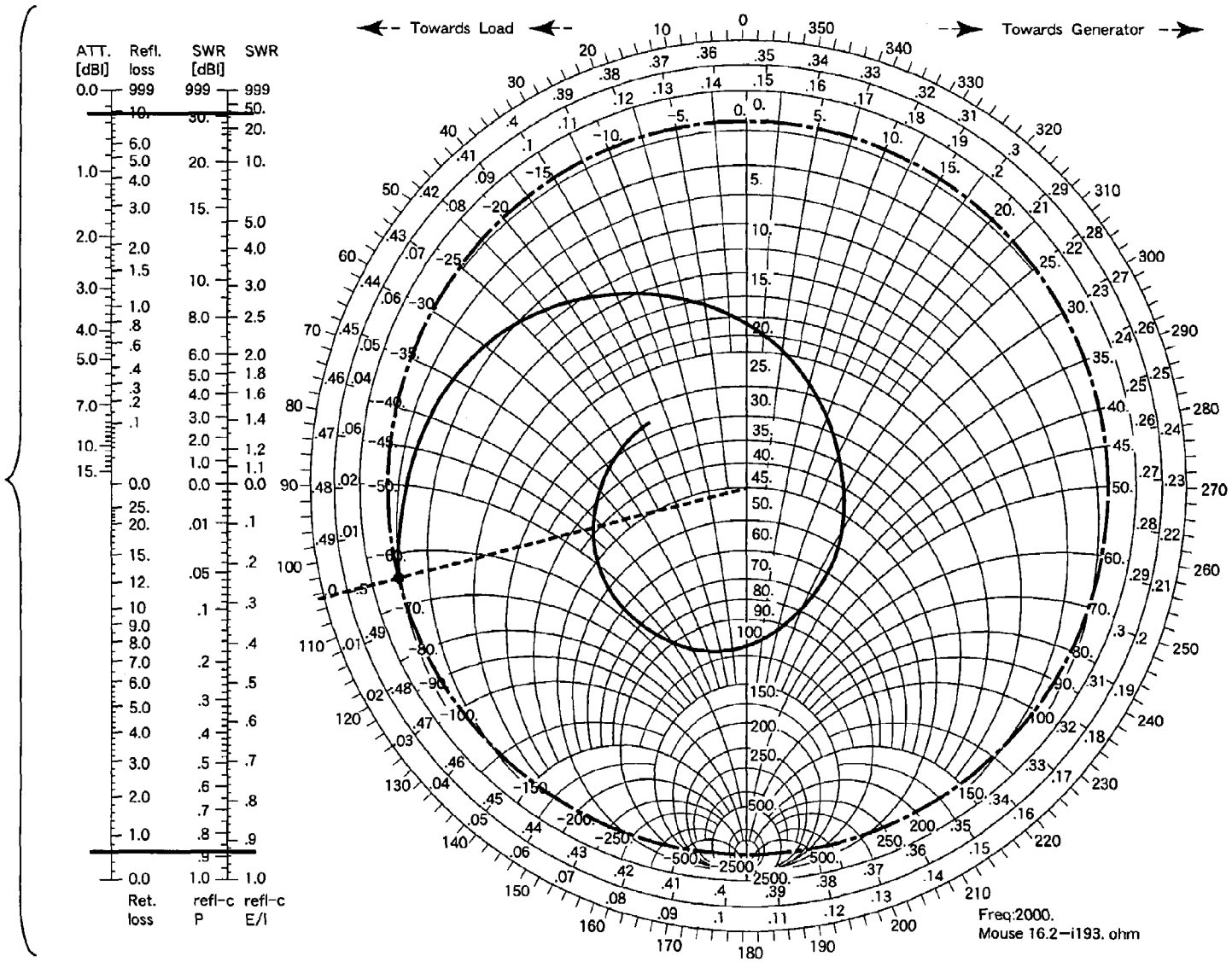
FIG. 51 is a Smith chart with respect to the antenna 1200 shown in FIG. 47.
Figure 52A:
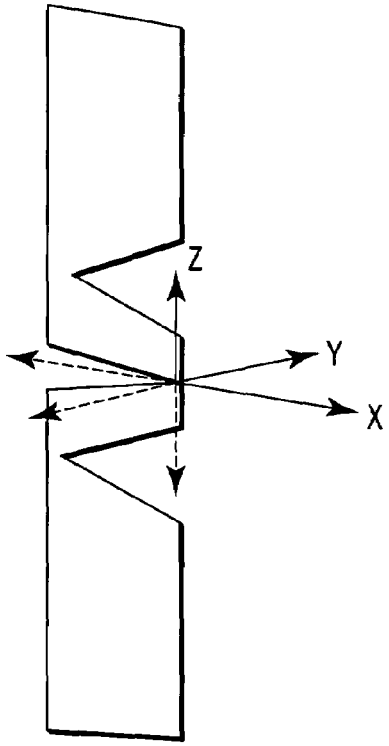
FIGS. 52A–52G are illustrations showing radiation patterns of the antenna shown in FIG. 47.
Figures 52B, 52C, 52D:
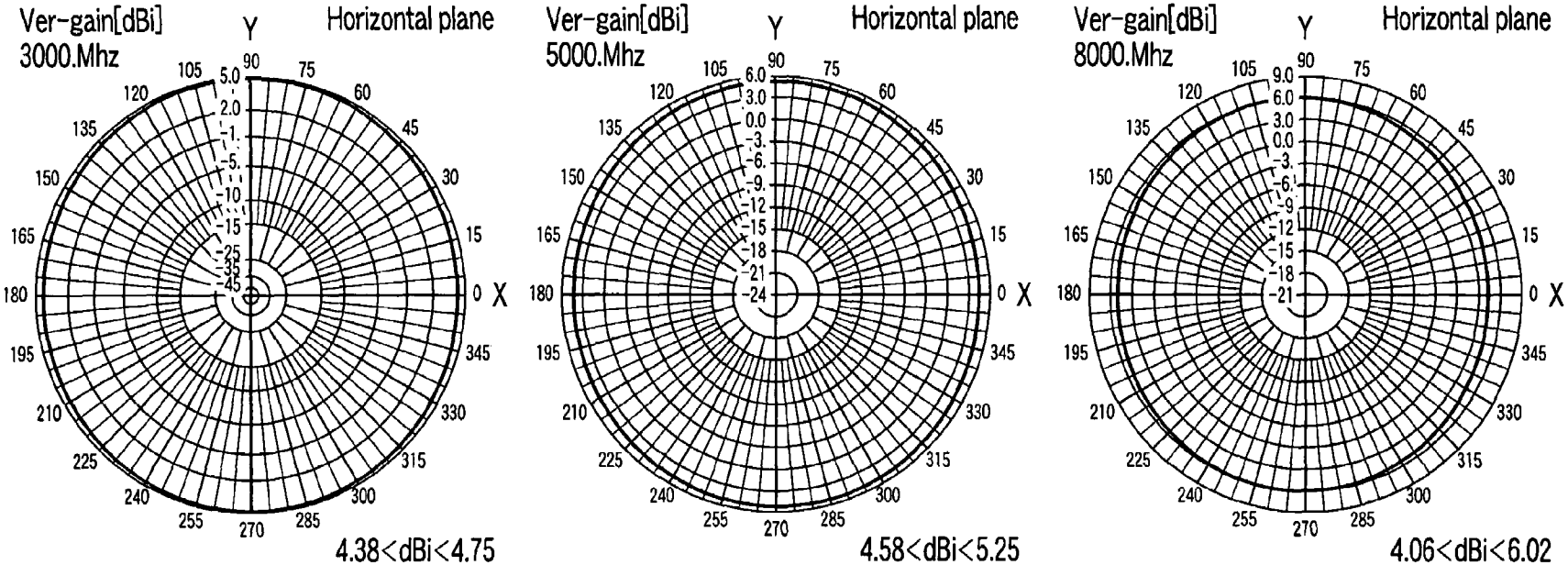
Figures 52E, 52F, 52G:
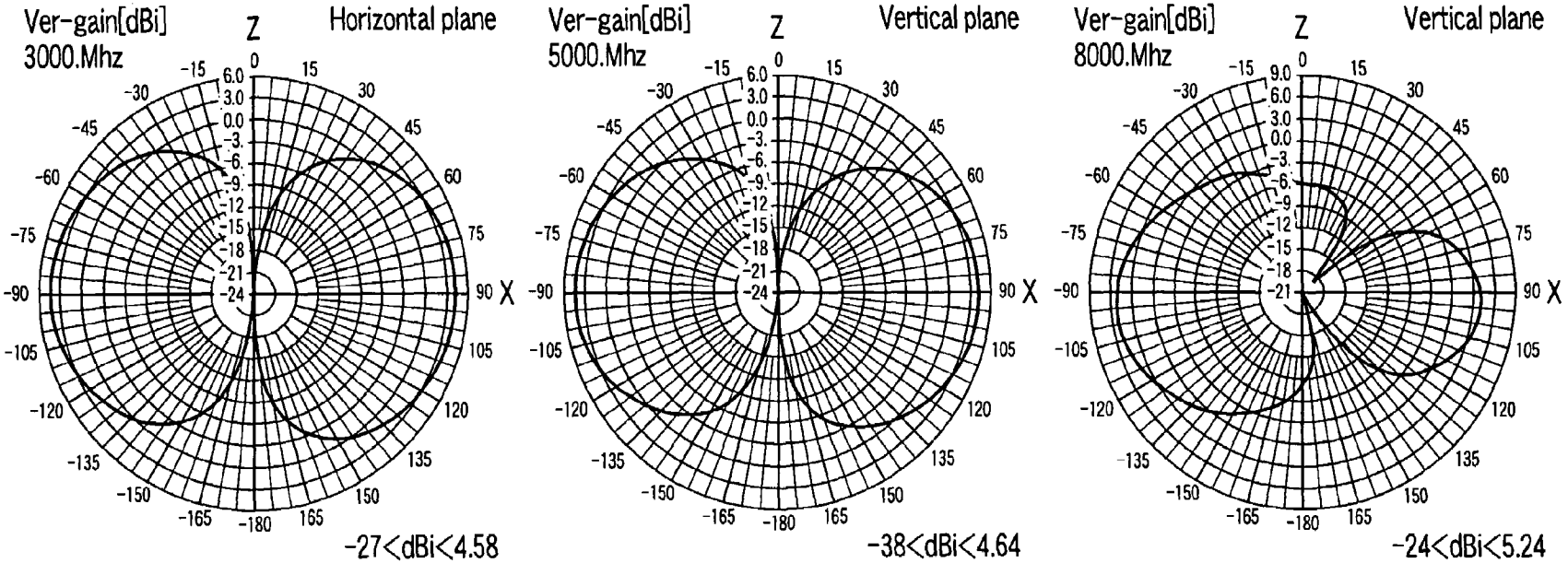

FIG. 50 is the illustration showing the characteristics of the VSWR and the reflection coefficient of the antenna 1200. FIG. 51 is the Smith chart with respect to the antenna 1200. FIGS. 52A to 52G are the illustrations showing radiation patterns of the antenna 1200. FIGS. 52B to 52D show radiation patterns on an XY plane of a coordinate system shown in FIG. 52A, and FIGS. 52E to 52G show radiation patterns on an XZ plane of the coordinate system shown in FIG. 52A. Moreover, FIG. 52B and FIG. 52E show radiation patterns at 3 GHz, FIG. 52C and FIG. 52F show radiation patterns at 5 GHz, and FIG. 52D and FIG. 52G show radiation patterns at 8 GHz.

As known from these FIG. 50 to FIG. 52, the antenna 1200 can obtain radiation patterns further excellent in balance in the whole range of the wide transmittable/receivable band by being provided with the notches 37, 38.

(Twelfth Embodiment)

Figure 53:
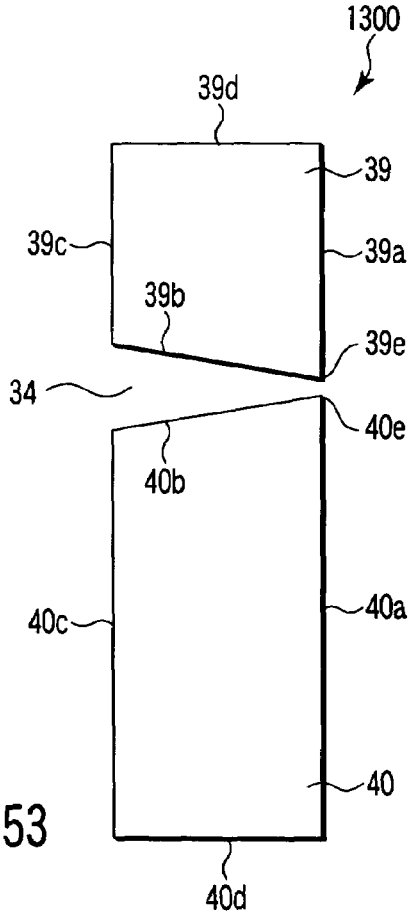
FIG. 53 is an illustration showing a structure of a wideband antenna regarding a twelfth embodiment of the invention.

FIG. 53 is the illustration showing the structure of the wideband antenna 1300 regarding the twelfth embodiment in the invention. The same parts as those of FIG. 39 are referred to by the same reference numerals and detailed explanation thereof will be omitted.

As shown in FIG. 53, the antenna 1300 comprises a conductive element 39 and a conductive element 40. These elements 39, 40 are mounted on a dielectric substrate however, the substrate is not shown.

The elements 39, 40 are thin plates made of conductive material. Each element 39, 40 are shaped as a trapezoid in which only one side is inclined. The elements 39, 40 are approximately symmetric in shape with each other.

As shown in FIG. 53, four sides of the element 39 are referred to as sides 39*a*, 39*b*, 39*c* and 39*d*. The side 39*b* is the inclined side as described above. The sides 39*a*, 39*c* contact opposed ends of the side 39*b*. The sides 39*a*, 39*c* are approximately parallel to each other. A top 39*e* is formed at a section with which the sides 39*a*, 39*b* are contacted. The opposed sides of the side 39*d* contact the sides 39*a* and 39*c*.

As shown in FIG. 53, four sides of the element 40 are referred to as sides 40*a*, 40*b*, 40*c* and 40*d*. The sides 40*a*, 40*c* contact opposed ends of the side 40*b*. The sides 40*a*, 40*c* are approximately parallel to each other. A top 40*e* is formed at a section with which the sides 40*a*, 40*b* are contacted. The opposed ends of the side 40*d* contact the sides 40*a* and 40*c*.

The elements 39, 40 are mounted on the dielectric substrate in a state that the tops 39*e*, 40*e* are opposed to each other. A small gap is provided between the tops 39*e* and the 40*e*. The sides 39*a*, 40*a* and the sides 39*c*, 40*c* are respectively positioned on the respective same straight line.

By such arrangements of the elements 39, 40 described above, the notch 34 is formed between the elements 39 and 40.

Sizes of the elements 39, 40 are determined in consideration of the required frequency band. That is, a length from an end of the side 39*c* up to an end of the side 40*c* along with the sides 39*c*, 39*b*, 40*b* and 40*c* is defined in the same manner for the length L11 of the antenna 100. A length from an end of the side 39*b* up to an end of the side 40*b* along with the sides 39*b*, 40*b* is defined in the same manner for the length L12 of the antenna 1100.

The antenna 1300 structured as described above, determines a point between a section near the top 39*e* and a section near the top 39*e* as a power feeding point.

Figure 54:
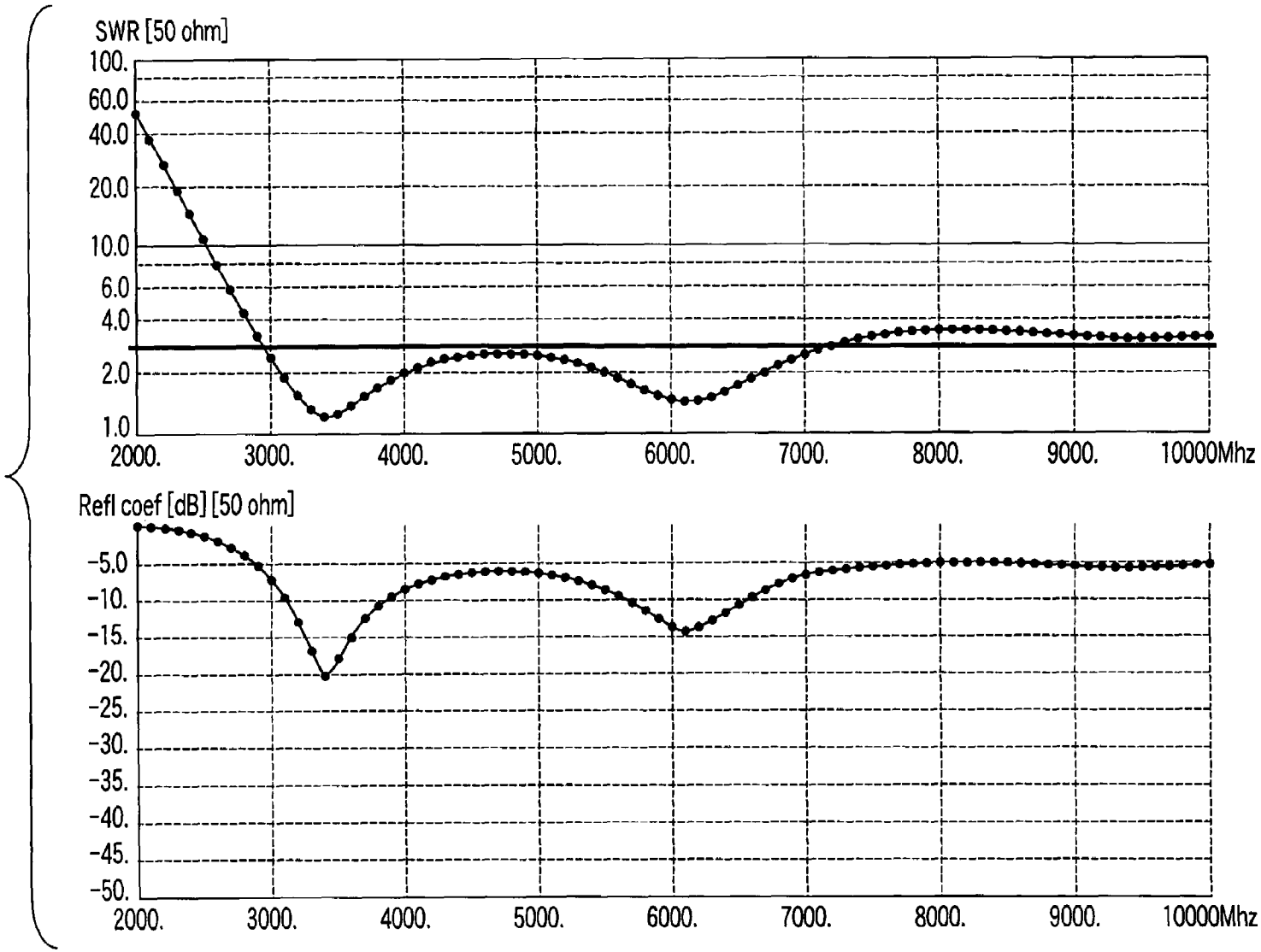
FIG. 54 is an illustration showing characteristics of VSWR and reflection coefficient of the antenna shown in FIG. 53.
Figure 55:
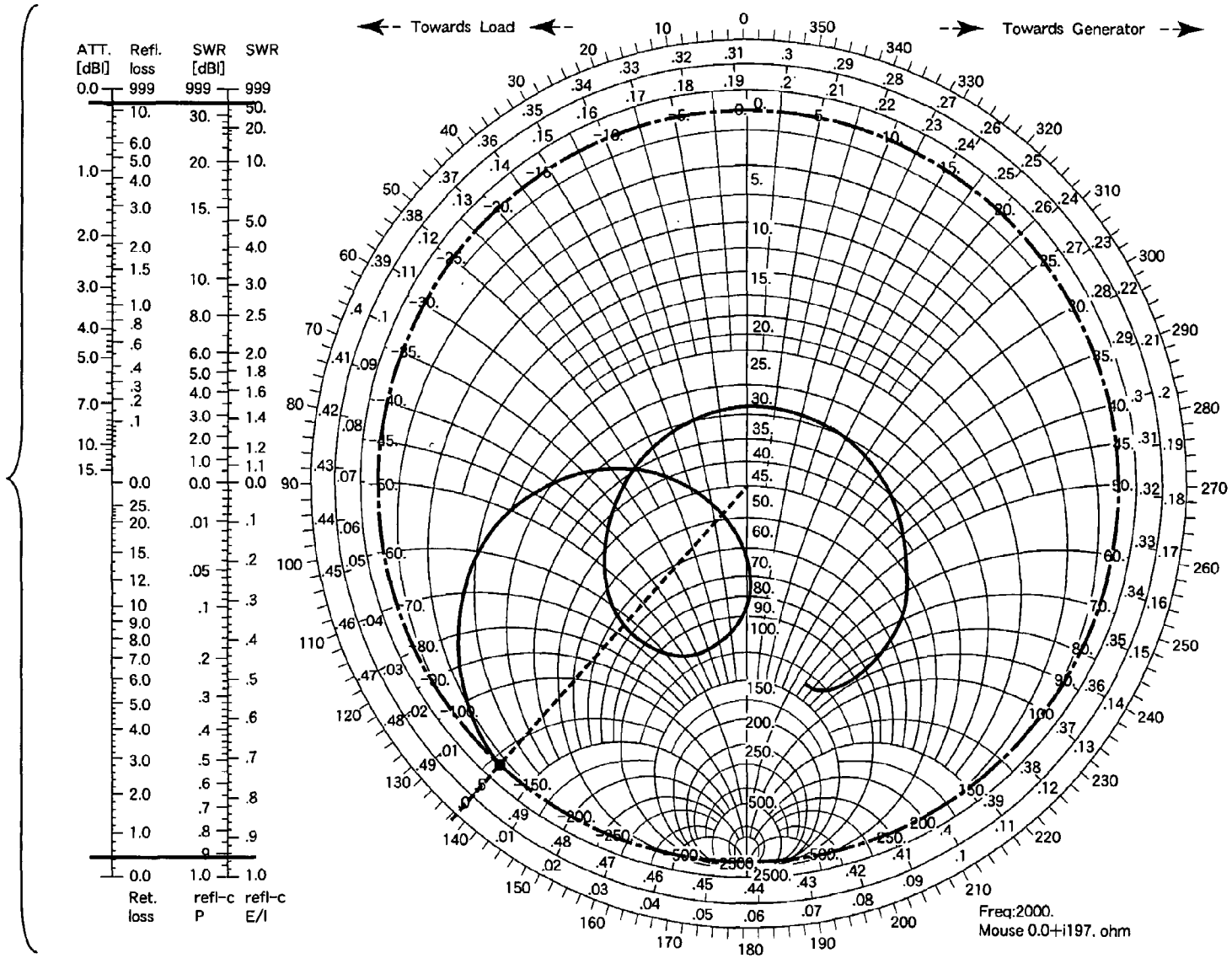
FIG. 55 is a Smith chart with respect to the antenna shown in FIG. 53.

FIG. 54 is the illustration showing the characteristics of the VSWR and the reflection coefficient of the antenna 1300. FIG. 55 is the Smith chart with respect to the antenna 1300.

As known from these FIG. 54 and FIG. 55, also the antenna 1300 as well as the antenna 1100 can obtain a wide transmittable/receivable band by the combination of two resonant frequencies in the same manner as that of the antenna 1100.

Moreover, the antenna 1300 can be easily shaped in response to a housing space of a communication apparatus, etc.

(Thirteenth Embodiment)

Figure 56:
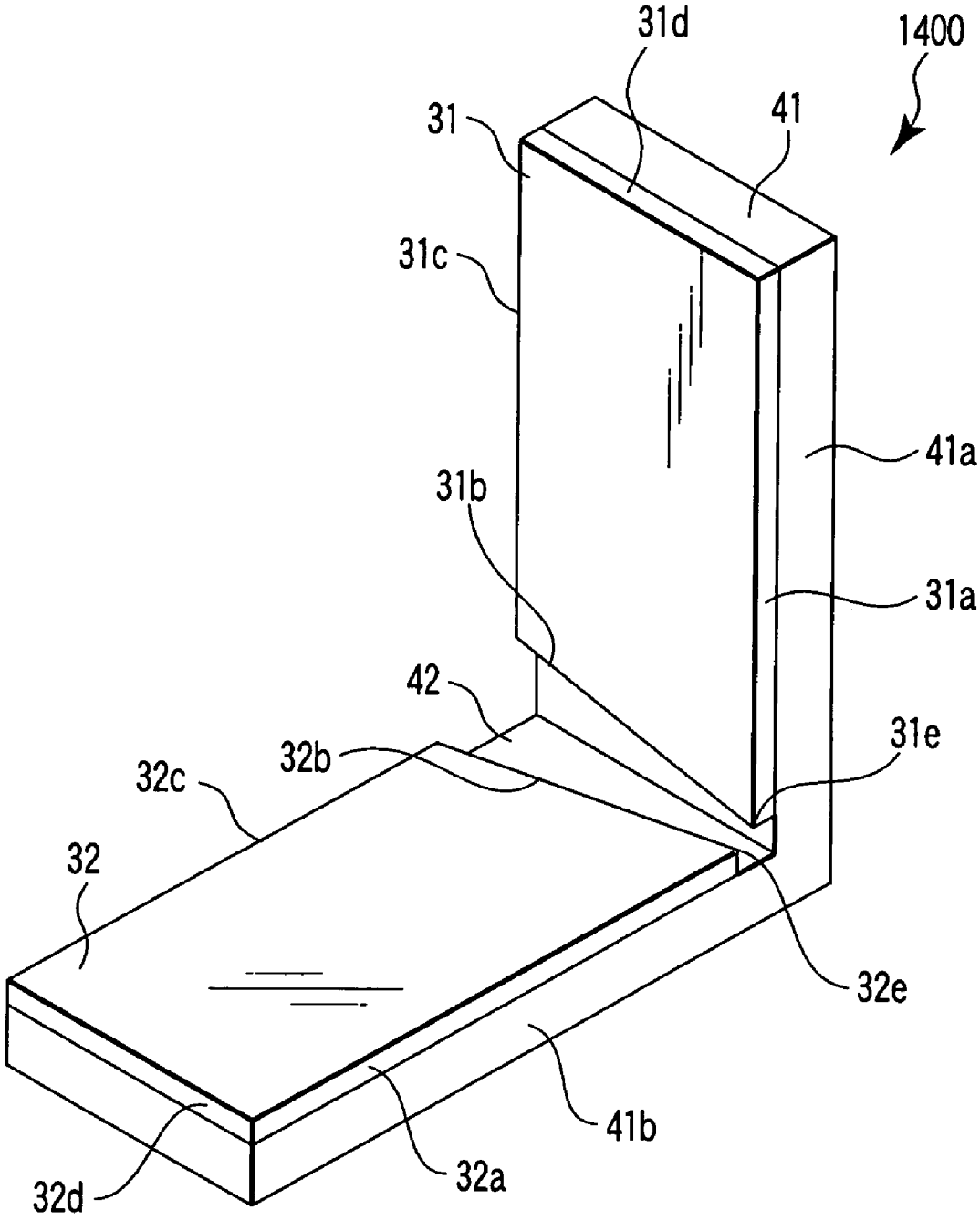
FIG. 56 is a perspective view showing a structure of a wideband antenna regarding a thirteenth embodiment of the invention.

FIG. 56 is the perspective view showing the structure of the wideband antenna 1400 regarding the thirteenth embodiment of the invention. In FIG. 56, the same parts as those of the FIG. 39 are referred to the same reference numerals and detailed explanation thereof will be omitted.

As shown in FIG. 56, the antenna 1400 comprises the conductive elements 31, 32 and a dielectric substrate 41.

The substrate 41 is shaped so that the dielectric substrate 33 is squarely bent at its center section. Hereinafter, two parts of the substrate 41 different in direction are referred to as a vertical section 41*a* and a horizontal section 41*b*, respectively.

The elements 31, 32 are attached to the vertical section 41*a* and the horizontal section 41*b* of the substrate 41, respectively, in a state that the top 31*e* and the top 32*e* are opposite to each other. A small gap is provided between the top 31*e* and the top 32*e*. The sides 31*a* and 32*a* are respectively positioned on two straight lines intersecting orthogonally with each other and the sides 31*c* and 32*c* are respectively positioned on another two straight lines intersecting orthogonally with each other.

By such arrangements of the elements 31, 32, a notch 42 is formed between the side 31*b* and the side 32*b* and also between the elements 31 and 32. The width of the notch 42 becomes narrowest between the tops 31*e* and 32*e* and becomes gradually wider with getting apart from the tops 31*e*, 32*e*.

Even in the antenna 1400 with the structure described above, resonant points are defined in the same manner as that of the antenna 1100.

Figure 57:
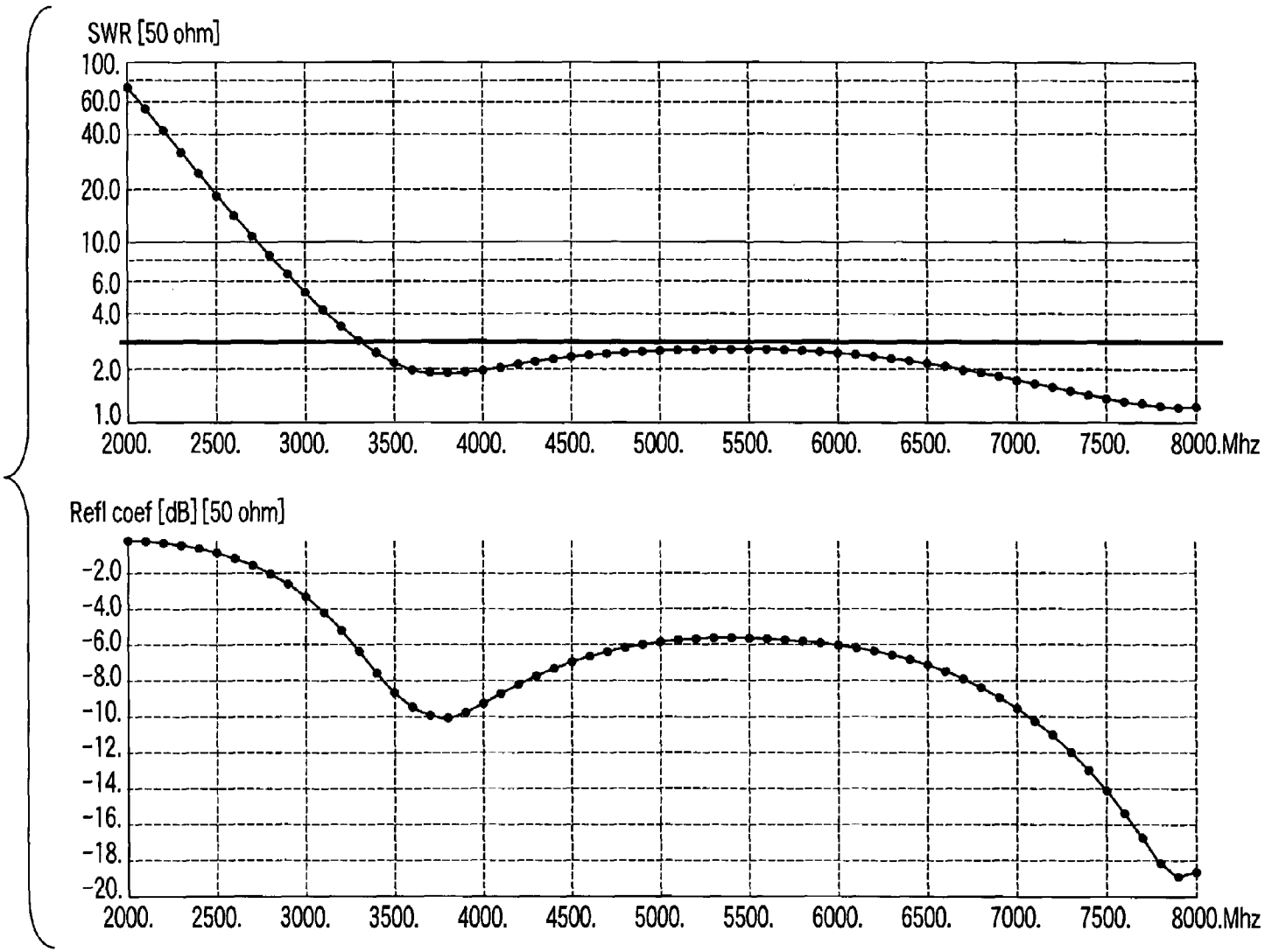
FIG. 57 is an illustration showing characteristics of VSWR and reflection coefficient of the antenna shown in FIG. 56.
Figure 58:
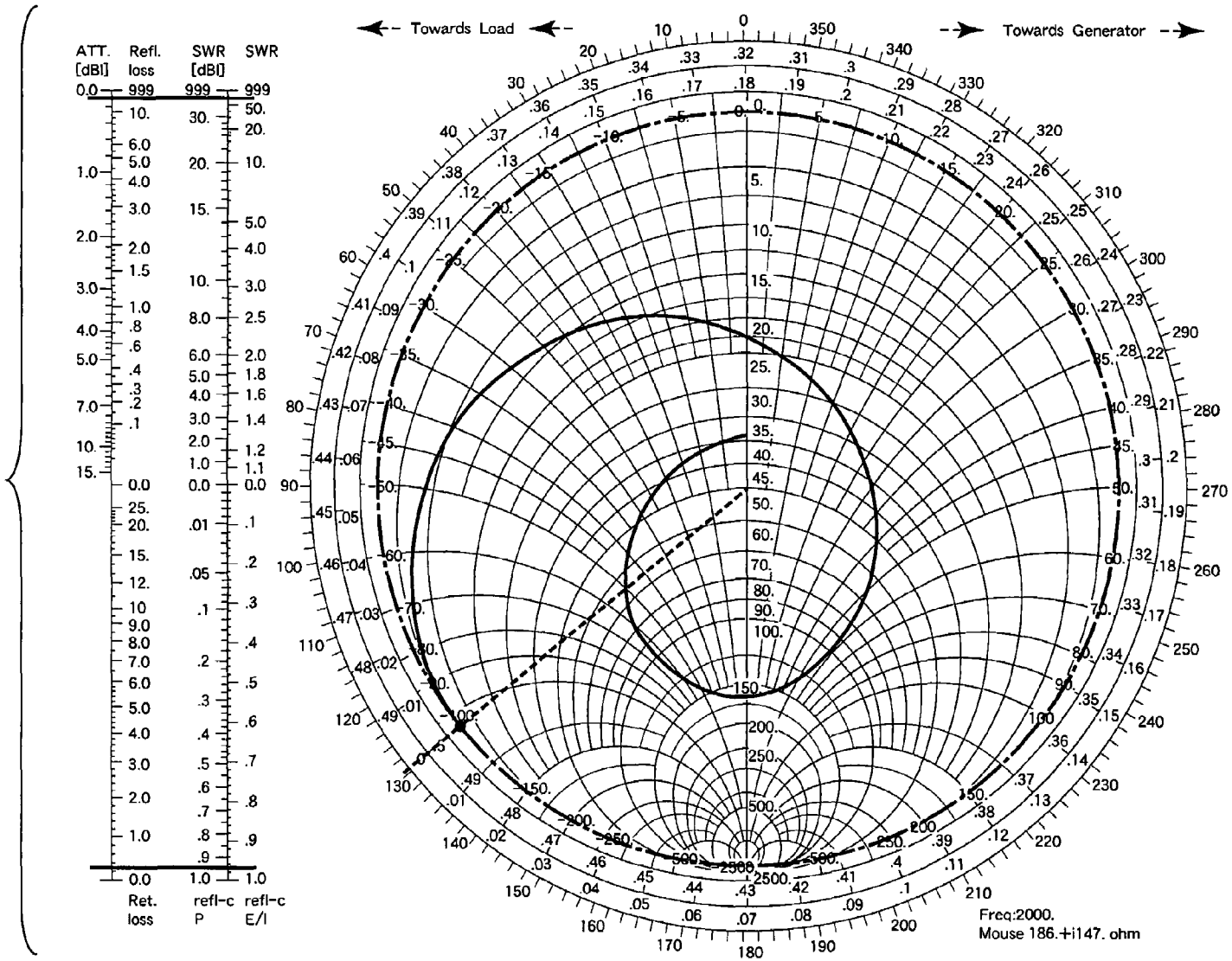
FIG. 58 is a Smith chart with respect to the antenna shown in FIG. 56.
Figure 59A:
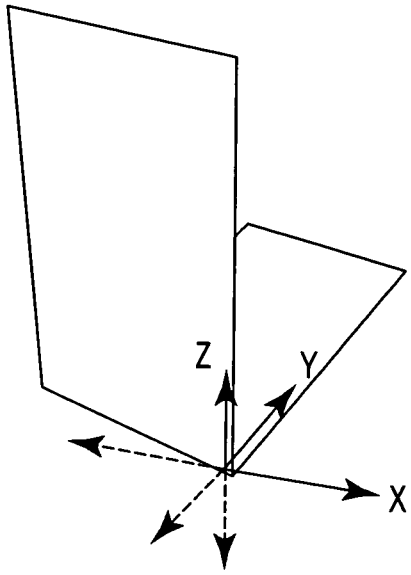
FIGS. 59A–59G are illustrations showing radiation patterns of the antenna shown in FIG. 56.

FIG. 57 is the illustration showing the characteristics of the VSWR and the reflection coefficient of the antenna 1400. FIG. 58 is the Smith chart with respect to the antenna 1400.

As is known from FIGS. 57, 58, also the antenna 1400 as well as the antenna 1100 can offers a wide transmittable/receivable band by a combination of two resonant frequencies.

Figure 59B:
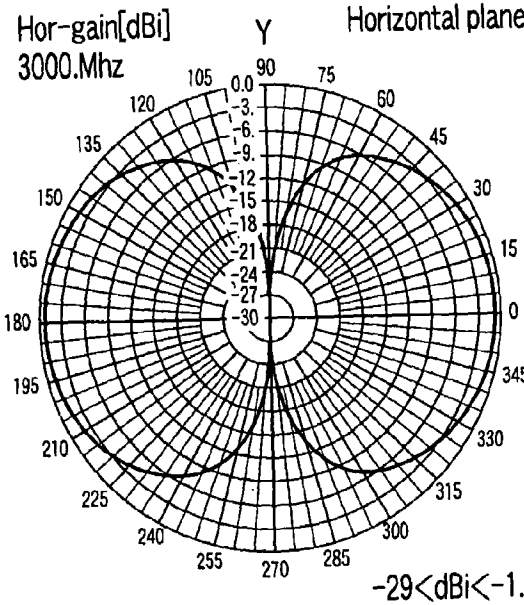
Figure 59C:
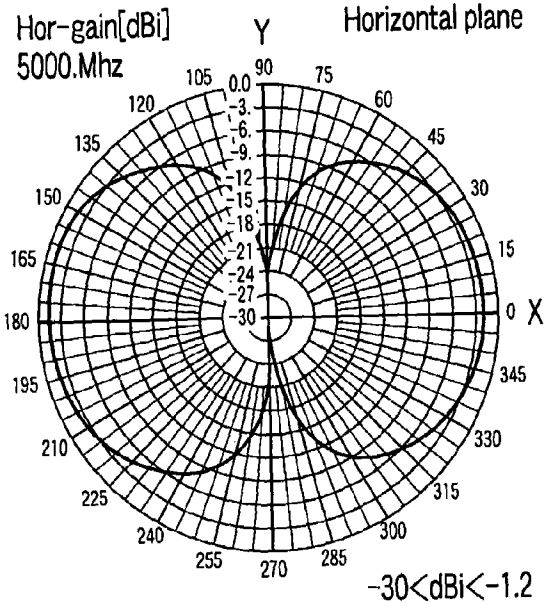
Figure 59D:
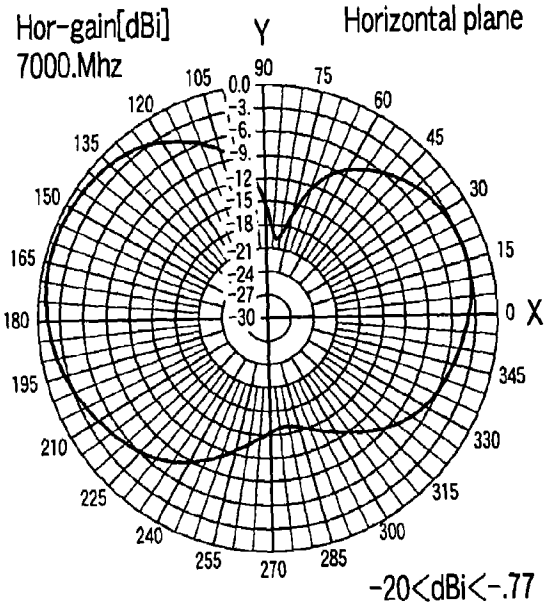
Figures 59E, 59F, 59G:
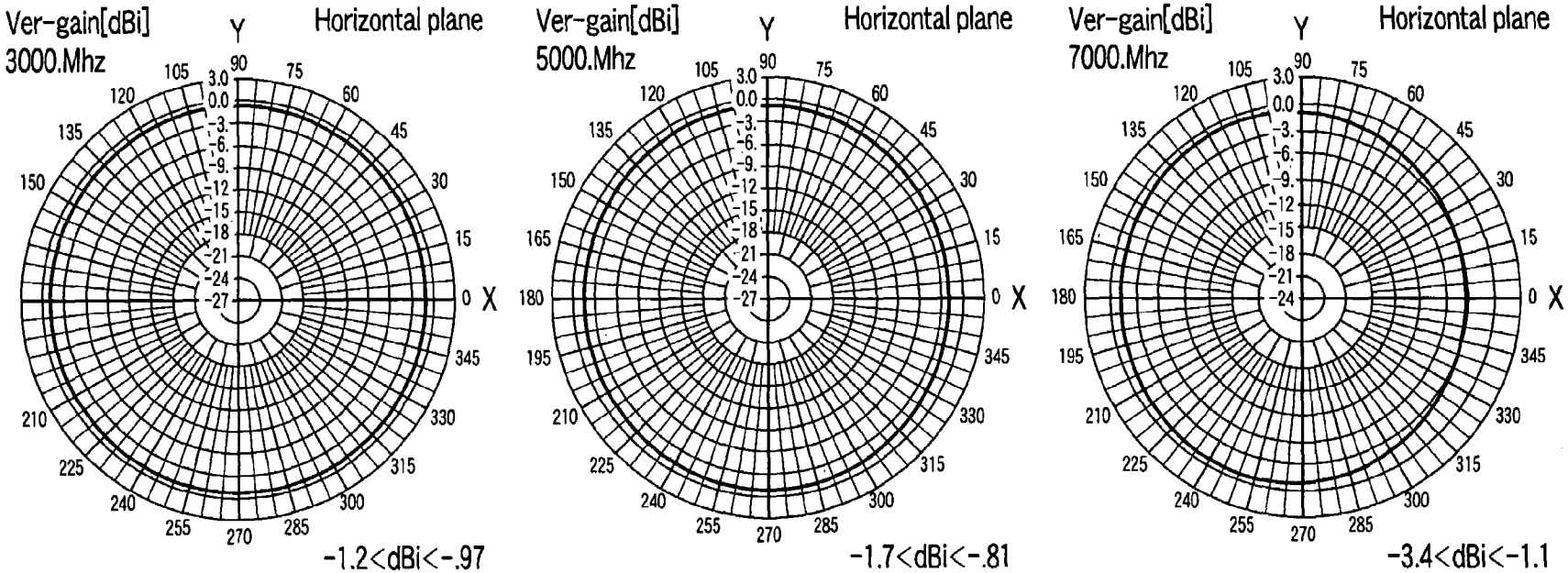

FIGS. 59A to 59G are illustrations showing radiation patterns of the antenna 1400. FIGS. 59B–59D show horizontally polarized waves on an XY plane of a coordinate system shown in FIG. 59A, and FIGS. 59E–59G show vertically polarized waves on the XY plane of the coordinate system shown in FIG. 59A. Moreover, FIG. 59B and FIG. 59E show a radiation pattern at 3 GHz, FIG. 59C and FIG. 59F show a radiation pattern at 5 GHz, and FIG. 59D and FIG. 59G show a radiation pattern at 7 GHZ.

As known from these FIGS. 59A to 59G, the antenna 1400 has excellent radiation patterns in both horizontally and vertically polarized waves.

(Fourteenth Embodiment)

Figure 60:
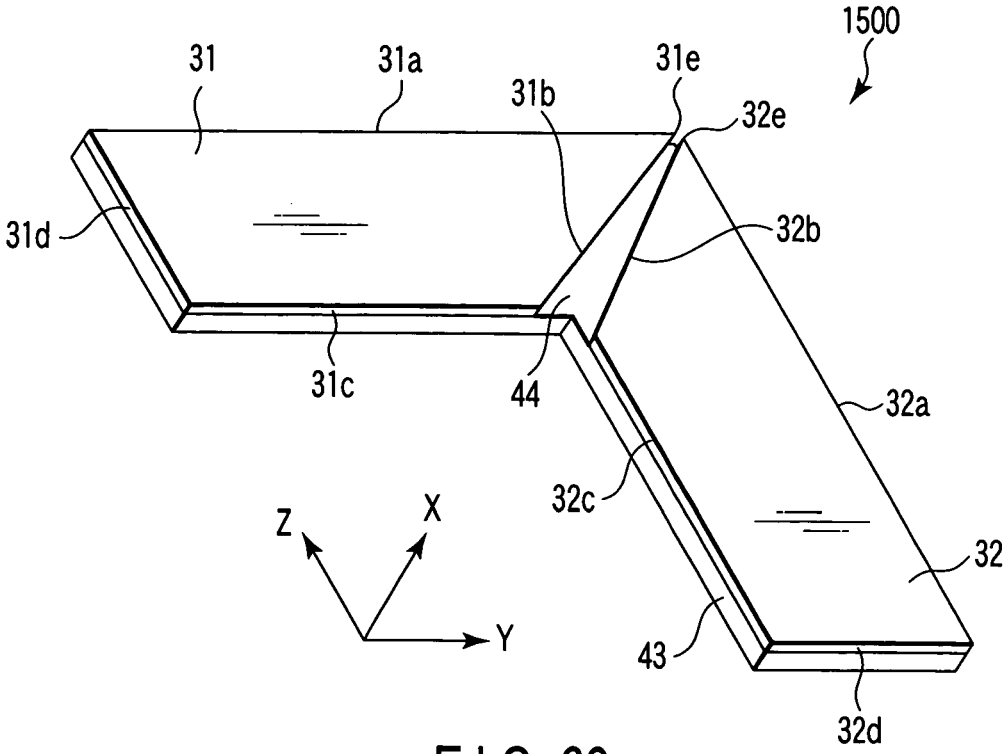
FIG. 60 is a perspective view showing a structure of a wideband antenna regarding a fourteenth embodiment of the invention.

FIG. 60 is the perspective view showing the structure of the wideband antenna 1500 regarding the fourteenth embodiment of the invention. The same parts as those of FIG. 39 are referred to the same reference numerals and detail thereof will be omitted.

As shown in FIG. 60, the antenna 1500 comprises the conductive elements 31, 32 and a dielectric substrate 43.

The substrate 43 is a thin plate made of a dielectric and formed in L-shape.

The elements 31, 32 are attached to the same surface of the substrate 43 in a state that the top 31*e* and the top 32*e* are opposite to each other. In this case, the tops 31*e*, 32*e* are positioned close to corner sections of outer sides formed by the L-shape of the substrate 43. Each side 31*a* and 32*a* respectively takes along two sides of the outer sides formed by the L-shape of the substrate 43. Each side 31*c* and 32*c* takes along two sides of inner sides formed by the L-shape of the substrate 43. An angle formed by the tops 31*e*, 32*e* is smaller than 45°.

By such arrangements of the elements 31 and 32, a notch 44 is formed between the elements 31 and 32. A width of the notch 44 is narrowest between the tops 31*e* and 32*e*, and gradually becomes wider with getting apart from the tops 31*e*, 32*e*. That is, the notch 44 is shaped so that an intermediate point between the tops 31*e* and 32*e* is set as a reference point and the width becomes wider with getting apart from the reference point. Sizes of the elements 31, 32 are defined in the same manner as that of the tenth embodiment. Gradients of the sides 31*b* 32*b* are made wider than those of the tenth embodiment.

In the antenna 1500 having such a structure, resonant points are also defined in the same manner as that of the antenna 1100.

Figure 61:
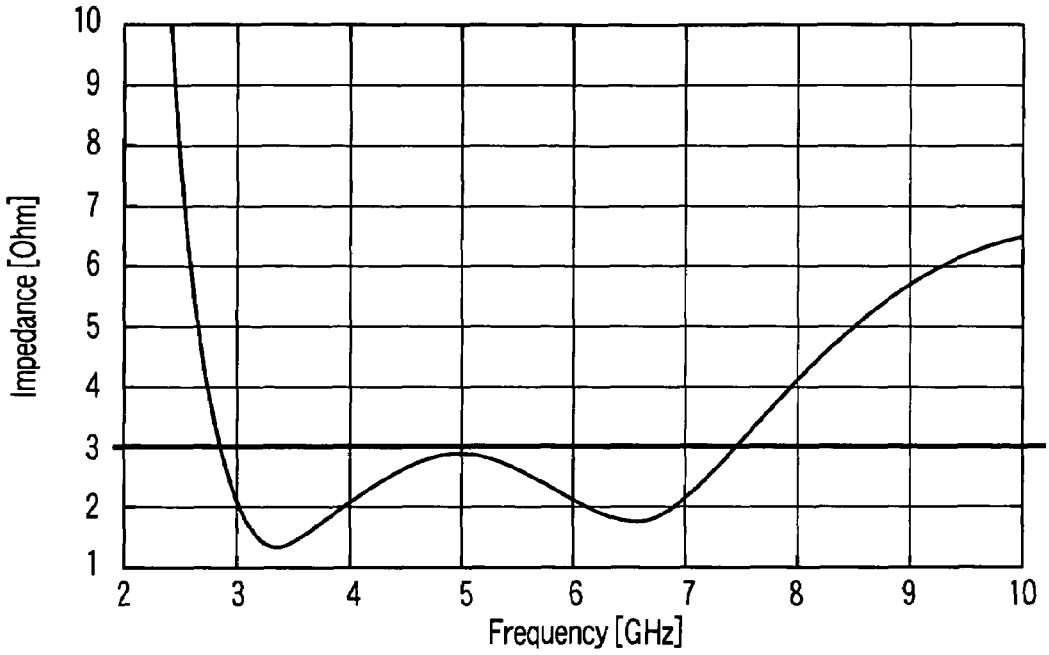
FIG. 61 is an illustration showing a characteristics of a VSWR of the antenna shown in FIG. 60.

FIG. 61 is the illustration showing the characteristics of the VSWR of the antenna 1500.

As is known from FIG. 61, also the antenna 1500 as well as the antenna 1100 can offers a wide transmittable/receivable band by a combination of two resonant frequencies.

Figure 62:
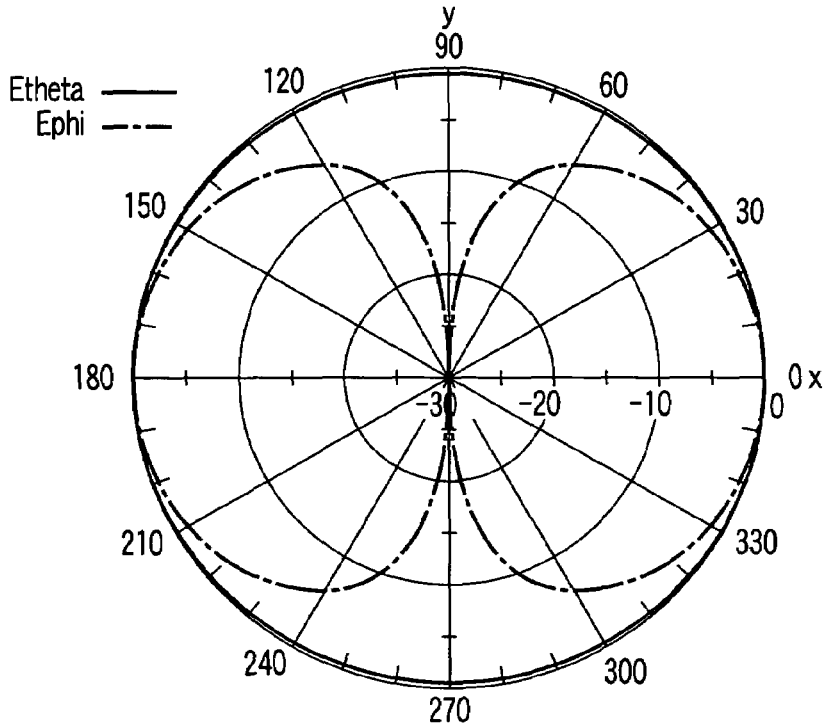
FIG. 62 is an illustration showing a radiation pattern of the antenna shown in FIG. 60.

FIG. 62 is the illustration showing the radiation pattern of the antenna 1500, and shows a radiation pattern at 3 GHz with respect to the XY plane of the coordinate system shown in FIG. 60.

As known from FIG. 62, the antenna 1500 can obtain excellent radiation patterns in respect to both horizontally and vertically polarized waves.

Furthermore, although the antenna 1500 can radiate such both polarized waves, it can be housed in a thin space. Whereby, the antenna 1500 is suitable for being mounted on a communication apparatus having low-profile housing such as a cellular phone.

Figure 63:
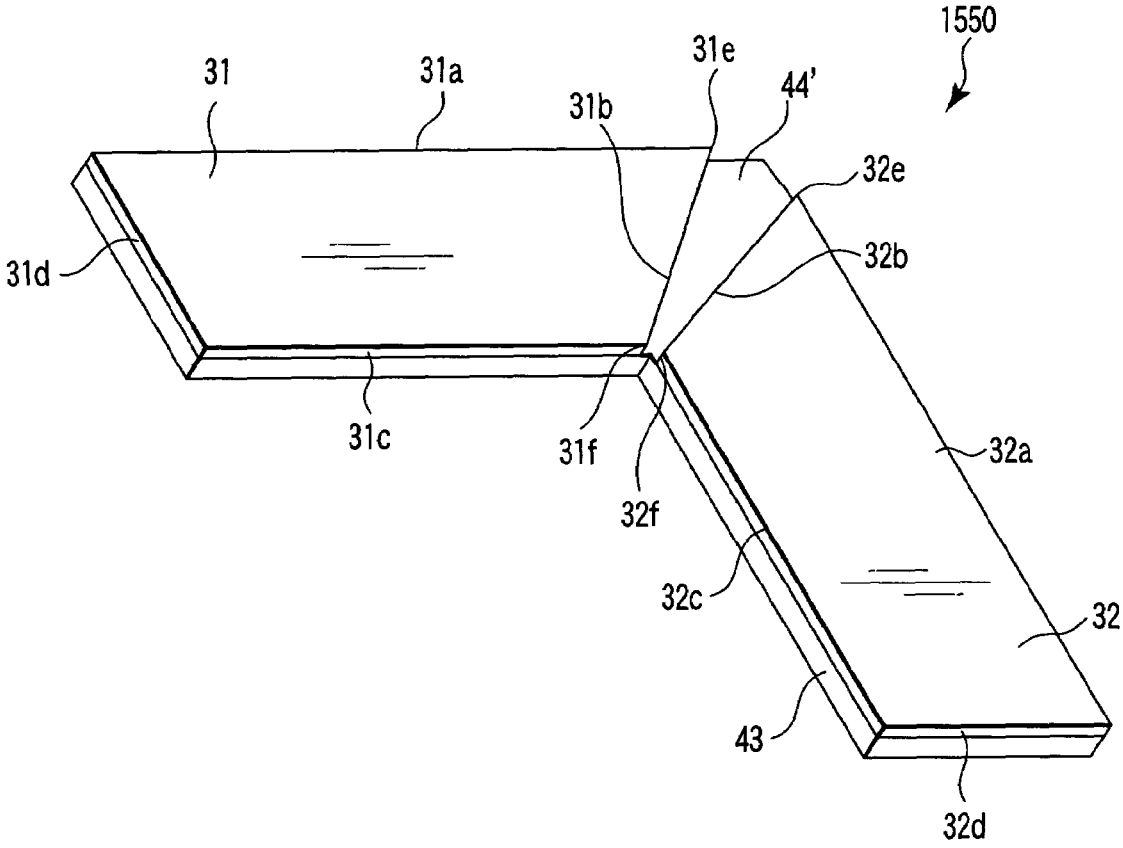
FIG. 63 is a perspective view of a wideband antenna regarding a modified embodiment of the fourteenth embodiment.

The fourteenth embodiment can be achieved with modification as the wideband antenna 1550 shown in FIG. 63.

The elements 31, 32 of the antenna 1550 varies angles formed by the tops 31*e*, 32*e* to an extent not smaller than 45°. Then, the tops 31*f*, 32*f* positioned near the corner sections of the inner sides formed by L-shape of the substrate 43 are opposite to each other. A small gap is provided between the tops 31*f* and 32*f*.

By such arrangements of the elements 31, 32, a notch 44' is formed between the elements 31 and 32. A width of the notch 44' becomes narrowest between the tops 31*f* and 32*f* and gradually becomes wider with getting apart from the tops 31*f*, 32*f*. That is, the notch 44' sets an intermediate point between the tops 31*f* and 32*f* to a reference point and has a shape so that the width becomes wider with getting apart from the reference point.

(Fifteenth Embodiment)

Figure 64:
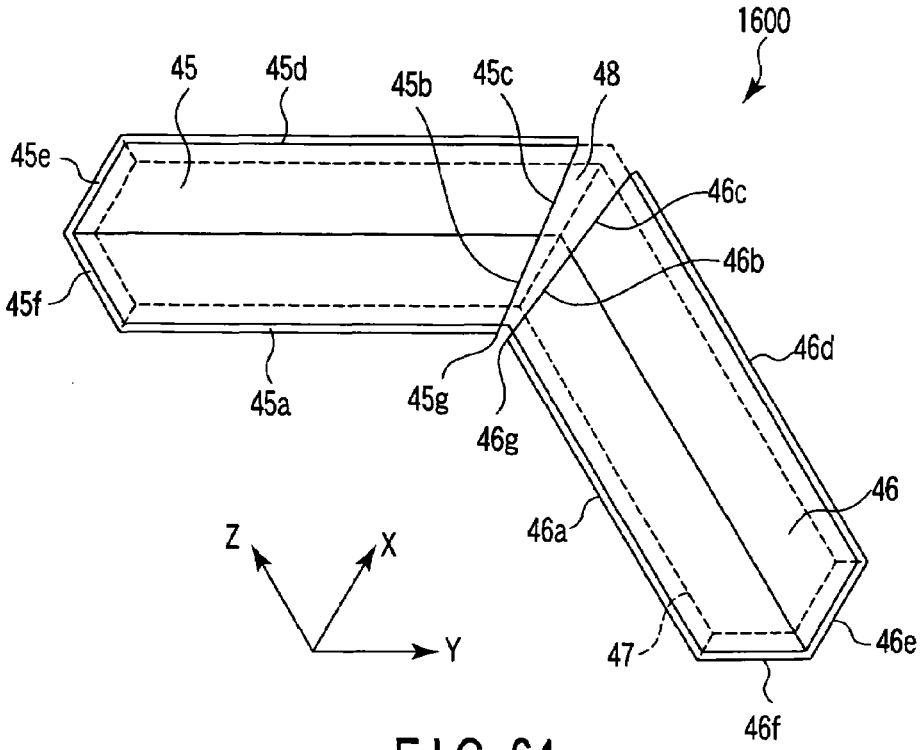
FIG. 64 is a perspective view of a structure of a wideband antenna regarding a fifteenth embodiment of the invention.

FIG. 64 is the perspective view showing the structure of the wideband antenna 1600 regarding the fifteenth embodiment of the invention.

As shown in FIG. 64, the antenna 1600 comprises conductive elements 45, 46. Each element 45, 46 is formed in a shape in which a pentagonal thin plate made of conductive material is approximately squarely bent.

As shown in FIG. 64, sides of the element 45 are referred to as sides 45*a*, 45*b*, 45*c*, 45*d*, 45*e* and 45*f*, respectively. The sides 45*b*, 45*c* contact with each other. The side 45*a* contacts the side 45*b* at an end on a side of the side 45*b* with which the side 45*c* is not contacted. The side 45*d* contacts side 45*c* at an end on a side of the side 45*c* with which the side 45*b* is not contacted. The side 45*e* almost squarely contacts side 45*d* at an end on a side of the side 45*d* with which the side 45*c* is not contacted. The side 45*f* approximately squarely contacts side 45*e* at an end on a side of the side 45*a* with which the side 45*b* is not contacted. A bending line of the element 45 passes through a contact point between the sides 45*b* and 45*c* and a contact point between the sides 45*e* and 45*f*. Sides 45*a*, 45*b* and 45*f* are positioned on the same surface. Sides 45*c*, 45*d* and 45*e* are positioned on the same surface. The surface with the sides 45*a*, 45*b* and 45*f* positioned thereon and the surface with the sides 45*c*, 45*d* and 45*e* positioned thereon are brought into mutually almost orthogonal states.

As shown in FIG. 64, sides of the element 46 are referred to as sides 46*a*, 46*b*, 46*c*, 46*d*, 46*e* and 46*f*, respectively. The sides 46*b*, 46*c* contact with each other. The side 46*a* contacts the side 46*b* at an end on a side of the side 46*b* with which the side 46*c* is not contacted. The side 46*d* contacts side 46*c* at an end of on a side the side 46*c* with which the side 46*b* is not contacted. The side 46*e* almost squarely contacts side 46*d* at an end on a side of the side 46*d* with which the side 46*c* is not contacted. The side 46*f* almost squarely contacts side 46*e* at an end on a side of the side 46*e* with which the side 46*d* is not contacted. The side 46*f* almost squarely contacts side 46*a* at an end on a side of the side 46*a* with which the side 46*b* is not contacted. A bending line of the element 46 passes through a contact point between the sides 46*b* and 46*c*, and a contact point between the sides 46*e* and 46*f*. Sides 46*a*, 46*b* and 46*f* are positioned on the same surface. Sides 46*c*, 46*d* and 46*e* are positioned on the same surface. The surface with the sides 46*a*, 46*b* and 46*f* positioned thereon and the surface with the sides 46*c*, 46*d* and 46*e* positioned thereon are intersected almost orthogonally with each other.

In the elements 45 and 46, a top 45*g* and a top 46*g* face each other across a small gap, and the side 45*a* and the side 46*a* are respectively positioned on two straight lines intersecting almost orthogonally each other, and also the side 45*d* and the side 46*d* are respectively positioned on two straight lines intersecting almost orthogonally each other. The top 45*g* is formed at the contact point between the side 45*a* and the side 45*b*. The top 46*g* is formed at the contact point between the side 46*a* and the side 46*b*.

Thus, if a coordinate system is defined as shown in FIG. 64, every side 45*a*, 45*b*, 45*e*, 45*f*, 46*a*, 46*b*, 46*f* is positioned on a YZ plane. Every side 45*c*, 45*d*, 45*e* is positioned on an XY plane. Every side 46*c*, 46*d*, 46*e* is positioned on a ZX plane.

According to such arrangements of the elements 45, 46, a notch 48 is formed between the side 45*b* and the side 46*b* and between the side 45*c* and the side 46*c*. The side 45*b*, 45*c*, 46*b* and 46*c* are inclined so that the width of the notch 48 becomes narrowest between the tops 45*g* and 46*g* and becomes gradually wider with getting apart from the tops 45*g*, 46*g*. Thus, the notch 48 sets an intermediate point between the tops 45*g* and 46*g* as a reference point, and the notch 48 has a shape so that the width thereof becomes wider with getting apart from the reference point.

The elements 45, 46 are mounted on a dielectric substrate 47 in the state mentioned above.

Sizes of the elements 45, 46 are defined in consideration with wavelengths λ1, λ2 in the same manner that of the tenth embodiment. That is, a length L3 from a contact point between the sides 45*d* and 45*e* up to a contact point between the sides 46*d* and 46*e* along with the sides 45*d*, 45*c*, 45*b*, 46*b* 46*c*, and 46*d* is set to approximately λ1×½. A length L4 from a contact point between the sides 45*c* and 45*d* up to a contact point between the sides 46*c* and 46*d* along with the sides 45*c*, 45*b*, 46*b* and 46*c* is set to approximately λ2×½. The length L3 is ideally set to λ1×½, i.e. λ1×0.5, however, extent from λ1×0.4 to λ1×10.6 may be sufficient. The length L4 is ideally set to λ2×½, i.e. λ2×0.5, however, an extent from λ2×0.4 to λ2×0.6 may be sufficient.

The antenna 1600 structured as mentioned above defines a point as a power feeding point between a section near the top 45*g* and a section near the top 16*g*.

Also in the antenna 1600 having such a structure mentioned above, resonant points are defined in the same manner as that of the antenna 1100.

Figure 65:
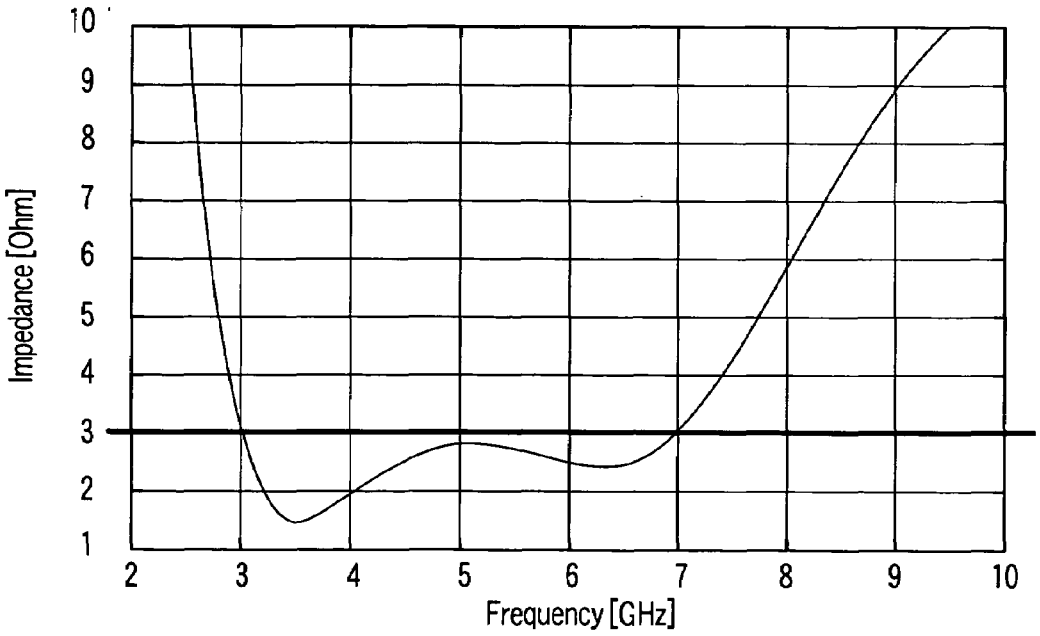
FIG. 65 is an illustration showing a characteristics of a VSWR of the antenna shown in FIG. 64.

FIG. 65 is the illustration showing the characteristics of the VSWR of the antenna 1600.

As is known from FIG. 65, also the antenna 1600 as well as the antenna 1100 can offers a wide transmittable/receivable band by a combination of two resonant frequencies.

Figure 66C:
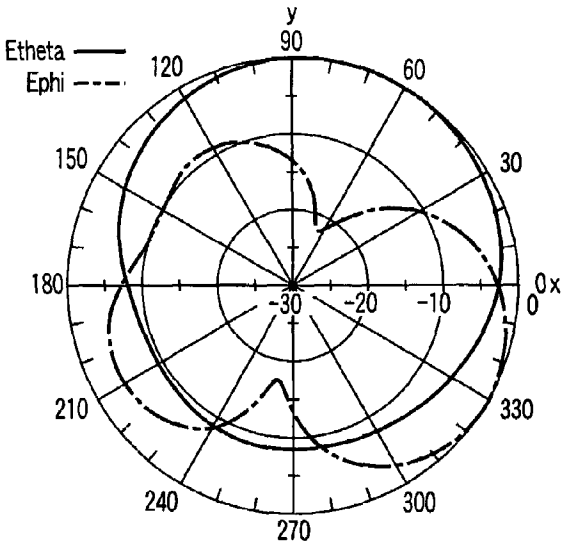
FIGS. 66A–66F are illustrations showing radiation patterns of the antenna shown in FIG. 64.
Figure 66B:
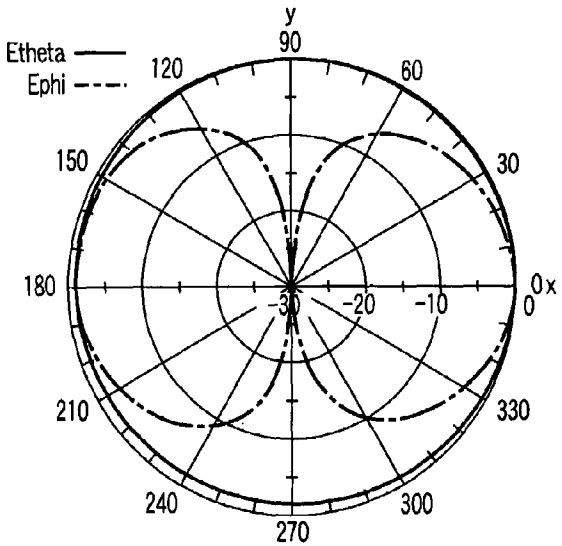
Figure 66A:
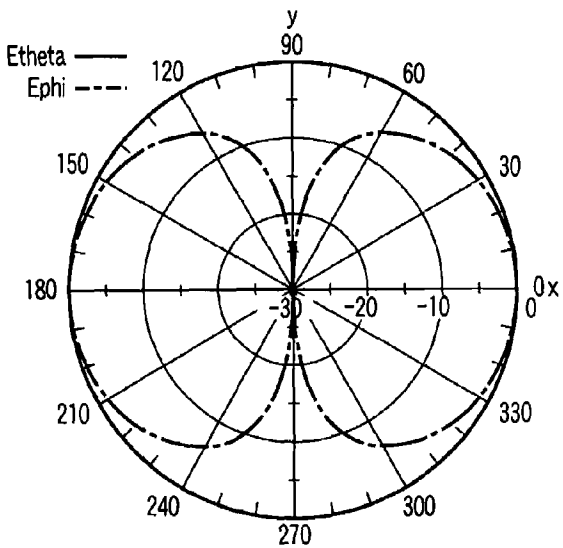
Figures 66D, 66E, 66F:
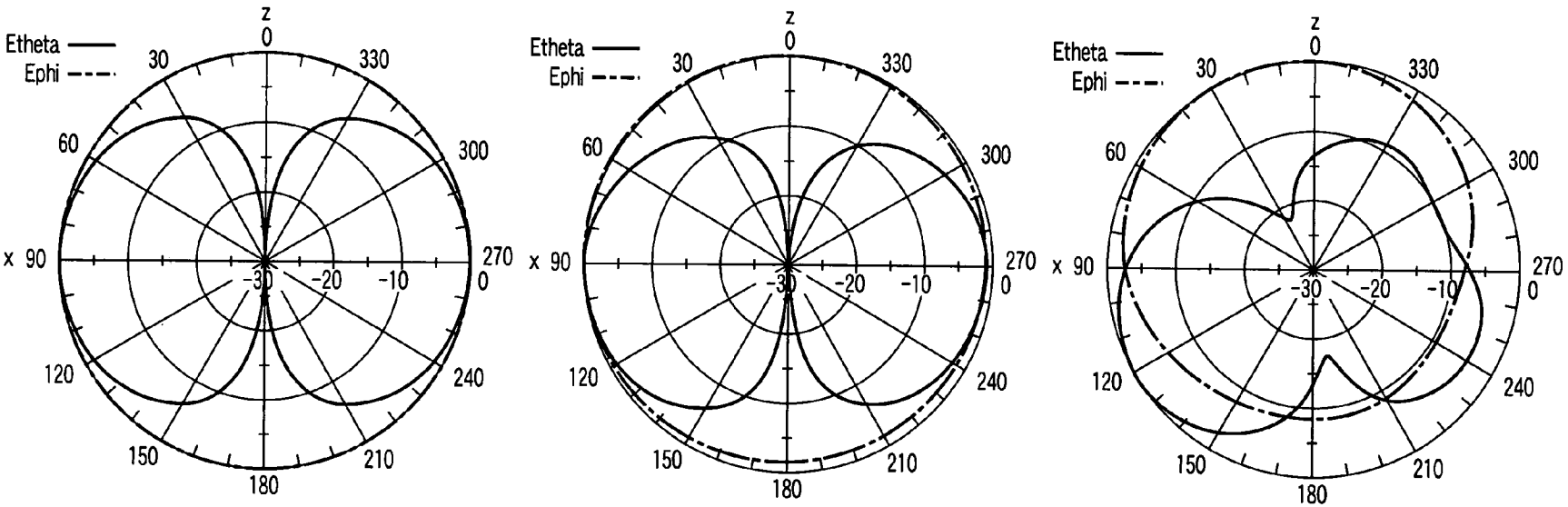

FIGS. 66A to 66F are illustrations showing radiation patterns of the antenna 1600. FIGS. 66A to 66C show radiation patterns on XY planes of a coordinate system in FIG. 64, and FIGS. 66D to 66F show radiation patterns on ZX planes of the coordinate system shown in FIG. 64. Moreover, FIG. 66A and FIG. 66D show a radiation pattern at 3 GHz, FIG. 66B and FIG. 66E show a radiation pattern at 5 GHz, and FIG. 66C and FIG. 66F show a radiation pattern at 7 GHZ.

As known from these FIGS. 66A to 66F, the antenna 1600 can obtain excellent radiation patterns in both horizontally and vertically polarized waves.

(Sixteenth Embodiment)

Figure 67:
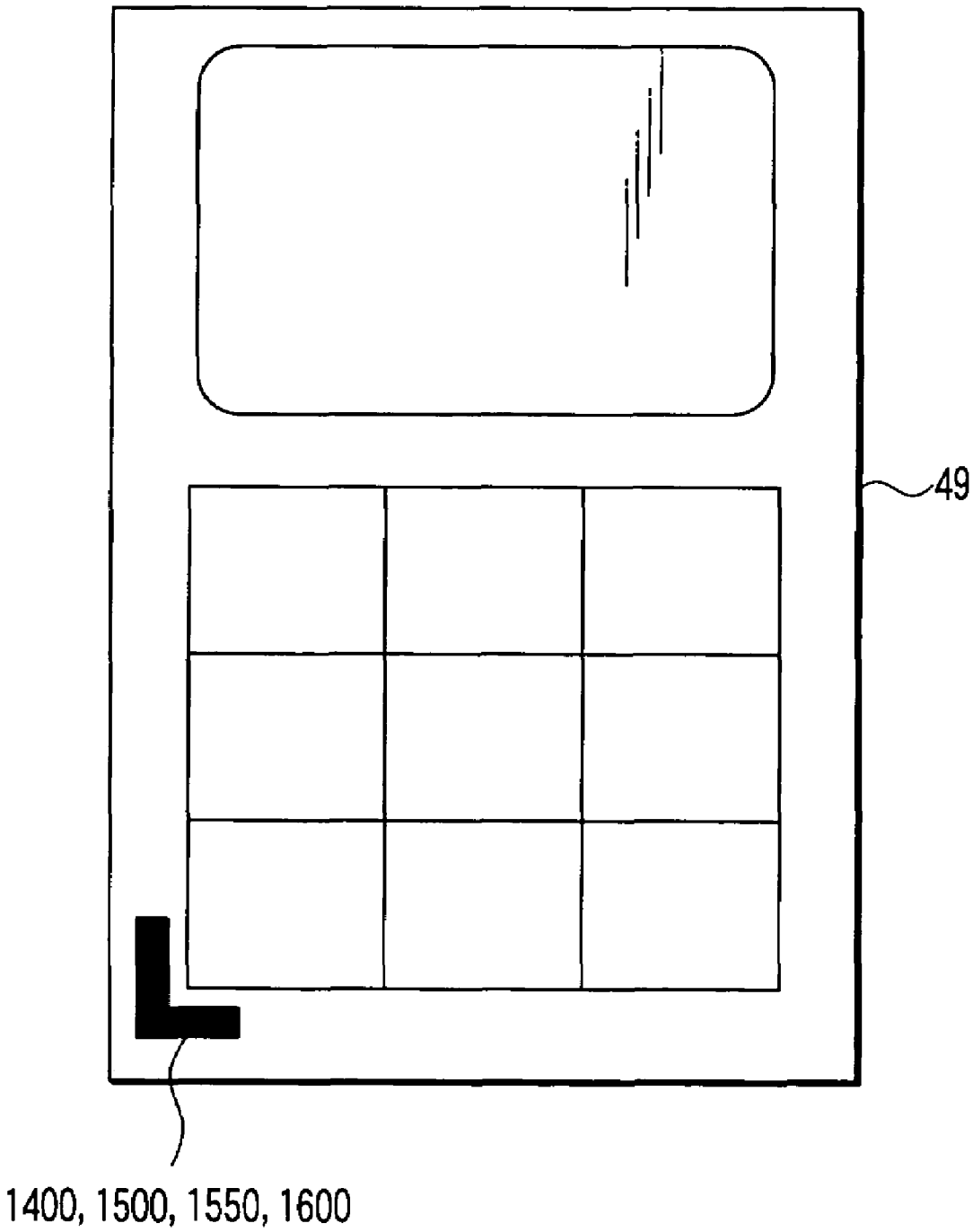
FIG. 67 is an illustration showing a structure of a communication apparatus regarding a sixteenth embodiment of the invention.

FIG. 67 is the illustration showing the structure of the communication apparatus regarding the sixteenth embodiment of the invention.

The communication apparatus is composed by housing component elements such as a variety of electric parts into a housing 49 having an approximately rectangular shape. As for an antenna to transmit and receive a radio signal, any one of the antennas 1400, 1500, 1550 and 1600 described above is mounted on the communication apparatus. Each antenna 1400, 1500, 1550 and 1600 has a shape so that two conductive elements make the respective corner sections as mentioned above. Then, the respective antennas 1400, 1500, 1550 and 1600 are disposed into the housing 49 so that the respective corner sections made by two elements to be taken along with the corner sections of the housing 49.

Consequently, any one of the antennas 1400, 1500, 1550 and 1600 can be efficiently housed into the housing 49, a flexibility of housing of other component elements can be improved and the housing 49 can be miniaturized.

(Seventeenth Embodiment)

Figure 68B:
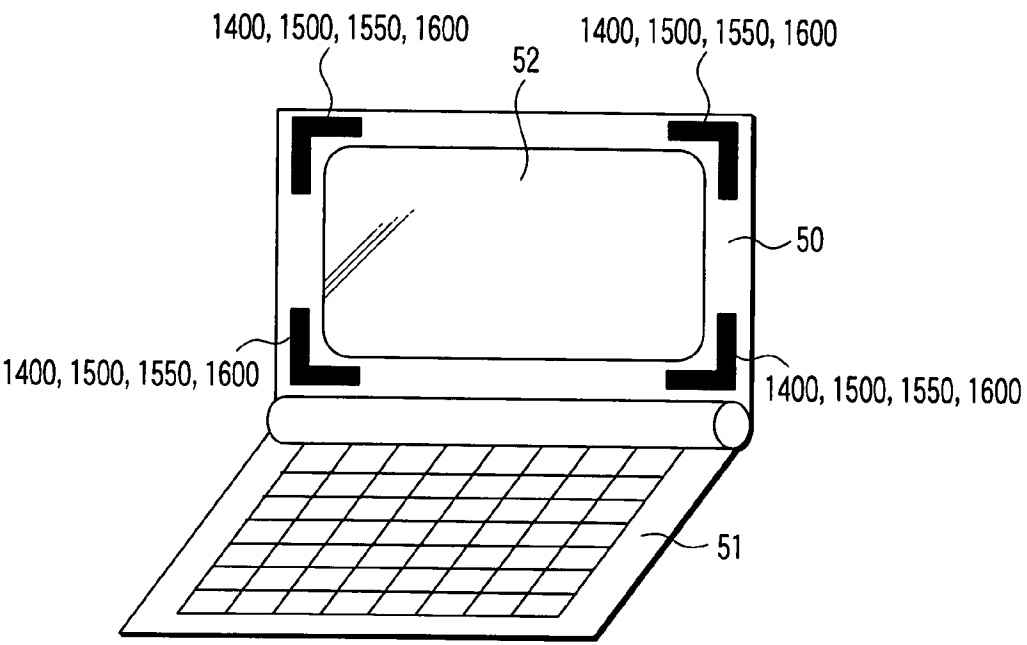
FIGS. 68A, 68B are illustrations showing structures of a communication apparatus regarding a seventeenth embodiment of the invention.
Figure 68A:
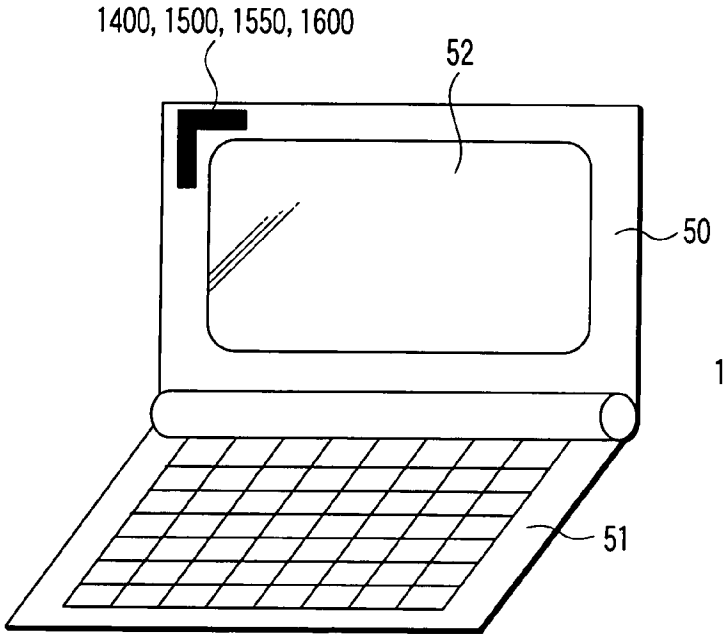

FIGS. 68A, 68B are the illustrations showing the communication apparatus regarding the seventeenth embodiment of the invention.

The communication apparatus is composed by housing component elements such as a variety of electric parts into an upper housing 50 and a lower housing 51 respectively having approximately rectangular shapes. As for an antenna to transmit and receive a radio signal, any one of the wideband antennas 1400, 1500 and 1600 is mounted on the communication apparatus.

In this kind of communication apparatus, a display device 52 is often housed in the upper housing 50. Almost all of an inner space of the upper housing 50 is used as a housing space for the display device 52. At the same time, some of spaces are often remain at corner sections of the upper housing 50. On the other hand, the antennas 1400, 1500, 1550 and 1600 are shaped so that two conductive elements respectively make corner sections as described above. The antennas 1400, 1500, 1550 and 1600 are arranged inside the housing 49 of the sixteenth embodiment by making the corner section formed by the two elements run along the corner sections of the upper housing 50.

FIG. 68A shows an example in which any one of the antennas 1400, 1500, 1550 and 1600 is housed in a corner section on the upper-left of the upper housing 50. FIG. 68B shows an example in which any one of the antennas 1400, 1500, 1550 and 1600 is housed in any one of the four corner sections, respectively.

Accordingly, the communication apparatus can efficiently house the antennas 1400, 1500, 1550 and 1600 in the upper housing 50.

Each embodiment described above can be achieved in a variety of modified embodiments.

Figure 69:
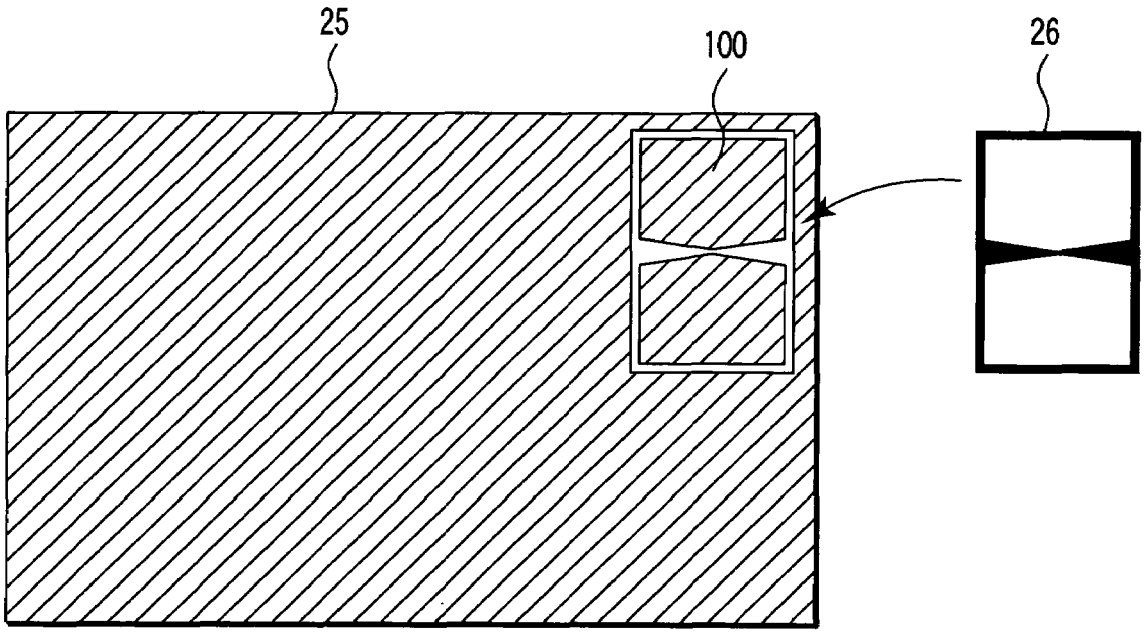
FIG. 69 is an illustration showing a specific example achieving a conductive element as conductive patters formed on a substrate.

In each embodiment, conductive elements can be also achieved as conductive patterns formed on the dielectric substrates. For example, as shown in FIG. 69, the antenna 100 consisting of conductive patterns can be produced by peeling off a masking 26 from a substrate 25 after spraying a conductive plating film onto the substrate 25 in a state that the masking 26 is stuck on the substrate 25.

In each embodiment, a supporting member to support the conductive element may be a frame-like member to surround the conductive element.

In each embodiment, two elements may be held at the positional relationship of each embodiment by the supporting member with an arm-like shape, etc. different from that of the dielectric substrate.

In the case that a conductive element with a bent-shape is used as the seventh embodiment or the eighth embodiment, the bending angle is not limited to a right-angle and may be an arbitrary angle. Or, the element may be curved to a curved surface. For example, the eighth embodiment may be modified so that the element is formed in a cylindrical shape.

In the eleventh embodiment, either the notch 37 or the notch 38 may be eliminated.

In the thirteenth embodiment, the face with the element 31 mounted thereon and the face with the element 32 mounted thereon may be intersected with inclination.

In the fourteenth embodiment, the straight line with the side 31*a* positioned thereon and the straight line with the side 32*a* positioned thereon may be intersected with inclination.

In the fifteenth embodiment, the straight line with the side 45*a* positioned thereon and the straight line with the side 46*a* positioned thereon may be intersected with inclination.

In the fifteenth embodiment, the face with the side 45*b* positioned thereon and the face with the side 45*c* positioned thereon may be intersected with inclination.

In the fifteenth embodiment, the face with the side 46*b* positioned thereon and the face with the side 46*c* positioned thereon may be intersected with inclination.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A wideband antenna in which a first conductive element and a second conductive element are arranged so that a first notch of which the width becomes wider with getting apart from a reference point to be a power feeding point is formed between the first conductive element and the second conductive element, wherein the first conductive element and the second conductive element have shapes satisfying two conditions:

(i) a sum of the lengths of one or more sides facing the first notch and a first side terminating at one edge of a wider opening of the first notch, these sides pertaining to the first conductive element, and the lengths of one or more sides facing the first notch and a second side terminating at one edge of the wider opening of the first notch, these sides pertaining to the second conductive element, is approximately half of a first wavelength corresponding to a first frequency within a required frequency band; and (ii) a sum of the lengths of one or more sides pertaining to the first conductive element and facing the first notch, and the lengths of one or more sides pertaining to the second conductive element and facing the first notch is approximately half of a second wavelength corresponding to a second frequency within the required frequency band, the second frequency being higher than the first frequency.

2. The wideband antenna according to claim 1, wherein the wideband antenna further comprise a holding member made of dielectric to hold the first conductive element and the second conductive element in the arrangement state.

3. The wideband antenna according to claim 1, wherein the first conductive element and the second conductive element form a second notch extending in a direction different from that of the first notch and having a width becoming wider with getting apart from the reference point, and the first conductive element and the second conductive element have respective shapes satisfying two conditions:

(i) a sum of the lengths of one or more sides facing the second notch and a third side terminating at one edge of wider opening of the second notch, these sides pertaining to the first conductive element, and the lengths of one or more sides facing the second notch and a fourth side terminating at one edge of the wider opening of the second notch, these sides pertaining to the second conductive element, is approximately half of the first wavelength; and (ii) a sum of the lengths of one or more sides pertaining to the first conductive element and facing the second notch, and the lengths of one or more sides pertaining to the second conductive element and facing the second notch is approximately half of the second wavelength.

4. The wideband antenna according to claim 3, wherein the first conductive element and the second conductive element are arranged so that the shapes of the first notch and the second notch become approximately congruent with each other.

5. The wideband antenna according to claim 3, wherein directions of the first notch and the second notch are different by 180 degrees with each other.

6. The wideband antenna according to claim 3, wherein directions of the first notch and the second notch are different by 90 degrees with each other.

7. The wideband antenna according to claim 3, wherein the first conductive element and the second conductive element are arranged on the same surface.

8. The wideband antenna according to claim 7, wherein the first conductive element and the second conductive element are bent at a reference line extending in an alignment direction of the first conductive element and the second conductive element and passing the reference point.

9. The wideband antenna according to claim 8, wherein the first conductive element and the second conductive element are squarely bent on the reference line.

10. The wideband antenna according to claim 3, wherein the first conductive element is a tubular member having a gap between the first side and the third side, and the second conductive element is a tubular member having a gap between the second side and the fourth side.

11. The wideband antenna according to claim 3, wherein the first conductive element and the second conductive element are respectively arranged on individual surfaces which intersect with each other.

12. The wideband antenna according to claim 3, wherein the one or more side pertaining to the first conductive element and facing the first notch, the one or more side pertaining to the first conductive element and facing the second notch, the one or more side pertaining to the second conductive element and facing the first notch, the one or more side pertaining to the second conductive element and facing the second notch, and the first to the fourth sides are formed linear.

13. The wideband antenna according to claim 1, wherein the first conductive element further has a third side terminating at one edge of narrower opening of the first notch and approximately parallel to the first side, and wherein the second conductive element further has a fourth side terminating at one edge of narrower opening of the first notch and approximately parallel to the second side.

14. The wideband antenna according to claim 13, wherein the first conductive element has only one side facing the first notch and has a first polygonal planer section having the one side, the first side and the third side, and wherein the second conductive element has only one side facing the first notch and has a second polygonal planer section having the one side, the second side and the fourth side.

15. The wideband antenna according to claim 14, wherein the first conductive element and the second conductive element are arranged so that the first planer section and the second planer section are positioned on the same surface.

16. The wideband antenna according to claim 15, wherein the first conductive element and the second conductive element are arranged so that the first side and the second side are positioned on the same straight line.

17. The wideband antenna according to claim 15, wherein the first conductive element and the second conductive element are arranged so that the first side and the second side are positioned on the first straight line and the second straight line intersecting with each other.

18. The wideband antenna according to claim 14, wherein the first conductive element and the second conductive element are arranged so that the first planer section and the second planer section are positioned on two surfaces intersecting with each other, respectively.

19. The wideband antenna according to claim 13, wherein the first conductive element has a shape in which a notch dividing the third side into two is formed within a range from a end closest to the reference point up to one-quarter of a third wavelength corresponding to an upper limit frequency of the required frequency band.

20. The wideband antenna according to claim 13, wherein the first conductive element and the second conductive element have symmetric shapes with each other.

21. The wideband antenna according to claim 13, wherein:

the one or more sides facing the first notch and pertaining to the first conductive element are a fifth side and a sixth side;

the first conductive element has a first planer section and a second planer section intersecting each other with a straight line passing through a contact point between the fifth side and the sixth side and substantially parallel to the first side as a boundary;

the one or more sides facing the first notch and pertaining to the second conductive element are a seventh side and a eighth side;

the second conductive element has a third planer section and a fourth planer section intersecting each other with a straight line passing through a contact point between the seventh side and the eighth side and substantially parallel to the second side as a boundary and with an angle almost equal to an intersecting angle formed by the first planer section and the second planer section; and the first conductive element and the second conductive element are arranged so the first planer section and the third planer section are positioned on the same surface; and the first side and the second side are positioned on two straight lines intersecting with each other.

22. A communication apparatus comprising:

a housing formed with a corner section; and the wideband antenna according to claim 17, wherein the wideband antenna is arranged inside the housing by making a corner section formed by the first conductive element and the second conductive element run along the corner section of the housing.

23. A communication apparatus comprising:

a housing formed with a corner section; and the wideband antenna according to claim 18, wherein the wideband antenna is arranged inside the housing by making a corner section formed by the first conductive element and the second conductive element run along the corner section of the housing.

24. A communication apparatus comprising:

a housing formed with a corner section; and the wideband antenna according to claim 21, wherein the wideband antenna is arranged inside the housing by making a corner section formed by the first conductive element and the second conductive element run along the corner section of the housing.

* * * * *